US012359428B2

(12) United States Patent
Kabatsi et al.

(10) Patent No.: US 12,359,428 B2
(45) **Date of Patent: *Jul. 15, 2025**

(54) CEILING SYSTEM

(71) Applicant: Arktura LLC, Gardena, CA (US)

(72) Inventors: Chris Kabatsi, Venice, CA (US); Robert Kilian, Venice, CA (US); Kevin Kane, Los Angeles, CA (US); John Johnston, Beaumont, CA (US); Moti Tavassoli, Los Angeles, CA (US); Keith Berry, Marina Del Rey, CA (US)

(73) Assignee: Arktura LLC, Carson, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/416,511

(22) Filed: Jan. 18, 2024

(65) Prior Publication Data

US 2024/0240460 A1 Jul. 18, 2024

Related U.S. Application Data

(62) Division of application No. 17/704,265, filed on Mar. 25, 2022, now Pat. No. 11,891,804.

(60) Provisional application No. 63/167,780, filed on Mar. 30, 2021.

(51) Int. Cl.

| | |
|---|---|
| ***E04B 9/06*** | (2006.01) |
| ***E04B 9/00*** | (2006.01) |
| *E04B 9/36* | (2006.01) |

(52) U.S. Cl.

CPC ..... *E04B 9/06* (2013.01); *E04B 9/005* (2013.01); *E04B 9/001* (2013.01); *E04B 9/366* (2013.01)

(58) Field of Classification Search

CPC ..... E04B 9/001; E04B 9/005; E04B 9/006; E04B 9/04; E04B 9/067; E04B 9/18; E04B 9/22; E04B 9/225; E04B 9/36; E04B 9/366; E04B 9/26; E04B 2009/062

See application file for complete search history.

(56) References Cited

U.S. PATENT DOCUMENTS 2,059,483 A * 11/1936 Parsons ..... E04B 9/26 52/775
2,066,205 A * 12/1936 Keating ..... E04B 9/183 52/778
2,066,206 A 12/1936 Keating
2,998,112 A * 8/1961 Burgin ..... E04B 9/26 52/772

(Continued)

*Primary Examiner* — Kyle J. Walraed-Sullivan

(74) *Attorney, Agent, or Firm* — Patrick Sheldrake

(57) ABSTRACT

A ceiling system, a method of forming a ceiling system, and a cover for use therein. The cover may include an elongated cover body. The elongated cover body may have a floor portion and first and second sidewall portions extending upward from the floor portion. The cover may have a cover slot in a top surface of the elongated cover body that extends downward into the elongated cover body between the first and second sidewall portions. The cover slot may have a narrowed section and a widened section below the narrowed section. A plurality of transverse cover notches may be arranged in a spaced apart manner along the elongated cover body. Each of the plurality of transverse cover notches may be formed in a bottom portion of the elongated cover body and may intersect the widened section and at least a portion of the narrowed section of the cover slot.

19 Claims, 40 Drawing Sheets

(56) References Cited

U.S. PATENT DOCUMENTS

| | | | | | |
|---|---|---|---|---|---|
| 3,139,162 | A * | 6/1964 | Spangenberg | E04B 9/26 | 52/762 |
| 3,182,773 | A | 5/1965 | Laaksonen | | |
| 3,204,383 | A * | 9/1965 | Adams | E04B 9/26 | 52/404.1 |
| 3,212,224 | A * | 10/1965 | Spangenberg | E04B 9/26 | 52/459 |
| 3,461,630 | A * | 8/1969 | Lovullo | E04B 9/26 | 52/506.09 |
| 3,755,988 | A | 9/1973 | Van Der Sluys | | |
| 3,843,086 | A * | 10/1974 | Ptak | F21V 21/02 | 52/506.07 |
| 3,969,865 | A * | 7/1976 | Andersen | E04B 9/20 | 52/506.07 |
| 4,967,530 | A * | 11/1990 | Clunn | E04B 9/242 | 52/204.591 |
| 5,033,247 | A * | 7/1991 | Clunn | E04B 9/02 | 52/204.591 |
| 5,313,759 | A * | 5/1994 | Chase, III | E04B 9/18 | 52/39 |
| 5,611,185 | A * | 3/1997 | Wilz | E04B 9/064 | 52/471 |
| 6,205,733 | B1 * | 3/2001 | LaLonde | E04B 9/30 | 52/506.07 |
| 8,733,053 | B2 | 5/2014 | Kabatsi | | |
| 8,782,987 | B2 | 7/2014 | Kabatsi | | |
| 9,038,344 | B2 | 5/2015 | Mayer | | |
| 9,163,402 | B2 | 10/2015 | Kabatsi | | |
| 9,469,988 | B2 * | 10/2016 | Myers | E04B 9/006 | |
| D802,173 | S | 11/2017 | Kilian | | |
| D849,969 | S | 5/2019 | Kilian | | |
| 10,808,402 | B2 | 10/2020 | Adams | | |
| 10,961,705 | B2 | 3/2021 | Yu | | |
| 11,891,804 | B2 * | 2/2024 | Kabatsi | E04B 9/366 | |
| 2002/0112424 | A1 * | 8/2002 | Zaborowski | E04B 9/064 | 52/220.6 |
| 2006/0272256 | A1 * | 12/2006 | Frecska | H01R 25/16 | 52/506.07 |
| 2015/0040494 | A1 * | 2/2015 | Lehane, Jr. | E04B 9/122 | 52/506.07 |
| 2015/0167297 | A1 * | 6/2015 | St-Laurent | E04B 9/22 | 52/700 |
| 2018/0283004 | A1 | 10/2018 | Gilette | | |
| 2019/0072249 | A1 * | 3/2019 | Bobbo | E04B 9/006 | |
| 2021/0062506 | A1 * | 3/2021 | Yu | E04B 9/001 | |
| 2022/0106788 | A1 * | 4/2022 | Laydera-Collins | E04B 9/064 | |

* cited by examiner

CEILING SYSTEM

CROSS-REFERENCE TO RELATED APPLICATIONS

The present application claims priority to U.S. Provisional Patent Application Ser. No. 63/167,780, filed Mar. 30, 2021, the entirety of which is incorporated herein by reference.

BACKGROUND

Co-owned U.S. Pat. No. 8,733,053 discloses systems and methods for supported architectural designs. Co-owned U.S. Pat. No. 8,782,987 discloses supported architectural structures. Fixtures have conventionally provided only horizontally oriented surfaces or vertically oriented planar segments. Furthermore, the attachment of baffle-like members to the support beams of conventional ceiling systems has been somewhat onerous.

There is a need for new acoustical ceiling systems and wall architectural fixtures. There is a further need for an improved ceiling system providing sound-absorption/sound attenuation benefits. There is an additional need for an improved ceiling system that provides a modular construction. There is an additional need for an improved ceiling system that provides a continuous aesthetic visual pattern. There is also a need for an improved ceiling system that provides improved connection between components of the system. There is a need for an improved ceiling system that provides for various configurations of the components of the system. There is an additional need for an improved ceiling system that is easier to manufacture, assemble, adjust, and maintain. The present invention satisfies these needs and provides other related advantages

BRIEF SUMMARY

A ceiling system which includes support beams, elongated covers that at least partially cove the support beams, and baffles which attach to the support beams through notches or grooves in the elongated covers. The support beams may have a vertical web portion, a flange portion at a top end of the vertical web portion, and bulb portion at a bottom end of the vertical web portion. The elongated may have a cover body and a cover slot in a top surface of the cover body. The elongated covers may be mounted to the support beams so that the bulb portions of the support beams are located within the cover slots of the elongated covers. The baffles may extend between and be mounted to adjacent ones of the plurality of support beams so that the baffle extends into the notches of the elongated covers and the bulb portions of the support beams are located within slots of the baffle.

In one aspect, the invention may be a ceiling system comprising: a first support beam extending along a first beam axis and comprising a vertical web portion and a beam protuberance at a lower end of the vertical web portion; a first cover extending along a first cover axis and comprising: a first cover body having a floor portion and first and second sidewall portions extending upward from the floor portion in an opposing manner; and a first cover slot in a top surface of the first cover body and extending downward into the first cover body between the first and second sidewall portions, the first cover slot extending substantially parallel to the first cover axis; and the first cover mounted to the first support beam so that: (1) the first beam axis and the first cover axis are substantially parallel to one another; (2) the vertical web portion of the first support beam is located within a first section of the first cover slot; and (3) the beam protuberance of the first support beam is located within a second section of the first cover slot.

In another aspect, the invention may be a cover for use in a ceiling system, the cover comprising: an elongated cover body extending along a cover axis from a first end to a second end, the elongated cover body comprising a floor portion and first and second sidewall portions extending upward from the floor portion in an opposing manner; a cover slot in a top surface of the cover body and extending downward into the first cover body between the first and second sidewall portions, the cover slot having a narrowed section and widened section below the narrowed section; and a plurality of transverse cover notches arranged in a spaced apart manner along the elongated cover body, each of the plurality of transverse cover notches formed in a bottom portion of the elongated cover body and intersecting the widened section and at least a portion of the narrowed section of the cover slot.

In yet another aspect, the invention may be a ceiling system comprising: a plurality of support beams arranged in a non-intersecting arrangement, each of the plurality of beams extending along a beam axis and comprising a vertical web portion, a flange portion at a top end of the vertical web portion, and a bulb portion at a bottom end of the vertical web portion; a plurality of covers, each of the covers extending along a cover axis and comprising: an elongated cover body; and a cover slot in a top surface of the elongated cover body; and the plurality of covers mounted to the plurality of support beams so that the bulb portions of the support beams are located within the cover slots of the covers and the cover axis of the each of the plurality of covers is substantially parallel to the beam axis of the support beam to which it is mounted.

In still another embodiment, the invention may be a method of forming a ceiling system comprising: a) aligning a support beam and a cover so that a beam protuberance at a lower end of a vertical web portion of the support member is aligned with a cover slot in a top surface of a cover body of the cover; b) slidably inserting the beam protuberance into a first section of the cover slot, thereby causing first and second sidewall portions of the cover body to flex away from one another; and c) sliding the beam protuberance downward through the first section of the cover slot until the beam protuberance enters a second section of the cover slot, wherein upon the beam protuberance being disposed within the second section of the cover slot, the first and second sidewall portions of the cover body moving back toward one another.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 6 illustrates a front elevation view of unfolded cover of FIG. 5 (a rear elevation view of the unfolded cover being substantially identical to the front elevation view), and with curved arrows indicating directions that sides are folded in;

DETAILED DESCRIPTION

Figure 1:
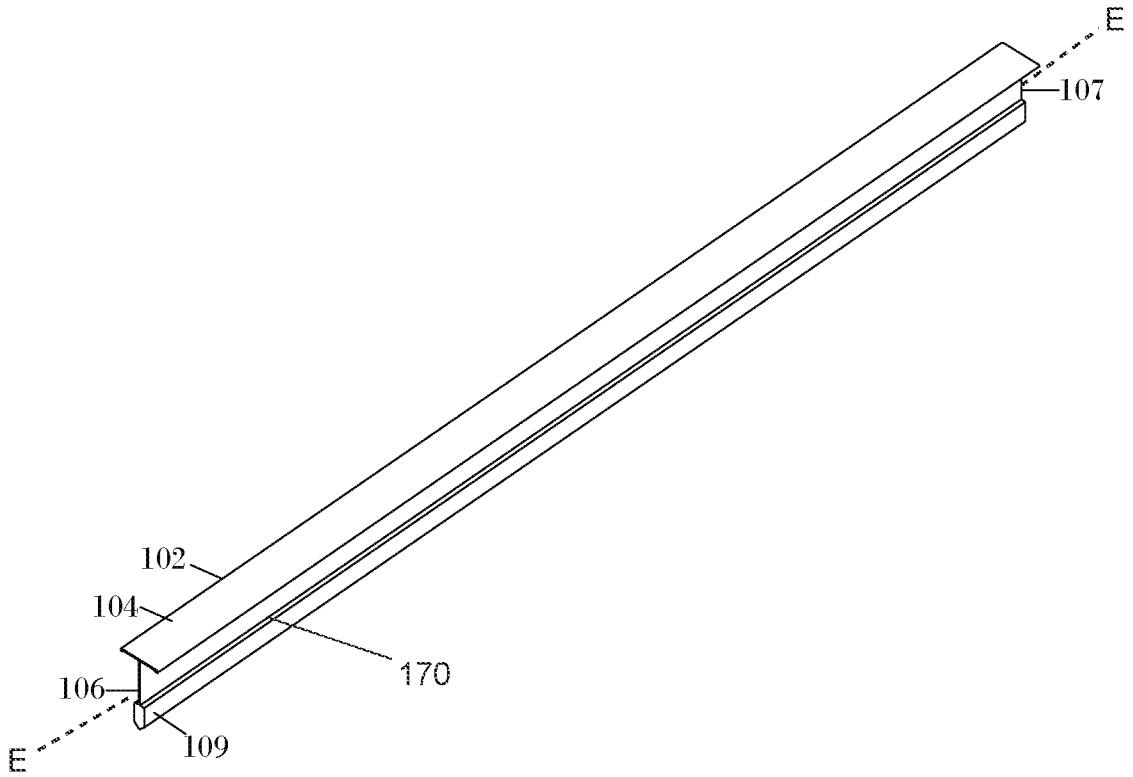
FIG. 1 illustrates a top, front, right, perspective view of a support beam of a ceiling system in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As shown in FIGS. 1-9 for purposes of illustration, an embodiment of the present invention may be directed to an architectural fixture assembly in the form of a ceiling system 100. The ceiling system 100 generally comprises at least one (or a plurality of) support beam 102, at least one (or a plurality of) elongated cover (or more simply, covers) 116, and at least one (or a plurality of) baffle 108. The support beams 102 are configured to attached to or hung from a support structure, such as a structural ceiling or the like from which suspended ceiling systems are often hung. The cover 116 is configured to be coupled to and/or partially wrapped around the support beam 102. The baffle 108 is configured to be coupled to the support beam 102, the cover 116, or both. In some embodiments, the plurality of support beams 102 may comprise a plurality of support beams arranged in a non-intersecting arrangement. In some embodiments the plurality of support beams 102 may be arranged in a parallel arrangement, although this is not required in all embodiments, some examples of which are provided herein. While the support beams 102 may be arranged in a parallel arrangement, in other embodiments they may be non-parallel but also non-intersecting. In still other embodiments, the ceiling system 100 may comprise just one of the support beams 102.

Figure 2:
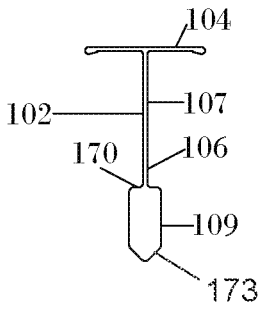
FIG. 2 illustrates a front elevation view of the support beam of FIG. 1 (a rear elevation view of the support beam being substantially identical to the front elevation view)

Referring to FIGS. 1 and 2, the support beams 102 will be described with reference to a singular support beam. In should be appreciated that the invention may comprise more than one of the support beams 102, and the claims may reference more than one of the support beams 102 using the prefixes "first" and "second." The description below applies to any of the support beams referenced in the claims, whether that be a singular support beam or multiple support beams. When there are multiple support beams in a ceiling system, the support beams may be identical to one another, although the invention is not to be so limited in all embodiments and the various support beams may have structural differences relative to one another in other embodiments.

The support beam 102 is elongated from a first end to a second end along a beam axis E-E. Each support beam 102 may include a vertical web portion 106, a flange portion 104 at a top end of the vertical web portion 106, and a bulb portion 109 at a lower end of the vertical web portion 106. The terms top end and lower end are based on the orientation of the support beam 102 when installed and mounted to or hung from a support structure. The top end of the vertical web portion 106 is closer to the support structure (the structural ceiling in the interior space within which the support beam 102 is hung) and the lower end of the vertical web portion 106 is closer to the floor of the room within which the ceiling system is installed. The flange portion 104 may extend horizontally from the top end of the vertical web portion 106 in two opposing directions. The bulb portion 109 may also be referred to herein as a widened beam feature or a widened feature as it protrudes outward from the vertical web portion 106 along the lower end of the vertical web portion 106. In the exemplified embodiment the bulb portion 109 has a maximum transverse width that is less than a maximum transverse width of the flange portion 104, as best seen in FIG. 2 (the width being measured left to right in the front elevation view of FIG. 2).

The bulb portion 109 comprises a beam protuberance 170 and a chamfered bottom portion 173. The beam protuberance 170 of the bulb portion 109 may form an upper ledge surface that protrudes horizontally from the vertical web portion 106, and more specifically the upper ledge portion of the beam protuberance 10 may protrude horizontally from both opposing side surfaces of the vertical web portion 106. In the exemplified embodiment, the support beam 102 may be a generally T-shaped support beam and the support beam 102 may be hung from a ceiling support surface so that the flange portion 104 is adjacent to the ceiling support surface and the bulb portion or the widened beam feature 109 is located further from the ceiling support surface. The support beam 102 may be supported from a support structure, such as a ceiling support surface, at one or more connection points on the flange portion 104 of the support beam 102. The bulb portion 109, rather than the horizontally oriented flange portion 104, may be used for the coupling of the other components of the ceiling system 100 to the support beam 102, such as the covers 116 and/or the baffles 108, as described in greater detail below.

Figures 39A, 39B, 39C, 39D, 39E, 39F, 39G, 39H, 39I, 39J:
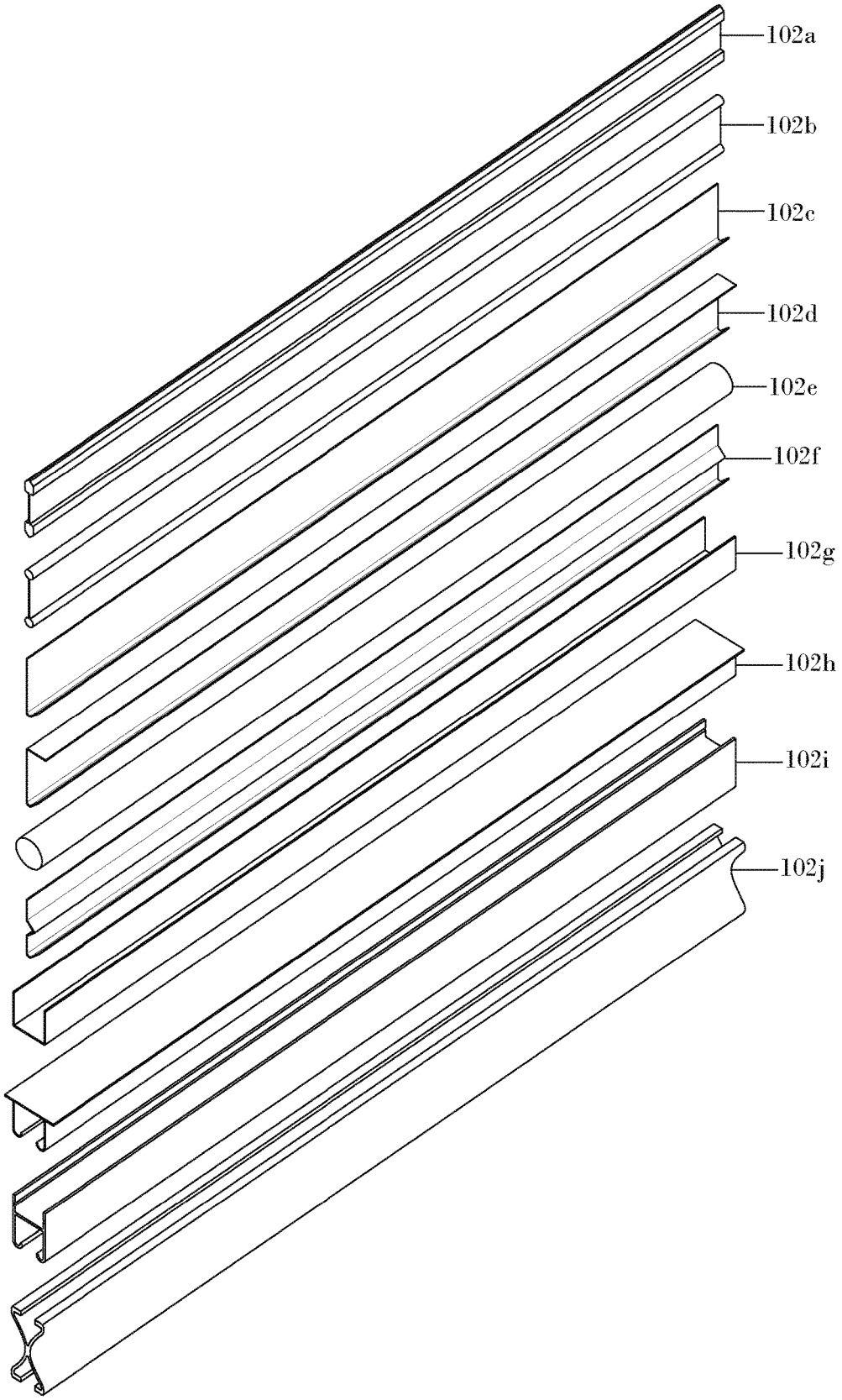
FIGS. 39A-39J illustrate alternate embodiments of support beams having different cross-sectional shapes.

As seen in FIGS. 39A-J, the support beam 102 is not limited to the T-shape, and the support beam 102 may have a variety of cross-sectional shapes, including a support beam 102*a* having a generally I-shape or pointed house-shaped forms connected by a web (FIG. 39A), a support beam 102*b* having a generally barbell-shape (FIG. 39B), a support beam 102*c* having a fishhook shape (FIG. 39C), a support beam 102*d* having a J-shape (FIG. 39D), a support beam 102*c* having a circular shape (FIG. 39E), a support beam 102*f* having a generally J-shape with a generally V-shaped bend in the middle (FIG. 39F), a support beam 102*g* having a generally U-shape (FIG. 39G), a support beam 102*h* having a generally Pi-shape with mirror-image generally J-shaped vertical portions (FIG. 39H), a support beam 102*i* having a mirror-image generally J-shaped vertical portions connected by a horizontal portion (with or without notches in the horizontal portion) disposed between the vertical portions (FIG. 39I), and a support beam 102*j* having a generally X-shaped or hourglass-shaped (FIG. 39J).

The support beam 102 (which may be the support beam 102 or any of the support beams 102*a-j*) can be any length desired by a user, with various dimensions and proportions of the support beam 102 also being as desired by a user. The support beam 102 can be made from various materials including, without limitation, metal (steel, steel alloy, aluminum, etc.), wood, plastic, etc. In the embodiment seen in FIG. 9, there are two generally parallel, co-planar support beams 102 of identical dimensions (e.g., height, length, thickness, etc.). The ceiling system 100 may include any number of generally parallel, co-planar support beams 102 in various embodiments as needed to fit a particular space. Moreover, in other embodiments the support beams 102 need not be generally parallel, but may be non-intersecting so that various baffles 108 may extend between pairs of adjacent support beams 102 as described herein below. Two beams can be non-intersecting if they are parallel or if they are non-parallel if they do not physically intersect with one another, irrespective of whether their longitudinal axes would intersect. In some embodiments, two or more of the support beams 102 may be arranged in an intersecting manner but may be non-perpendicular.

As seen in FIG. 2, the flange portion 104 of each support beam 102 forms the upper, horizontal portion of the "T" of that support beam 102. The vertical web portion 106 includes a generally vertical portion 107 that extends downwards from the middle of the bottom side of the flange portion 104. The widened beam feature or bulb portion 109 (generally referred to herein as the bulb portion, but any of the terms noted may be used to refer to the same portion) is located at a distal end or a lower end of the generally vertical portion 107 of the vertical web portion 106. The bulb portion 109 may be shaped like an elongated square that extends to a point at the midpoint of one side. The beam protuberance 170 forms a top portion of the bulb portion 109 and comprises an upper ledge surface that extends in opposing directions away from the vertical web portion 106. The beam protuberance 170 and the upper ledge surface thereof may form an engagement surface that can be engaged by the cover 116 and/or the baffle 108 to mount the cover 116 and/or the baffle 108 to the support beam 102.

Referring to FIGS. 3-6, the covers 116 will be further described. In some exemplified embodiments, there is one cover 116 associated with and configured for coupling to each of the support beams 102. Thus, in embodiments of the ceiling system 100 that include more than one support beam 102, there may also be more than one cover 116. The claims may reference more than one cover 116 using the prefixes "first" and "second." The description below applies to any of the covers referenced in the claims, whether that be a singular cover or multiple covers. When there are multiple covers in a ceiling system, the covers may be identical to one another, although the invention is not to be so limited in all embodiments and the various covers may have structural differences relative to one another in other embodiments.

Each cover 116 is configured to engage a particular one of the support beams 102. Furthermore, each of the covers 116 may be configured to engage, or be engaged by, at least one of the baffles 108. In other embodiments, the baffles 108 may engage the support beam 102 directly without engaging the cover 116. In still other embodiments the baffles 108 may engage the support beam 102 and the cover 116. The cover 116 may comprise a cover body 175 having a floor portion 176, a first sidewall portion 177 extending upwardly from the floor portion 176, and a second sidewall portion 178 extending upwardly from the floor portion 176. The floor portion 176 of the cover body 175 extends between and connects the first and second sidewall portions 177, 178 of the cover body 175 together. The cover 116 further comprises a top portion or top surface 118, a bottom portion or bottom surface 120, a first side surface 122 which forms an outer surface of the first sidewall portion 177, a second side surface 124 which forms an outer surface of the second sidewall portion 177, a first end 126, and a second end 128. The cover 116 is elongated along a cover axis A-A from the first end 126 to the second end 128. Moreover, the cover 116 may be a singular component. In particular, the cover 116 may be a unitary or singular integral component rather than being formed from multiple distinct components.

The cover 116 may comprise a cover slit 150 formed between the first and second sidewall portions 177, 178 at the top surface 118 of the cover body 175. Furthermore, the cover 116 may comprise a cover slot 180 that extends downwardly from the cover slit 150 into the cover body 175 between the first and second sidewall portions 177, 178. The cover slot 180 may form a gap or space between the first and second sidewall portions 177, 178. The cover slot 180 may be elongated along a cover slot axis B-B which is substantially parallel to the cover axis A-A. The cover slot 180 may extend the full length of the cover 116 from the first end 126 thereof to the second end 128 thereof such that the cover slot 180 is open at each of the first and second ends 126. The cover slot 180 may comprise a first section 181 and a second section 182. The first section 181 may be located adjacent to and extend downwardly from the top surface 118 of the cover 116. The second section 182 of the cover slot 180 may be located below the first section 181, and more specifically between the first section 181 and the floor 176 of the cover 116. In the exemplified embodiment, the first section 181 extends linearly section from the top surface 118 to the second section 182 in a direction transverse or perpendicular to the cover axis A-A.

The first section 181 may be a narrow slit that exists between the inner surfaces of the first and second sidewall portions 177, 178 of the cover body 175. The second section 182 may be wider than the first section 181. Thus, the first section 181 may be referred to herein as a narrowed section of the cover slot 180 and the second section 182 may be referred to herein as a widened section of the cover slot 180. The first section 181 may have a substantially constant transverse width measured in the direction between the interior surfaces of the first and second sidewall portions 177, 178 (which is a direction transverse to the cover axis A-A). The term substantially constant as used herein may include a slight taper in either the inward or outward directions of no more than 5°. Moreover, the invention is not to be so limited and the transverse width of the first section 181 need not be constant in all embodiments. Nonetheless, the maximum transverse width of the first section 181 of the cover slot 180 may be less than a maximum transverse width of the second section 182 of the first cover slot 180. This is because, in some embodiments described herein, the second section 182 of the first cover slot 180 is configured to accommodate the bulb portion 109 of the support beam 102 whereas the first section 181 of the first cover slot 180 is configured to accommodate the vertical web portion 106 of the support beam 102.

The second section 182 of the cover slot 180 is an enlarged portion of the cover slot 180 which extends about midway, perhaps a little further than midway, between the top surface 118 and the bottom surface 120. The exact location of the second section 182 of the cover slot 180 may correspond with the location of the bulb portion 109 of the support beam 102 when the cover member 116 is coupled or attached to the support beam 102, as described further below. In the exemplified embodiment, the second section 182 of the cover slot 180 has a diamond shape. As used herein, the term diamond shape includes quadrilaterals having right angles and quadrilaterals having oblique angles. In some embodiments, the second section 182 of the cover slot 180 has an apex as the furthermost point of the second section 182 relative to the floor portion 176, and the first section 181 of the cover slot 180 extends from the apex of the second section 182 of the cover slot 180. The invention is not to be limited by the particular shape of the second section 182 of the cover slot 180 all embodiments and the second section 182 of the cover slot 180 may take on other shapes in other embodiments, including being circular, triangular, rectangular, square, pentagonal, hexagonal, octagonal, or the like. The second section 182 of the cover slot 180 may be configured to receive the bulb portion 109 of the support beam 102 when installed.

Interior surfaces of the first and second sidewalls 177, 178 of the cover 116 define the slot 180. The first sidewall 177 comprises a first downwardly facing shoulder 179 that forms a first roof portion of the second section 182 of the cover slot 180. The second sidewall 178 comprises a second downwardly facing shoulder 189 that forms a second roof portion of the second section 182 of the cover slot 180. In the exemplified embodiment, the first and second downwardly facing shoulders 179, 189 are oriented generally perpendicular to one another, with each extending downwardly and outwardly in a direction away from the cover slot 180. The exact orientation of the first and second downwardly facing shoulders 179, 189 is not to be limiting of the invention in all embodiments. In some embodiments, the first and second downwardly facing shoulders 178, 179 may be oriented horizontally rather than angled as depicted. In either case, the downwardly facing shoulders 178, 179 face downwardly towards the bottom end 120 of the cover 116 so that they may contact and/or engage the beam protuberance 170 of the bulb portion 109 of the support beam 102 when the cover 116 is coupled thereto as described below.

Each cover 116 is configured to generally enclose or cover at least a portion of one of the support beams 102 such that the vertical web portion 106 (or a portion thereof) of the one of the support beams 102 is located within the first section 181 of the cover slot 180 and the bulb portion 109 (or a portion thereof) of the one of the support beams 102 is located within the second section 182 of the cover slot 180. The cover slot 180 of each cover 116 forms a bore extending longitudinally through the cover 116 in the direction of the cover slot axis B-B with the bore configured as a receptacle portion configured to engage at least a portion of the particular support beam 102 that particular cover 116 is engaging.

Figure 3:
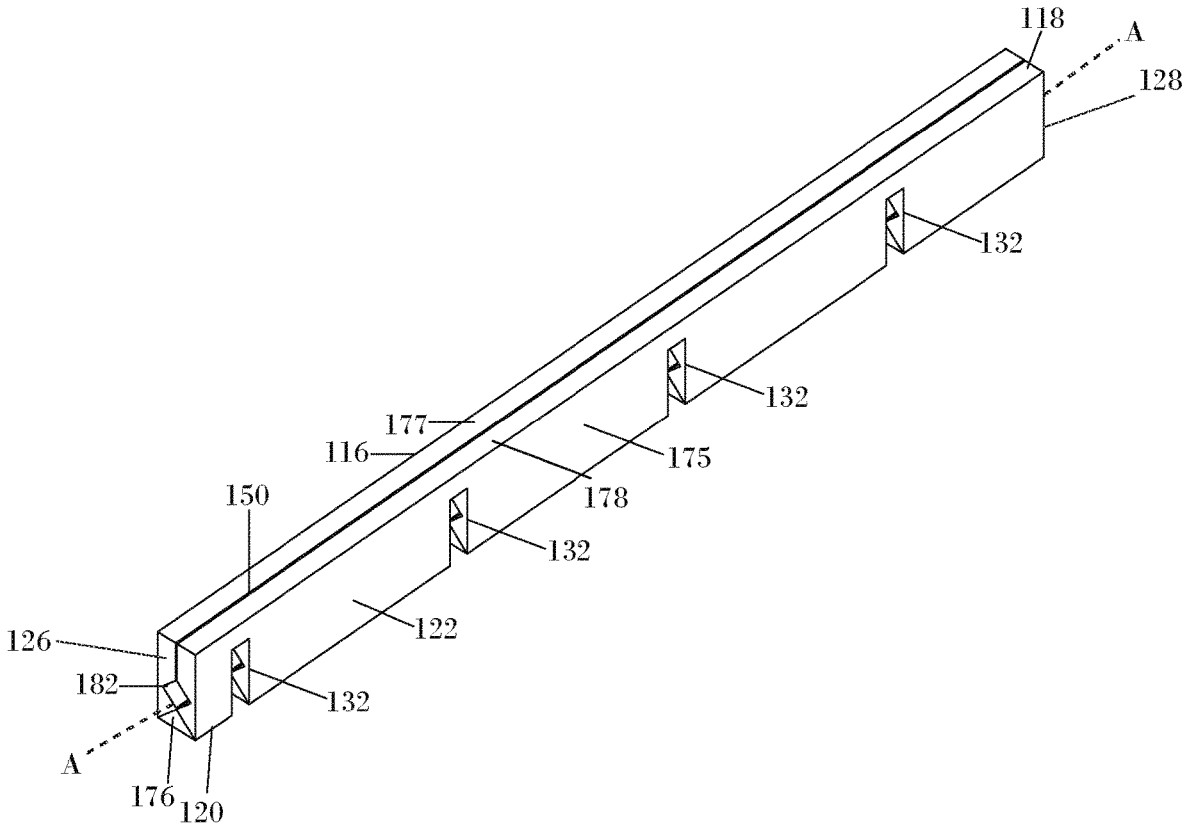
FIG. 3 illustrates a top, front, right perspective view of a cover of a ceiling system in accordance with an embodiment of the present invention.

As seen in FIG. 3, the cover 116 includes a plurality of notches or grooves 132 extending from the bottom surface 120 upwards towards, but not to, the top surface 118. The notches 132 may be referred to herein as transverse cover notches, as the notches 132 extend from the outer surfaces of the first and second sidewall portions 177, 178 inwardly in a transverse direction relative to the cover axis A-A. It should be noted that the term transverse as used with reference to the cover notches 132 is not limited to the notches 132 extending orthogonally relative to the cover axis A-A, but may also include the notches 132 extending outwardly from the cover axis A-A at an angle. That is, the notches 132 may extend from the outer surface of the cover 116 to the cover slot 180 along an axis that is perpendicular to the cover axis A-A or along an axis that is oblique to the cover axis A-A, and each of these may be considered transverse as used herein. The notches 132 may extend through the full thickness of each of the first and second sidewall portions 177, 178 of the cover 116 for a portion of a height of the cover 116 measured between the bottom end 120 thereof and the top end 118 thereof.

The cover 116 may comprise just one of the notches 132 instead of the plurality of notches 132 as shown in the exemplified embodiment. In other embodiments, one or more alignment notches may be formed in the cover 116 that extend from the top side 118 of the cover 116 downwards. In still other embodiments, there may be a combination of notches extending from the top side 118 downwards and the notches 132 extending upwards from the bottom side 120. The number of alignment notches 132 on any particular cover 116 depends on the number of baffles 108 that a user desires to engage to the cover 116. That is, the baffles 108 may be intended to engage the cover 116 at or along the notches 132. In some embodiments the baffles 108 may not actually engage the cover 116, but may instead nest within the notches 132 and engage the bulb portion 109 of the support beam 102 that is enclosed within the cover 116. In other embodiments, the baffles 108 may engage the cover 116 and the support beam 102, as discussed in greater detail herein below.

Figure 9:
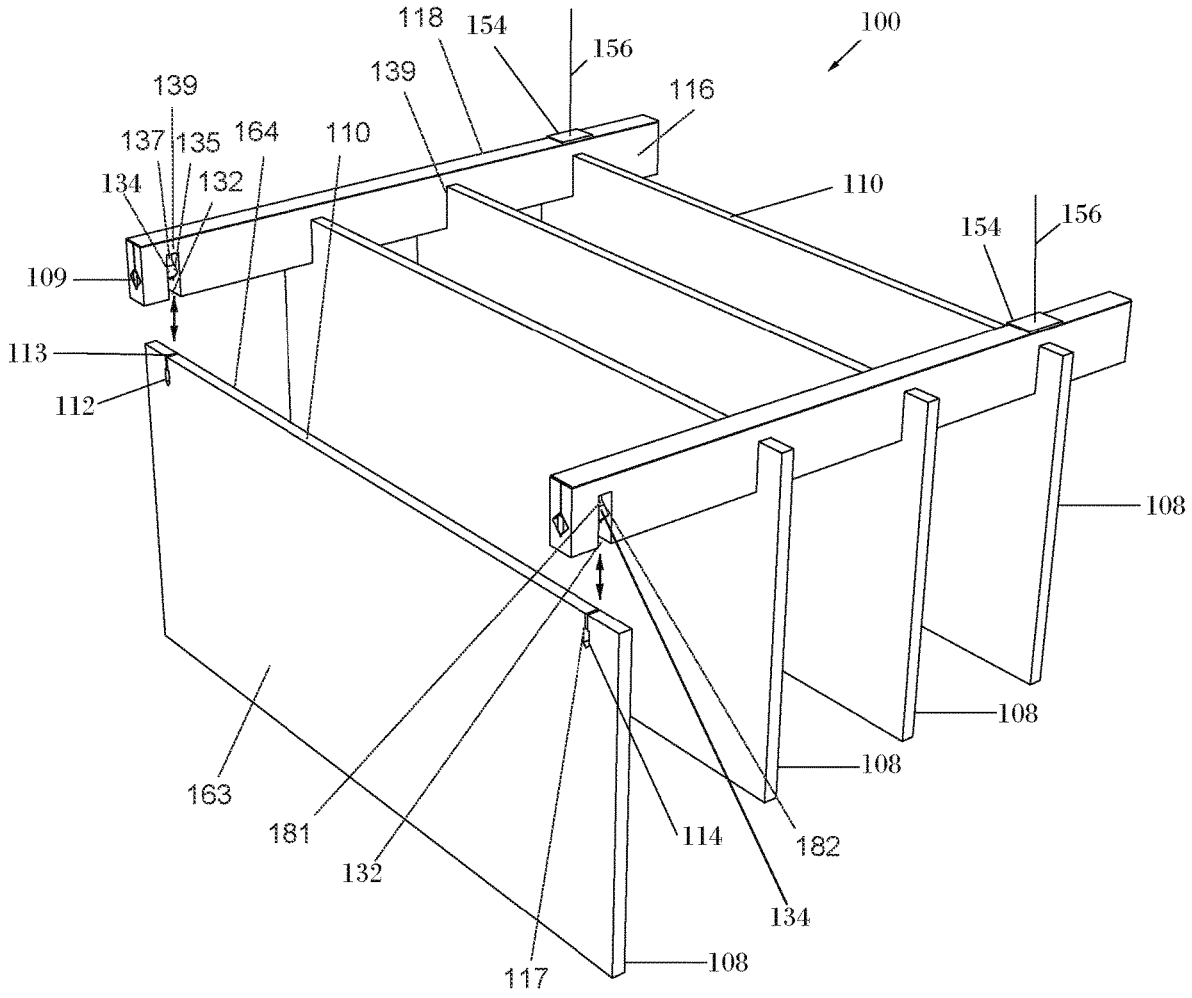
FIG. 9 illustrates a top, front, right perspective view of a ceiling system in accordance with an embodiment of the invention, with a pair of support beams of the type seen in FIG. 1 in respective engagement with a pair of covers of the type seen in FIG. 3, four baffles of the type seen in FIG. 8, and with a double-ended arrow indicating directions of movement for the baffles to engage with/disengage from the support beams/covers (three of the baffles shown in engagement with the support beams/covers and the fourth baffle shown disengaged from the support beams/covers)
Figure 10:
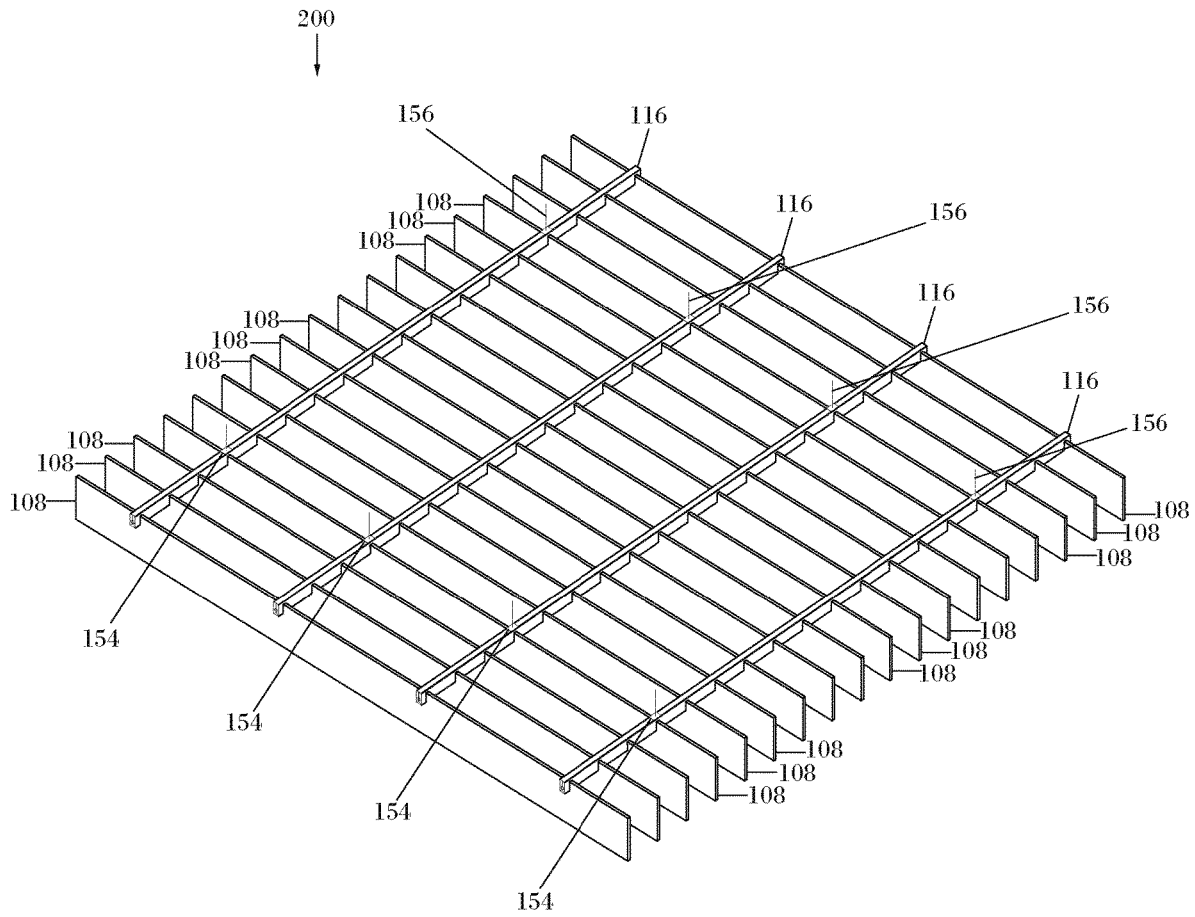
FIG. 10 illustrates a top, front, right, perspective view of a ceiling system in accordance with another embodiment of the invention, with four support beams of the type seen in FIG. 1 in respective engagement with four covers of the type seen in FIG. 3, and eighteen baffles of the type seen in FIG. 8.
Figure 11:
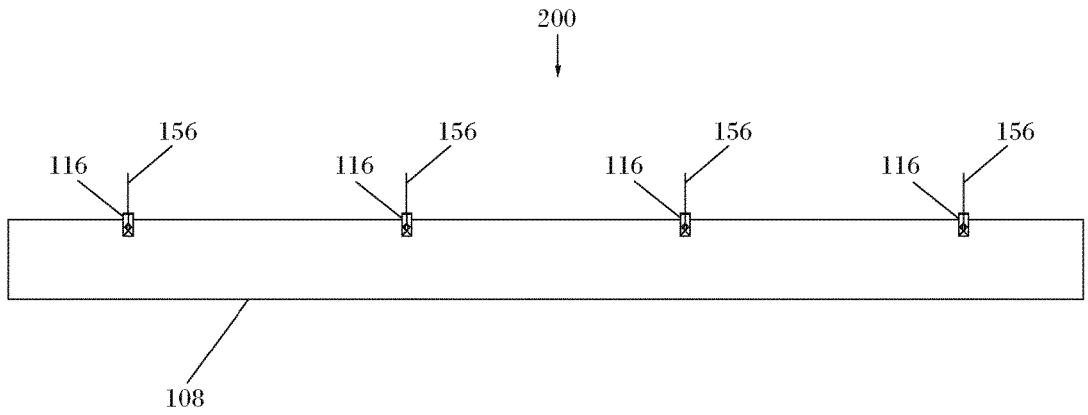
FIG. 11 illustrates a front elevation view of the ceiling system of FIG. 10 (a rear elevation view of the ceiling system being substantially identical to the front elevation view)
Figure 12:
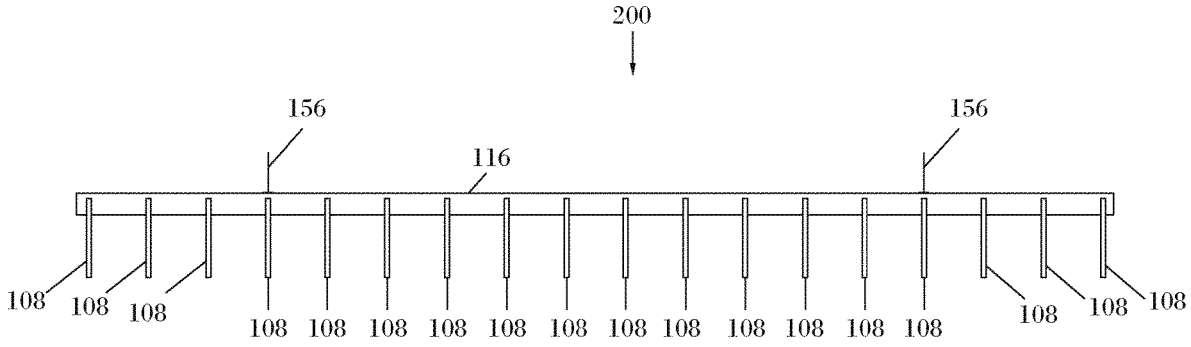
FIG. 12 illustrates a left side elevation view of the ceiling system of FIG. 10 (a right side elevation view of the ceiling system being substantially identical to the front elevation view)
Figure 13:
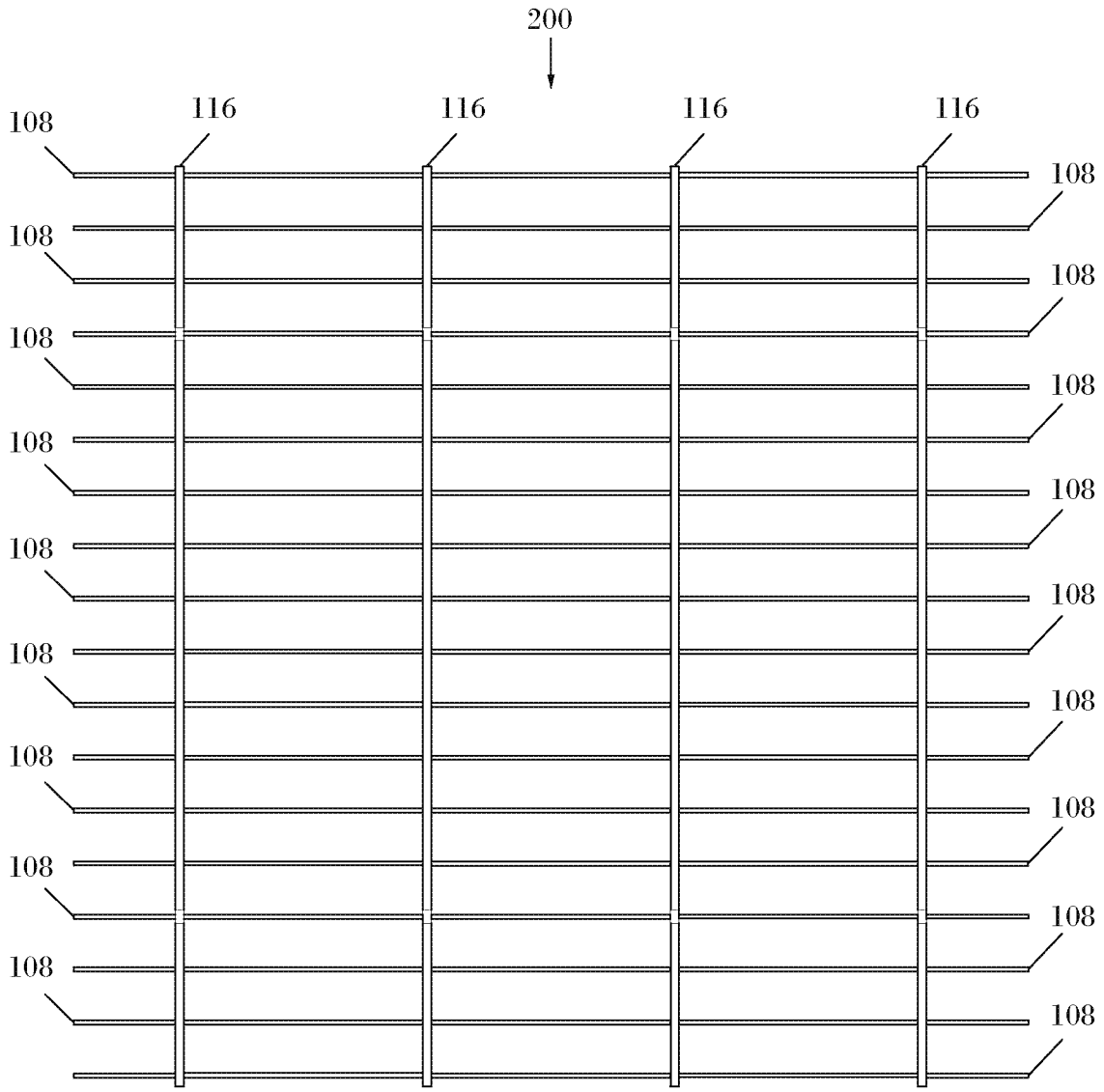
FIG. 13 illustrates a top plan view of the ceiling system of FIG. 10.
Figure 14:
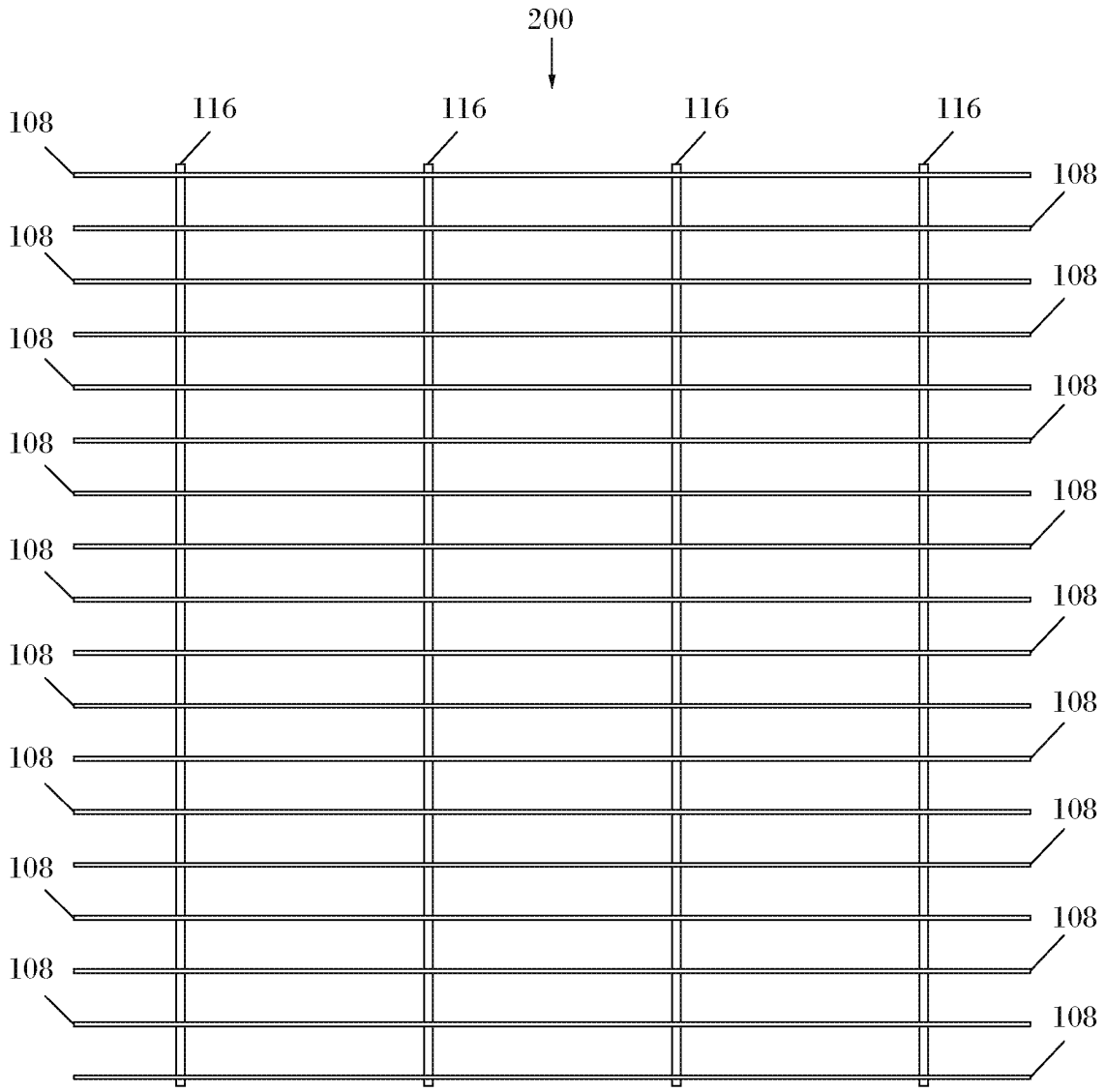
FIG. 14 illustrates a bottom plan view of the ceiling system of FIG. 10.

The notches 132 extend upwardly from the bottom end 120 of the cover 116 a sufficient distance towards the top end 118 of the cover 116 such that the notches 132 intersect the second section 182 of the cover slot 180 and at least a portion of the first section 181 of the cover slot 180. The intersection of the notches 132 with the first and second sections 181, 182 of the cover slot 180 are depicted in FIGS. 3 and 9. The notches 132 extend upwardly past the second section 182 of the cover slot 180 such that the notches 132 intersect with portions of the first section 181 of the cover slot 180 as well. In other embodiments, the notches 132 may intersect the second section 182 of the cover slot 180 but may not extend further upwardly to intersect the first section 181 of the cover slot 180.

The alignment notches 132 may be formed in the cover 116 by conventional methods, although specific techniques will be described below with reference to FIGS. 5 and 6. As shown in FIG. 9, when the ceiling system 100 is partially assembled such that the covers 116 are coupled to and enclose the support beams 102, portions 134 of the support beam 102 are visible and exposed through the notches 132. In particular, the portions 134 of the support beam 102 comprise longitudinal sections 135 of the bulb portion 109 of the support beam 102 and longitudinal sections 137 of the vertical web portions 106 of the support beam 102. There may be multiple longitudinal sections 135, 137 of each of the bulb portion 109 and the vertical web portions 106 that are exposed, one such set or pair of longitudinal sections 135, 137 being exposed through or along each notch 132. In FIG. 9 only one longitudinal section 135, 137 is illustrated as exposed because the others are covered by the baffles 108 which are later coupled to the support beam 102 as described herein. The baffles 108 are configured to be positioned within the notches 132 of the covers 116. As such, the baffles 108 may be coupled to the longitudinal sections 135, 137 of the support beam 102 that are exposed through the notches 132.

Figure 5:
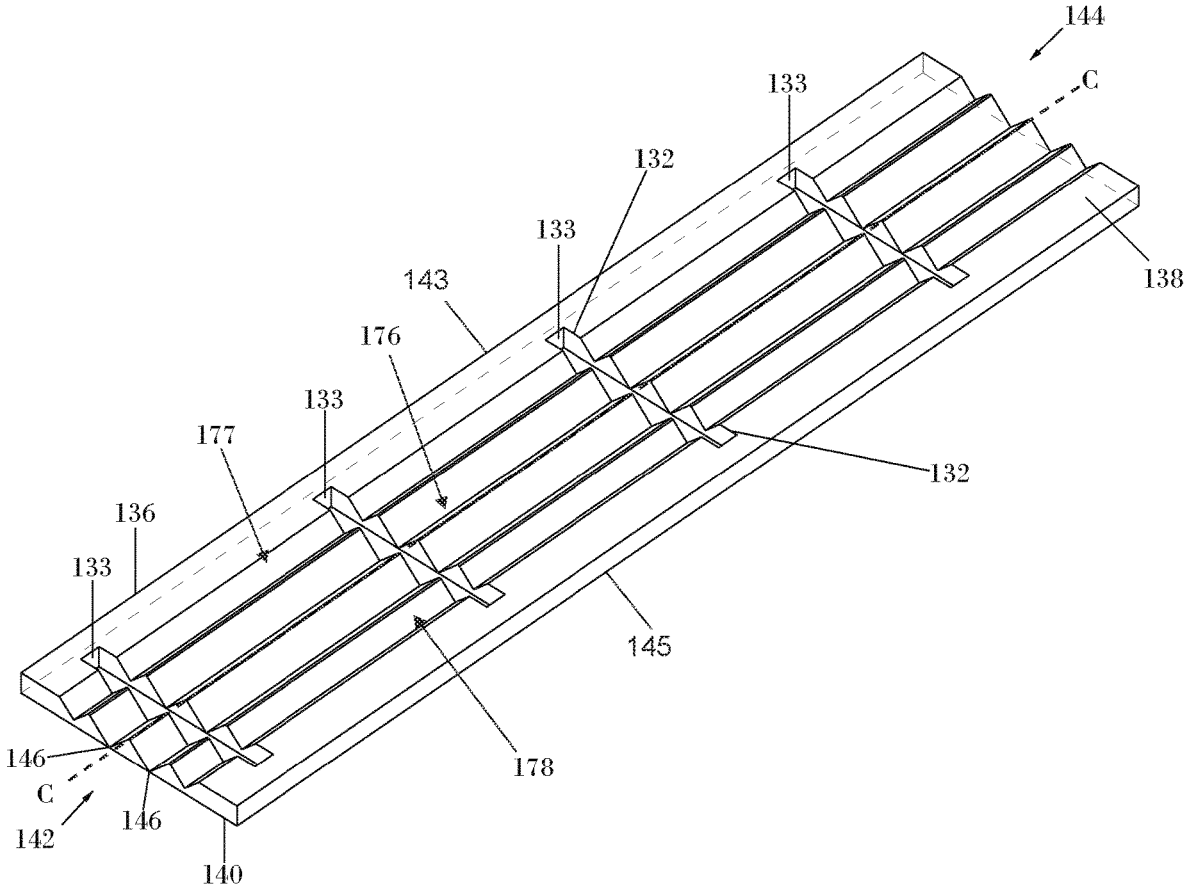
FIG. 5 illustrates a top, front, right perspective view of the cover of FIG. 3 in a generally flat, unfolded configuration.
Figure 6:
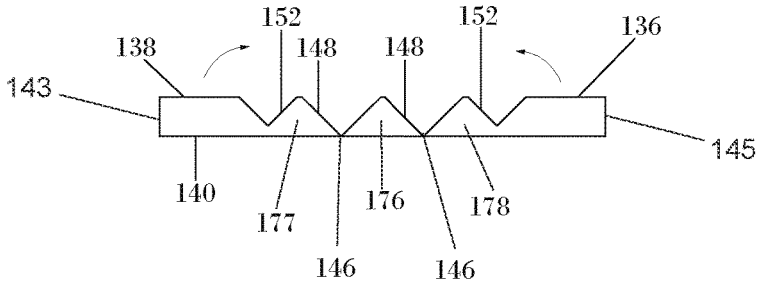

Referring to FIGS. 5 and 6, additional details about the cover 116 will be described in accordance with an embodiment of the present invention. It should be appreciated that while the cover 116 is described as being formed from a single sheet which is folded upon itself to create its final form, the invention is not to be so limited in all embodiments and the cover 116 may be a solid construct that is not configured to be folded upon itself. That is, the cover 116 may be manufactured in its final shape (i.e., in the shape shown in FIG. 3) without requiring folding to achieve that shape in some embodiments. The cover 116 may be made via extrusion or other techniques instead of the single sheet variation described herein in alternative embodiments.

Figure 4:
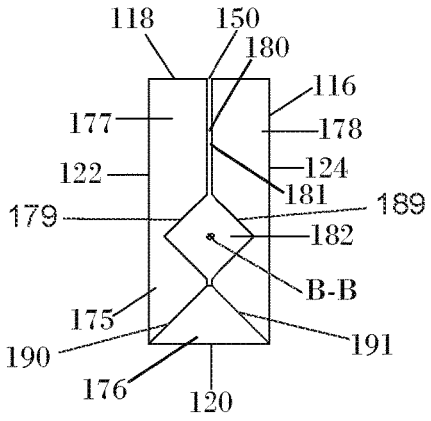
FIG. 4 illustrates a front elevation view of the cover of FIG. 3 (a rear elevation view of the cover being substantially identical to the front elevation view)

The cover 116 may be made from a generally flat, elongated sheet 136 with a top side or top surface 138, a bottom side or bottom surface 140, a first end 142, and a second end 144. The sheet 136 has a thickness measured between the top and bottom surfaces 138, 140. The sheet 136 may have a longitudinal axis C-C running along a center of the sheet 136 between the first end 142 and the second end 144. As seen in FIG. 5, the notches 132 are formed into the elongated sheet 136 as elongated through-holes that extend through the thickness of the elongated sheet 136 from the top surface 138 to the bottom surface 140. In the exemplified embodiment, the notches 132 extend and are elongated in a direction transverse to the longitudinal axis C-C. Furthermore, the notches 132 may be spaced apart from one another in the direction of the longitudinal axis C-C. The notches 132 extend from a first end that is adjacent to and spaced from a first side end 143 of the elongated sheet 136 to a second end that is adjacent to and spaced from a second side end 145 of the elongated sheet 136. The first and second side ends 143, 145 form the top surface 118 of the cover 116 when the cover 116 is folded into its assembled configuration as shown in FIG. 4. Because the notches 132 do not extend all the way to the first and second side ends 143, 145 when the elongated sheet 136 is not folded, the notches 132 also do not extend all the way to the top surface 118 of the cover 116 when the cover 116 is folded into its final assembled configuration.

The sheet 136 may comprise a pair of fold lines 146 that extend from the first end 142 to the second end 144. The fold lines 146 may be formed into the top surface 138 of the sheet 136, on opposite sides of, and parallel with, the longitudinal axis C-C. Each fold line 146 may be part of a generally V-shaped cut 148 formed into the top side 138 of the sheet 136 so that the sheet 136 may cleanly fold without substantially compressing or deforming the material of the sheet 136 that is otherwise present along the fold lines 146. Thus, the fold lines 146 are formed by reducing the thickness of the elongated sheet 136 along the full length of the elongated sheet 136 as measured in the direction of the longitudinal axis C-C. The regions of the sheet 136 with the minimum thickness form the fold lines 146. In the exemplified embodiment, the fold lines 146 are formed at the floor or bottom-most parts of the V-shaped cuts 148. Other techniques for forming the fold lines 146 may be used in other embodiments.

As a result of the V shaped cuts 148, the top surface 138 of the elongated sheet 136 has a plurality of triangular shaped sections positioned in a side-by-side adjacent manner in a direction moving from the first side edge 143 of the sheet 136 to the second side edge 145 of the sheet 136 (the first and second side edges 143, 145 of the sheet 136 extending between the first and second ends 142, 144 of the sheet 136. Each of the triangular shaped sections may extend the full length of the elongated sheet 136 from the first end 142 to the second end 144.

The generally V-shaped cuts 148 may be configured to permit the exposed edges to abut in a flush manner when the first and second sidewalls 177, 178 are folded at a desired angle. The abutting edges/sides of the generally V-shaped cuts 148 may, for example, be locked into place using various means including, without limitation, brackets, fasteners and/or adhesives (e.g., an epoxy, glue, tape, or the like); either alone or in various combinations with one or more of the others. That is, as best seen in FIG. 4, when the elongated sheet 136 is folded about the fold lines 146, an angled surface of the first sidewall portion 177 mates with or engages or contacts or abuts an angled surface of the floor portion 176 along a first interface 190. Similarly, an angled surface of the second sidewall portion 178 mates with or engages or contacts or abuts an angled surface of the floor portion 176 along a second interface 190. In some embodiments, an adhesive may be applied onto one or both of the mating surfaces of the floor 176 and the first sidewall portion 177 and of the floor 176 and the second sidewall portion 178 prior to folding along the fold lines 146. As such, upon the first and second sidewall portions 177, 178 being folded about the fold lines 146 relative to the floor portion 176, the cover 116 is maintained in its folded configuration (as shown in FIG. 4) as the first and second sidewall portions 177, 178 are bonded or adhered to the floor portion 176. In an alternative embodiment, the cover 116 is formed without folding and in such embodiments the first and second interfaces 190, 191 may be omitted.

The generally rectangular cross-sectional shape of the cover 116 is formed by the first sidewall portion 177 being folded upwards about the fold line 146 relative to the floor portion 176 until the sides of the generally V-shaped cut 148 engage at the interface 190, and the second sidewall portion 178 being folded upwards about the fold line 146 relative to the floor portion 176 until the sides of the generally V-shaped cut 148 engage at the interface 191. The first end 126 of the cover 116 and the first end 142 of the sheet 136 are the same end. The sheet 136 is folded from a flat configuration (FIGS. 5 and 6) to the generally rectangular cross-sectional shape configuration (FIGS. 3 and 4) by folding the first and second sidewall portions 177, 178 upwards about their respective fold lines 146 relative to the floor portion 176 so that the floor portion 176 and the first and second sidewall portions 177, 178 form a generally U-shaped configuration with the interior surfaces of the first and second sidewall portions 177, 178 facing each other to give the cover 116 the appearance of a generally rectangular cross-section. The folding of the first and second sidewall portions 177, 178 to form the cover 116 defines the cover slot 180 along a direction of the cover 116 extending between the top and bottom ends 118, 120. The cover slot 180 is located at an interface between generally abutting, but slightly spaced apart interior surfaces of the first and second sidewall portions 177, 178, and the cover slot 180 extends from the slit 150 in the top side 118 of the cover 116 downwards to the second section 182 of the cover slot 180.

Referring again to FIGS. 5 and 6, the sheet 136 may include another pair of generally V-shaped cuts 152 formed into the top side 138 of the sheet 136. That is, there may be a V-shaped cut 152 in each of the first and second sidewall portions 177, 178. As such, when the cover 116 is in the folded configuration when the first and second sidewall portions 177, 178 are folded about the fold lines 146 as shown in FIG. 4, the interior surfaces of the first and second sidewall portions 177, 178 formed by the V-shaped cuts 152 define the second section 182 of the cover slot 180 of the cover slot 180. In particular, in the exemplified embodiment the diamond-like shape of the second section 182 of the cover slot 180 of the cover slot 180 is formed by the first sidewall portion 177 being folded upwards about the fold line 146 until the sides of the generally V-shaped cut 148 engage, and the second sidewall portion 178 being folded upwards about the fold line 146 until the sides of the generally V-shaped cut 148 engage. The second section 182 of the cover slot 180 seen in FIG. 4 has a generally diamond-like cross-sectional shape due to the second section 182 of the cover slot 180 being formed by the generally V-shaped cuts 152 on the interior surfaces of the first and second sidewall portions 177, 178 of the cover 116. However, as mentioned above, the second section 182 of the cover slot 180 may have any cross-sectional shape desired by a user as long as the second section 182 of the cover slot 180 is sized and shaped to removably engage the bulb portion 109 of the vertical web portion 106 of the support beam 102. The generally V-shaped cuts 152 may have the same dimensions (e.g., depth, angle, etc.) as the generally V-shaped cuts 148 or different dimensions (e.g., depth, angle) than the generally V-shaped cuts 148. As seen in the embodiment of FIGS. 3-6, the generally V-shaped cuts 152 are smaller than the generally V-shaped cuts 148. In this manner, the second end 144 of the sheet 136 may have the same/similar features as the first end 142.

Figure 7:
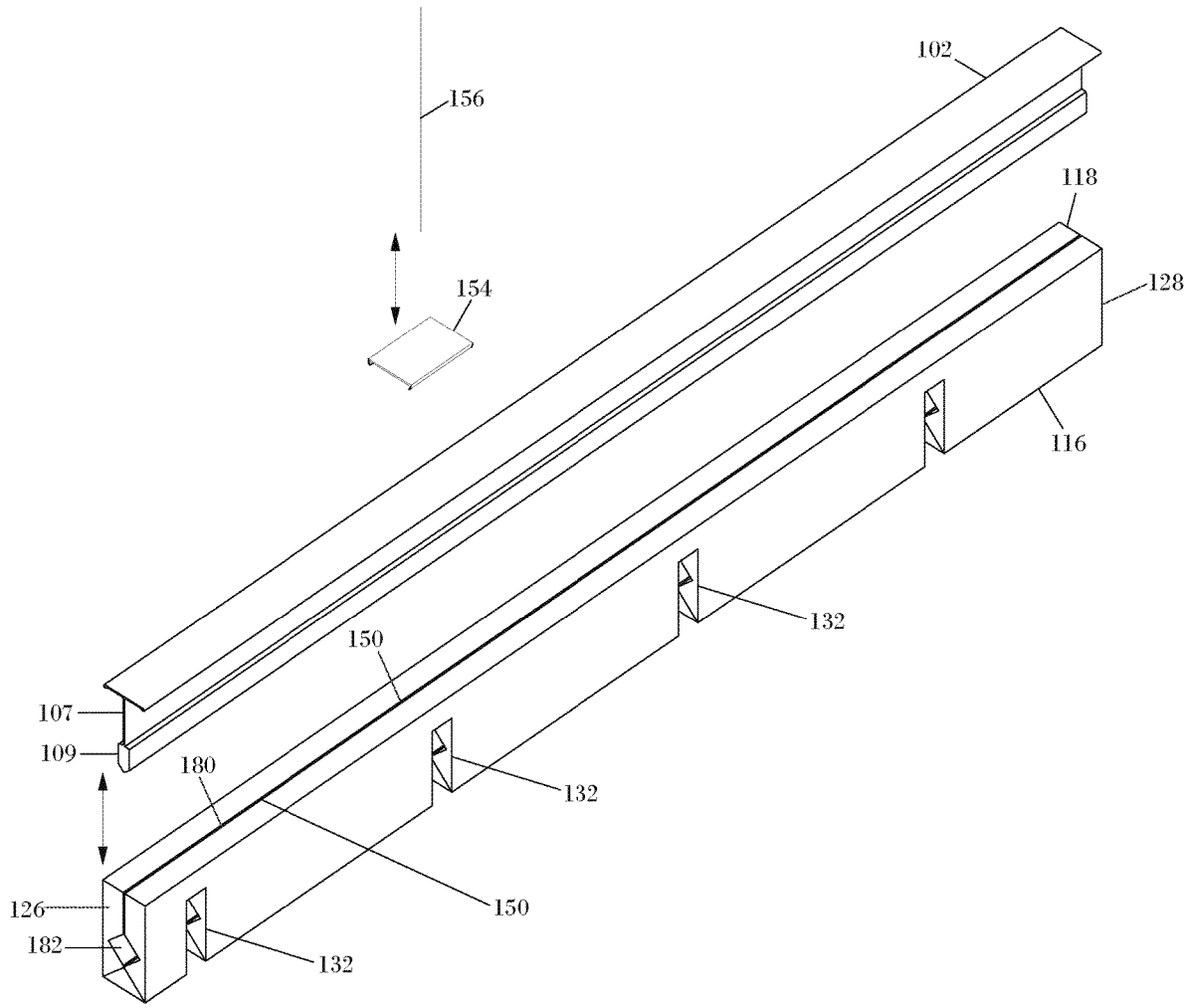
FIG. 7 illustrates a top, front, right perspective view of the support beam of FIG. 1 and the cover of FIG. 3, with a double-ended arrow indicating directions of movement for the cover to engage with/disengage from the support beam.
Figure 7A:
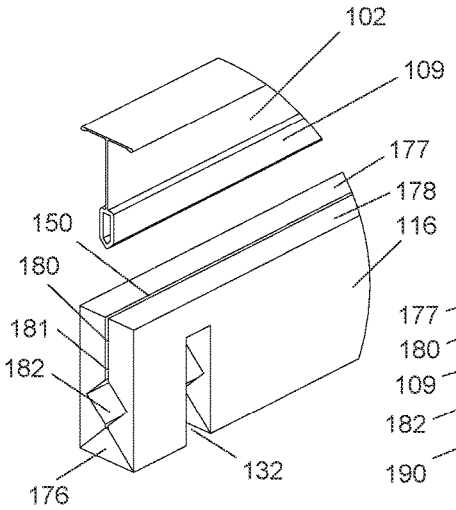
FIG. 7A-7C illustrate movement of the cover of FIG. 3 relative to the support beam of FIG. 1 to facilitate the coupling of the cover to the support beam, with the cover being coupled to the support beam in FIG. 7C.
Figure 7B:
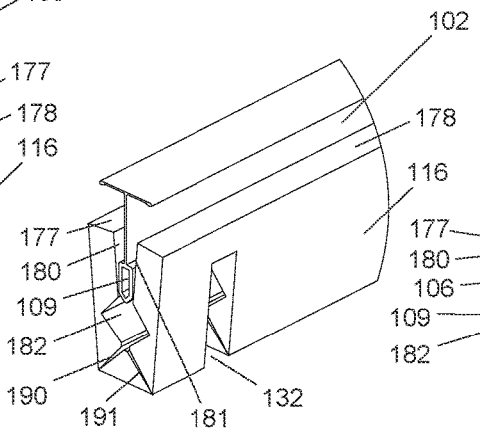
Figure 7C:
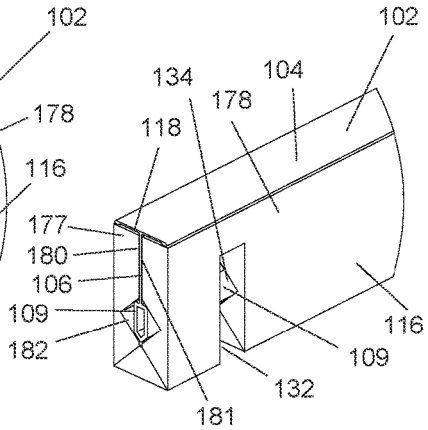
Figure 7D:
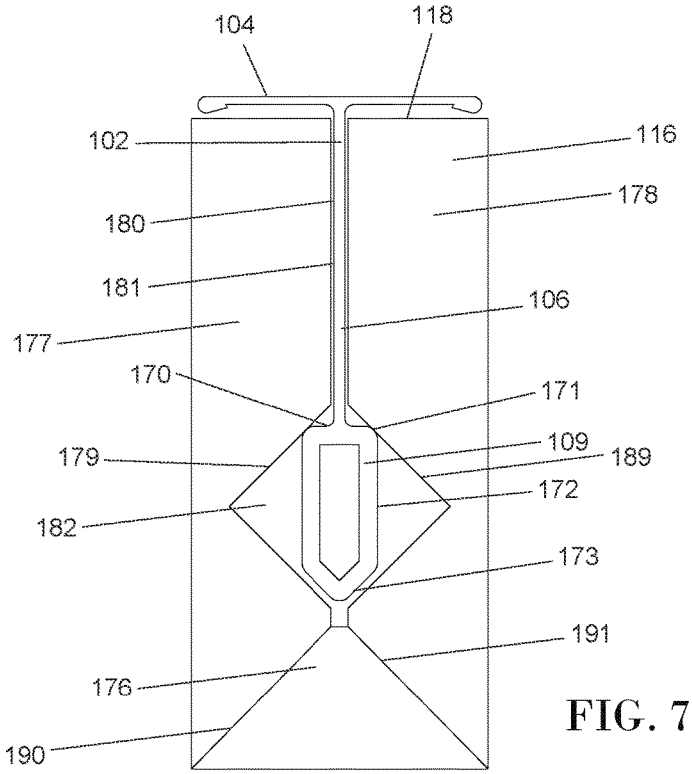
FIG. 7D is a front elevation view illustrating the cover and the support beam in a coupled state.

Referring now to FIGS. 7-7D, the attachment of the covers 116 to the support beams 102 will be described. In FIGS. 7-7D, the attachment of just one of the covers 116 to one of the support beams 102 is illustrated, but it should be appreciated that the same steps may be taken for the coupling of any of the covers 116 to the support beams 102.

FIG. 7 illustrates the cover 116 positioned below the bulb portion or widened beam feature 109 of the support beam 102. An arrow is provided in FIG. 7 to show the direction of movement of the cover 116 relative to the support beam 102 which is necessary to achieve the coupling between the cover 116 and the support beam 102 in accordance with the exemplified embodiment. Either the cover 116 may be moved in the upward direction of the arrow, the support beam 102 may be moved in the downward direction of the arrow, or a combination of both may be used to accomplish the coupling of the cover 116 to the support beam 102 in accordance with the exemplified embodiment. In other embodiments, the cover 116 may be slid onto the support beam 102 in the direction of the longitudinal axis E-E of the support beam 102 rather than the cover 116 being snapped onto the support beam 102 from below. That is, the cover 116 may be positioned adjacent to rather than below the support beam 102, and then the cover 116 may be slide relative to the support beam 102 so that the bulb portion 109 of the support beam 102 enters into the second section 182 of the cover slot 180 from one of the ends 126, 128 of the cover 116.

In the exemplified embodiment, the cover 116 may be engaged to the support beam 102 by moving the cover 116 upwardly until the vertical web portion 106 (in particular, the bulb portion 109 thereof) presses against the slit 150 (either by moving the cover 116 upwards against the support beam 102 or by moving the support beam 102 downwards against the cover 116, or by some combination of movement whereby the bulb portion 109 is pressed against the slit 150). Thus, the beam protuberance 170 of the bulb portion 109 may be slidably inserted into the first section 181 of the cover slot 180 due to this movement of the cover 116 and/or the support beam 102.

FIGS. 7A-7C illustrate this relative movement between the cover 116 and the support beam 102 in sequence. That is, in FIG. 7A, the top surface 118 of the cover 116 remains spaced from the bulb portion 109 of the support beam 102. In FIG. 7B, the cover 116 and/or support beam 102 has been moved one towards the other so that the bulb portion 109 of the support beam 102 passes through the slit 150 and into the cover slot 180 and forces the first and second sidewall portions 177, 178 to spread apart and/or separate from one another to accommodate the bulb portion 109 of the support beam 102. The material of the cover 116 possesses enough flexibility and resiliency that the bulb portion 109 can enter the slit 150 and move through the cover slot 180 towards the second section 182 thereof. In particular, in accordance with the exemplified embodiment as the bulb portion 109 is inserted into the cover slot 180, the first and second sidewall portions 177, 178 of the cover body 175 may flex away from one another to accommodate the bulb portion 109 and permit its entry into the cover slot 180.

While FIG. 7B illustrates the first and second sidewall portions 177, 178 separating from the floor portion 176 at the interfaces 190, 191, this does not occur in all embodiments. In particular, as noted above the first and second sidewall portions 177, 178 may be adhered or bonded to the floor portion 176 at the interfaces 190, 191 with an adhesive material and in such embodiments the first and second sidewall portions 177, 178 will not separate from the floor portion 176 at the interfaces 190, 191 during the introduction of the beam protuberance 170 into the cover slot 118. In other embodiments, the sidewall portions 177, 178 may be integral with the floor portion 176 rather than being adhered/bonded thereto. That is, the cover 116 may be formed in its folded state as shown in FIG. 4 rather than being formed as a sheet that is later folded. In such embodiments, the first and second sidewall portions 177, 178 may flex outwardly away from one another as the bulb portion 109 of the support beam 102 passes through the first section 181 of the cover slot 180 without the first and second sidewall portion 177, 178 separating from the floor portion 176 at the interfaces 190, 191. The first and second sidewall portions 177, 178 may bend or flex along their length as the bulb portion 109 of the support beam 102 moves within the first section 181 of the cover slot 180 towards the second section 182 of the cover slot 180.

FIGS. 7C and 7D illustrate the state wherein the cover 116 has been fully coupled to the support beam 102. In particular, the cover 116 is moved towards the support beam 102 or vice versa until the widened beam feature or bulb portion 109 of the support beam 102 nests within the second section 182 of the cover slot 180 of the cover 116. Once the bulb portion 109 of the support beam 102 is fully nested within the second section 182 of the cover slot 180 and is no longer located within the first section 181 of the cover slot 180, the first and second sidewall portions 177, 178 of the cover 116 are biased back towards one another, back to their natural, unflexed state. That is, upon cessation of an outward force acting on the first and second sidewall portions 177, 178 of the cover 116, the first and second sidewall portions 177, 178 may return to their non-flexed state (their natural state or position).

As best seen in FIG. 7C, portions 134 of the support beam 102 are visible and exposed through the notches 132 in the cover 116. As noted above, the portions 134 of the support beam 102 may comprise a longitudinal portion of the beam protuberance 170 of the bulb portion 109 and a longitudinal portion of the vertical web portion 106, as described above and shown in FIG. 9. This is because, as discussed above, the notch or groove 132 intersects the second section 182 of the cover slot 180 and at least a lower portion of the first section 181 of the cover slot 180. That is, the notch 132 extends upwardly along the cover 116 a sufficient distance from the bottom end 120 towards the top end 118 so that it intersects with the second section 182 and at least a lower portion of the first section 181 of the cover slot 180. This ensures that the portion 134 of the support beam 102 (which includes portions of the bulb portion 109 and may also include portions of the vertical web portion 106) is exposed through the notch 132 so that when the baffles 108 are inserted into the notches 132 they are permitted to engage the portions 134 of the support beam 102 to facilitate the coupling of the baffles 108 to the support beam 102.

FIG. 7D is a front elevation view illustrating the cover 116 coupled to the support beam 102. As seen in this view, when the cover 116 is coupled to the support beam 102, the bulb portion or widened beam feature 109 of the support beam 102 nests within the second section 182 of the cover slot 180 and the vertical web portion 106 of the support beam 102 nests within the first section 181 of the cover slot 180. The floor portion 176 of the cover 116 overlies the bottom surface of the support beam 102 including portions of the bottom surface of the support beam 102 which are vertically aligned with the vertical web portion 106 of the support beam 102. The first and second sidewall portions 177, 178 of the cover 116 extend upwardly from the floor portion 176 and may cover at least a portion of the opposing outer surfaces of the vertical web portion 106 of the support beam 102. Furthermore, in this embodiment the flange portion 104 of the support beam 102 faces, or potentially abuts against the top surface 118 of the cover 116.

The interior surfaces of the first and second sidewall portions 177, 178 may exert a compressive force onto the vertical web portion 106 of the support beam 102. As used herein, the compressive force does not require deformation of either of the first and second sidewall portions 177, 178 of the cover 116 or of the vertical web portion 106 of the support beam 102. Rather, the term compressive force as used in this context means only that opposing inward forces are applied from the first and second sidewall portions 177, 178 of the cover 116 onto the vertical web portion 106 of the support beam 102. The exact compressive force being applied may depend on the width of the vertical web portion 106 of the support beam 102 as compared to the width of the first section 181 of the cover slot 180. In some embodiments a slight pressure may be applied from the interior surfaces of the first and second sidewall portions 177, 178 onto the vertical web portion 106 of the support beam 102. In other embodiments, the width of the first section 181 of the cover slot 180 may be greater than the width of the vertical web portion 106 of the support beam 102 and in such embodiments no compressive force may be applied from the cover 116 onto the vertical web portion 106 of the support beam 102.

Moreover, the first and second downwardly facing shoulders 179, 189 of the first and second sidewall portions 177, 178 may rest atop of and in contact with the bulb portion 109 of the support beam 102. The bulb portion 109 of the support beam 102 may comprise the beam protuberance 170 that comprises the upper ledge surface that extends laterally from the lower end of the vertical web portion 106 and a rounded corner portion 171. The bulb portion 109 of the support beam 102 may also comprise a vertical portion 172 that extends downwardly from the rounded corner portion 171 to the chamfered bottom end 173 of the bulb portion 109. The first and second downwardly facing shoulders 179, 189 of the first and second sidewall portions 177, 178 of the cover 116 may rest in abutting contact with the upper ledge of the beam protuberance 170 of the bulb portion 109 and/or with the rounded corner portion 171 of the bulb portion 109. In the exemplified embodiment, the first and second downwardly facing shoulders 179, 189 of the first and second sidewall portions 177, 178 of the cover 116 are in contact with the rounded corner portion 171 of the bulb portion 109. This contact between the first and second downwardly facing shoulders 179, 189 of the first and second sidewall portions 177, 178 of the cover 116 with the bulb portion 109 may assist with maintaining the cover 116 in position around the support beam 102 and prevent the cover 116 from disengaging from the support beam 102 solely by gravity without an external force (such as one applied by a user or installer) being applied. In some embodiments, the cover 116 may be configured to move axially along the support beam 102 while remaining coupled thereto.

The bulb portion 109 may enter and engage at least a portion of the walls of the cover 116 which define and form a boundary of the second section 182 of the cover slot 180. When the bulb portion 109 is disposed within the second section 182 of the cover slot 180, the bottom side of the flange portion 104 may abut and contact the top side 118 of the cover 116, the generally vertical portion 107 of the vertical web portion 106 may be generally disposed within the first section 181 of the cover slot 180, the sides of the generally vertical portion 107 of the vertical web portion 106 may abut the interior surfaces of the first and second sidewalls 177, 178 of the cover 180, and the vertical web portion 106 of the support beam 102 may be being press-fit retained within the cover 116. A certain amount of force may be required to engage/disengage the support beam 102 and the cover 116. The weight of the cover 116 itself, along with gravity, may be insufficient to disengage the cover 116 from the support beam 102. As best seen in FIG. 9, the cover 116 may have a length (measured in the direction of the beam axis A-A between the first and second ends 126, 128) which is equal to or greater than a length of the support beam 102 (measured in the direction of the beam axis E-E). As such, the cover 116 may cover or partially enclose the support beam 102 along an entirety of the length of the support beam 102. When the cover 116 is coupled to the support beam 102, the longitudinal axis A-A of the cover 116 is substantially parallel to the beam axis E-E of the support beam 102 to which the cover 116 is coupled.

Figure 8:
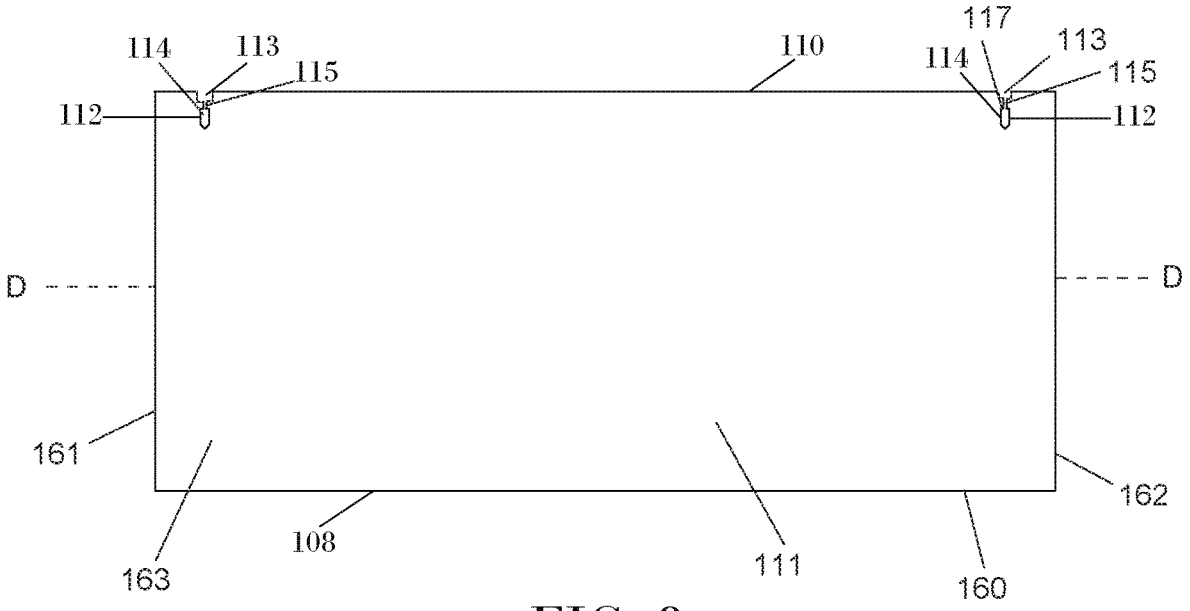
FIG. 8 illustrates a front elevation view of a baffle of a ceiling system in accordance with an embodiment of the present invention (a rear elevation view of the baffle being substantially identical to the front elevation view)

Referring to FIGS. 8 and 9, the ceiling system 100 further includes the plurality of baffles 108. In some exemplified embodiments, there is one baffle 108 associated with and configured for coupling to the support beams 102 and/or the covers 116 (also referred to as the support beam 102/cover 116 pairs). The claims may reference more than one baffle 108 using the prefixes "first," "second," and so forth. The description below applies to any of the baffles referenced in the claims, whether that be a singular baffle or multiple baffles. When there are multiple baffles in a ceiling system, the baffles may be identical to one another, although the invention is not to be so limited in all embodiments and the various baffles associated with a ceiling system may have structural differences relative to one another in other embodiments.

The baffle may comprise a baffle body 111 having a top surface 110, a bottom surface 160, a first end 161, and a second end 162. The baffle body 111 may also comprise a first side surface (or a first major surface) 163 and a second side surface (or a second major surface) 164 that is opposite the first side surface 163. The baffle 108 may be elongated along a baffle axis D-D that extends between the first and second side surfaces 161, 162, which may be deemed to form first and second ends of the baffle 108. The baffle may be formed from an acoustic material as described herein. The baffle 108 may have a rectangular shape as shown, or it may have any other shape as may be desired in other embodiments, including being wavy or planar and straight and having polygonal and irregular shapes to satisfy any desired décor.

Each baffle 108 comprises at least one, and possibly a plurality of baffle slots 112 formed into the top surface 110 thereof. Each baffle slot 112 extends from the top surface 110 downwards towards the bottom surface 160. The baffle slots 112 may extend only a small distance downwardly, such as between 5% and 10%, or more specifically between 5% and 15% of the height of the baffle body 111 measured between the bottom and top surfaces 108, 110. The baffle slots 112 may extend a greater or lesser distance in other embodiments so long as the baffle slots 112 are sufficiently dimensioned to enable the baffle slots 112 to receive various portions of the support beam 102 and/or the cover 116 as described below.

As seen in FIGS. 8-9, ceiling system 100 may include four generally parallel baffles 108 with two baffle slots 112 on each baffle 108. However, the quantity of baffles 108 (and support beams 102) can vary, as desired by a user. As seen in FIG. 9, there are four baffles 108 of identical dimensions (e.g., height, length, and thickness). In the alternative, a user may vary the dimensions (e.g., height, length, and thicknesses) of each baffle 108 in the system 100 as desired such that all the baffles have different dimensions (e.g., one or more have different height, length, and/or thickness), each baffle has unique dimensions, at least two baffles have identical dimensions but the remaining baffles have different dimensions, etc. The number of baffle slots 112 on each baffle 108 may match the number of support beams 102 to which the baffle 108 is to be attached. The number of alignment notches on a baffle may match the number of support beams 102 (e.g., see FIGS. 9, 10, 15, 19, 23, 27, 31). Each baffle slot 112 of each one of the baffles 108 may be configured to engage a different support beam 102 than engaged by other baffle slots 112 of that particular baffle 108. As seen in FIG. 9, each baffle slot 112 is configured to engage a particular one of the two support beams 102. In the alternative, the number and placement of baffle slots 112 on a particular baffle can vary from baffle to baffle as desired by a user.

Each of the baffle slots 112 extends through the thickness of the baffle 108 from the first side surface 163 to the second side surface 164. The baffle slots 112 comprise a top section 113 adjacent to the top surface 110 of the baffle body, a bottom section 114, and a middle section 115 located between the top and bottom sections 113, 114. The top section 113 may be configured to accommodate a portion of the cover 116, the middle section 115 may be configured to accommodate the longitudinal portion 137 of the vertical web portion 106 which is exposed through the notches 132 in the cover 116, and the bottom section 114 may be configured to accommodate the longitudinal portion 135 of the bulb portion 109 which is exposed through the notches 132 in the cover 116. The baffles 108 may be formed from a material which is capable of flexing so that the width of the baffle slots 112 increase as the baffles 108 are being coupled to the support beams 102 and the carriers 116 by the walls of the baffles 108 which bound the baffle slots 112 flexing outwardly.

As seen in FIG. 9, the baffles 108 are engaged to the support beams 102 and covers 116 (the support beam 102 and cover 116 already being in engagement with each other as previously described) one at a time. The two engaged support beams 102/covers 116 are of generally equal length, generally parallel to each other (although this is not required in all embodiments, examples of which are provided below), and spaced apart from one another by the same distance as the distance between the top sections 113 of the baffle slots 112 of the baffle 108 (i.e., the distance between the top sections 113 on the left side of the baffle 108 and the top section 113 on the right side of the baffle 108). Alternatively, each of the engaged support beams 102/covers 116 may be at a different angle relative to the horizontal plan than the other support beam 102/cover 116. The baffles 108 need not be attached to the support beams 102 and covers 116 in any particular order.

A first baffle 108 of the four baffles 108 is engaged to the engaged support beams 102/covers 116 by aligning the baffle slots 112 on the left and right of the baffle 108 with the respective alignment notches 132 on the left and right covers 116. The top portions 113 of the baffle slots 112 of the first baffle 108 are pressed against the respective longitudinal portions 135 of the bulb portions 109 on the left and right support beams 102 (or by some combination of movement whereby the bulb portion 109 is pressed against the baffle slots 112), which are exposed within the alignment notches 132 of the cover 116 as described above. The material of the baffle 108 possesses enough flexibility and resiliency that the bulb portions 109 of the support beams 102 move through the baffle slots 112 towards bottom section 114 of the baffle slots 112. The bulb portion 109 enters and engages at least a portion of the walls of the bottom sections 114 of the baffle slots 112. As each bulb portion 109 nests within and/or engages its respective bottom section 114 of the baffle slots 112, the baffle 108 will engage with the alignment notches 132 on the left and right covers 116 such that, when fully engaged, the top surface 110 of the baffle 108 will engage a top side 133 of each of the alignment notches 132, with a portion of the generally vertical portion 107 generally disposed within the top section 113 of the baffle slots 112.

The baffle slots 112 may comprise a downwardly facing shoulder 117 located between the bottom section 114 and the middle section 115. The downwardly facing shoulder 117 may form a transition between the bottom section 114 and the middle section 115. When the baffle slots 112 are mounted to the support beam 102, the downwardly facing shoulder 117 of the baffle slot 112 may rest atop of the upper ledge surface of the beam protuberance 170 of the bulb portion 109 of the support beam 102. This engagement between the downwardly facing shoulder 117 of the baffle slot 112 with the beam protuberance 170 may assist in maintaining the baffle 108 mounted to the support beam 102. Other engagement, compression fit, friction fit, and the like between the baffle 108 and the support beam 102 and/or the cover 116 may further assist in maintaining the baffle 108 in its mounted state. A certain amount of force may then be required to engage/disengage the baffle 108 and support beams 102/covers 116. The weight of the baffle 108 itself may be insufficient to disengage the baffle 108 from the support beams 102/covers 116. Each of the remaining three baffles 108 is, in turn, engaged to the support beams 102/covers 116 in the same/similar manner.

With reference to FIG. 9, the relative positioning of the portions of the support beam 102, the cover 116, and the baffle 108 will be described when the baffles 108 are coupled to the support beams 102 within the notches 132 of the cover 116. The baffles 108 are slid or moved or translated upwardly towards the previously coupled support beams 102 and covers 116 as shown by the arrow in FIG. 9. The baffles 108 are arranged so that the baffle slots 112 are aligned with the notches 132 in the covers 116 and with the exposed longitudinal portions 135, 137 of the bulb portion 109 (or beam protuberance 170 thereof) and vertical web portion 106. As the baffle 108 is slid upwardly, the exposed longitudinal portions 135 of the bulb portion 109 passes into and through the top and middle sections 113, 115 of the baffle slots 112 until the bulb portions 109 nest within the bottom sections 114 of the baffle slots 112. When so positioned, the exposed longitudinal portions 135 of the bulb portions 109 of the support beams 102 are located within the bottom sections 114 of the baffle slots 112, the exposed longitudinal portions 137 of the vertical web portions 106 of the support beams 102 are located within the middle section 115 of the baffle slots 112, and a portion 139 of the cover body 175 located between the notches 132 and the top end 118 of the cover 116 is located within the top section 113 of the baffle slots 112. As such, and as seen in FIG. 9, once the baffles 108 are engaged with the support beams 102 and the covers 116, the longitudinal portions 135, 137 of the bulb portions 109 and the vertical web portions 106 of the support beam 102 are no longer exposed as they are located within the baffle slots 112.

The engagement of the baffle 108 with the portion 139 of the cover 116 may result in the baffle 108 exerting a compression force onto the portion 139 of the cover 116 which is located above the notch 132. This compression force may result in the creation of or an increase of a friction fit between the vertical web position 106 of the support beam 102 and the cover 116. In particular, as the baffle 108 may apply opposing inward forces onto the portion 139 of the cover 116, this may force the cover 116 into more intimate surface contact with the support beam 102. As with the prior description of compression, again here the compression may not require the material itself to deform, but may simply indicate an inward force being applied. Moreover, the friction fit between the cover 116 and the support beam 102 may still permit the cover 116 to move or slide relative to the support beam 102. The creation of a friction fit or the increase in the friction fit may make such sliding more difficult, but it may still be possible. Thus, the creation or increase of the friction fit may increase the coefficient of kinetic friction between the cover 116 and the support beam 102, but may not do so to a sufficient degree to prevent sliding movement of the cover 116 relative to the support beam 102 in some embodiments.

Figure 35:
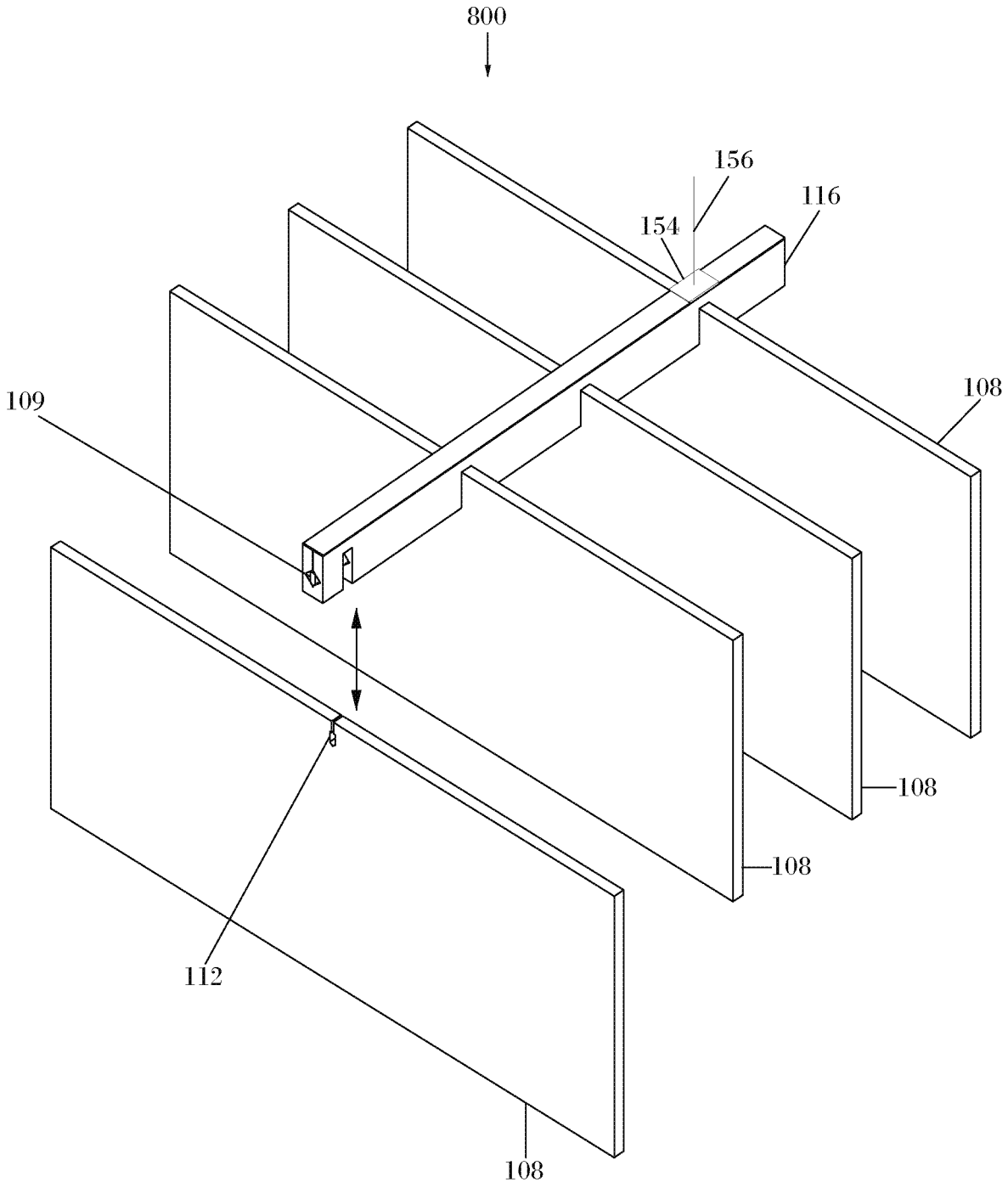
FIG. 35 illustrates a top, front, right perspective view of a ceiling system in accordance with still another embodiment of the invention, similar to the embodiments seen in FIGS. 9, 15, 19, 23, 27, and 31, but with only a single support beam, and with a double-ended arrow indicating directions of movement for the baffles to engage with/disengage from the support beam/cover (three of the baffles shown in engagement with the support beam/cover and the fourth baffle shown disengaged from the support beam/cover)
Figure 36:
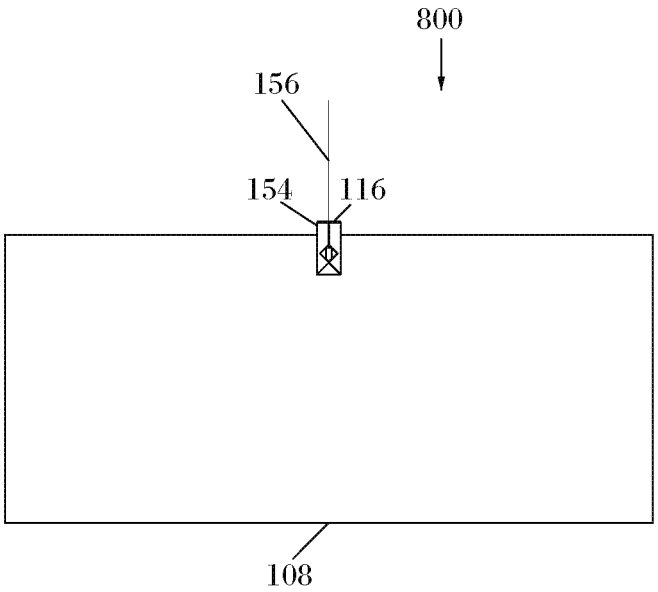
FIG. 36 illustrates a front elevation view of the ceiling system of FIG. 35
Figure 37:
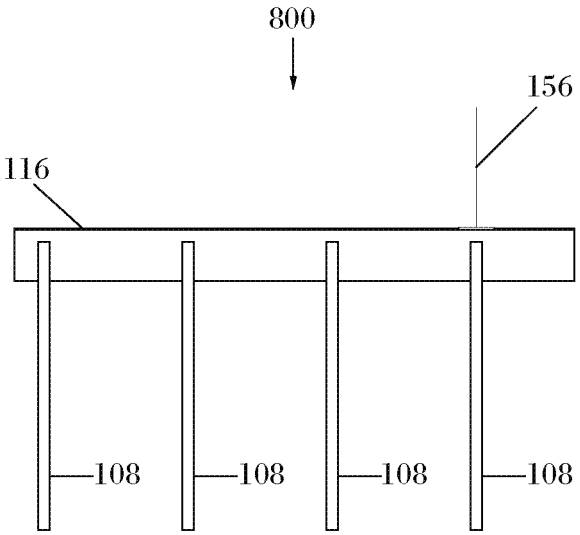
FIG. 37 illustrates a left side elevation view of the ceiling system of FIG. 35.
Figure 38:
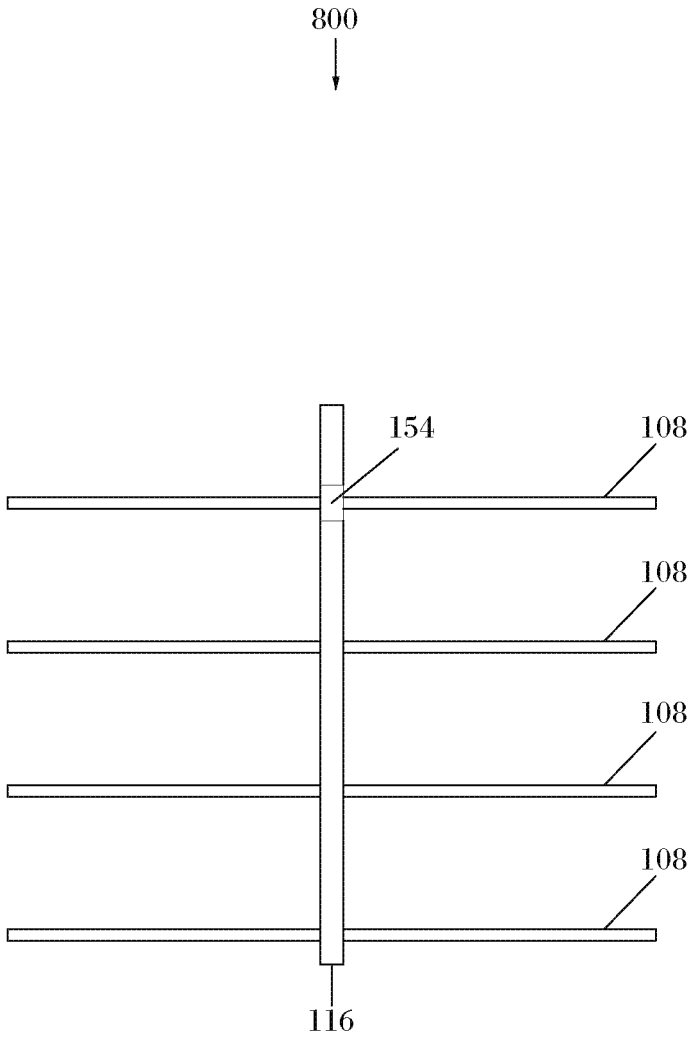
FIG. 38 illustrates a top plan view of the ceiling system of FIG. 35.

FIG. 9 illustrates two support beams 102 (a first support beam and a second support beam) each as described above with reference to the support beam 102. Furthermore, in FIG. 9 each of the support beams 102 is covered or at least partially enclosed with one of the covers 116, which is exactly as described above with reference to the covers 116. The support beams 102 may be parallel as shown, or non-parallel but also non-intersecting in other embodiments. Each of the baffles 108 extends between and is coupled to both of the support beams 102. In other embodiments, the baffles 108 may be configured to be coupled to a single support beam 102 (see, for example, FIGS. 35-37 described below). The claims may refer to a "first" support beam, cover, and baffle, and a "second" support beam, cover, and baffle, and it should be appreciated that this use of the prefixes "first" and "second" is intended only to differentiate between two structures of the same type described herein.

Each of the baffles 108 and covers 116/sheets 136 may be made using a sheet of one or more acoustic absorbing materials such as a sound-absorbing/barrier/acoustical material including, but not limited to, fabric-covered synthetic polymer foam, fabric-covered glass wool composite material, or the like. Alternatively, each of the baffles 108 and covers 116/sheets 136 may be made from other sound-absorbing materials including, but not limited to, synthetic foam or nonwoven polymer (without fabric), or synthetic foam or nonwoven polymer covered by a perforated metallic sheet, wood, wool or the like. In the alternative, each of the baffles 108 and covers 116/sheets 136 may also be formed from a metallic sheet, a polymeric sheet, or the like. Metallic sheets 136, for example, may be pressed or bent into the required folded generally U-shape of the covers 116 by various methods known in the art. Polymeric sheet stock, for example, may be pressed/bent under heating to obtain the required shape of the covers 116. Polymeric sheets having the required folded general U-shape, for example, may also be molded such as by injection molding directly into the required general U-shape of each cover 116.

As seen in FIGS. 7 and 9, one or more brackets 154 may engage each of the support beams 102. In FIGS. 7 and 9, not all brackets 154 and cables (or threaded rods) 156 are shown for reasons of clarity. Each bracket 154 may engage a top side of the flange portion 104 which forms the upper, horizontal portion of the "T" of each support beam 102. Each bracket 154 may be configured to slidably engage a particular support beam 102. In this manner, when each particular bracket 154 engages a particular support beam 102, at least one portion of that bracket 154 engages the top side of the flange portion 104 with another portion of that bracket 154 sliding between a bottom side of that flange portion 104 and the top side 118 of the cover 116 engaging that particular support beam 102. In the alternative, a bracket 154 may be attached to a support beam 102 by various fasteners including, without limitation, mechanical fasteners, chemical fasteners (e.g., adhesives), or the like.

A threaded rod or cable 156 (e.g., aircraft cable or wire ropes, etc.) is configured to engage the bracket 154 (e.g., generally one threaded rod or cable 156 per bracket 154, but more than one threaded rod or cable 156 may be used in connection with a single bracket 154 as desired by a user) in order to hang the assembly 100 (e.g., from a support structure such as a ceiling or other higher location). The threaded rod or cable 156 is configured to engage the bracket 154 using conventional methods that include, without limitation, fasteners (e.g., mechanical, chemical, or the like), welding, or the like. For example, threads of a threaded rod 156 may engage threads formed in the bracket 154. The bracket 154 may be made from various materials including, without limitation, metal (e.g., steel or an alloy thereof, aluminum, and the like), plastic, or the like. The number of brackets 154 engaging any particular support beam 102, as well as the spacing of the brackets 154 along that support beam 102, may vary as desired by a user. The ceiling system 100 seen in FIG. 9 is configured as a generally quadrilateral array (when seen from above or below) with two spaced-apart paired support beams 102/covers 116 arranged generally perpendicular to four generally evenly spaced-apart baffles 108. Each cover 116 may have four alignment notches 132 to engage a particular one of the baffles 108.

As shown in FIGS. 10-14 for purposes of illustration, another embodiment of the present invention resides in an architectural fixture assembly in the form of a ceiling system 200. Except for purposes of clarity, reference numbers used to describe features in the system 100 will be used to describe identical/similar features in the system 200. The system 200 has many similar, if not identical, features as described above in reference to the system 100, except that the system 200 describes a generally quadrilateral array (when seen from above or below) including four generally evenly spaced apart support beam 102/cover 116 pairs arranged generally perpendicular to eighteen generally parallel baffles 108 (with four brackets 154 and four cables 156 per support beam 102) spaced evenly apart from one another along the longitudinal length of each of the support beam 102/cover 116 pairs. Each cover 116 may have eighteen alignment notches 132 to engage a particular one of the eighteen baffles 108. The system 200 is assembled in a manner similar to that described above and below with respect to the system 100.

As shown in FIGS. 15-18 for purposes of illustration, another embodiment of the present invention resides in an architectural fixture assembly in the form of a ceiling system 300. Except for purposes of clarity, reference numbers used to describe features in the systems 100, 200 will be used to describe identical/similar features in the system 300. In FIGS. 15-18, not all brackets 154 and cables (or threaded rods) 156 are shown for reasons of clarity. The system 300 has many similar, if not identical, features as described above in reference to the systems 100, 200 except that the system 300 describes a generally quadrilateral array (when seen from above or below) including two generally parallel, evenly spaced apart support beam 102/cover 116 pairs of differing longitudinal lengths, and four non-parallel, spaced-apart baffles 308 (with two brackets 154 and two cables 156 per support beam 102/cover 116 pair) where the baffles 308 are arranged laterally across the support beam 102/cover 116 pairs at differing angles relative to perpendicular. That is, the baffles 308 are not oriented perpendicularly to the support beams 102 but are instead oriented at angles relative to the support beams 102.

Figure 15:
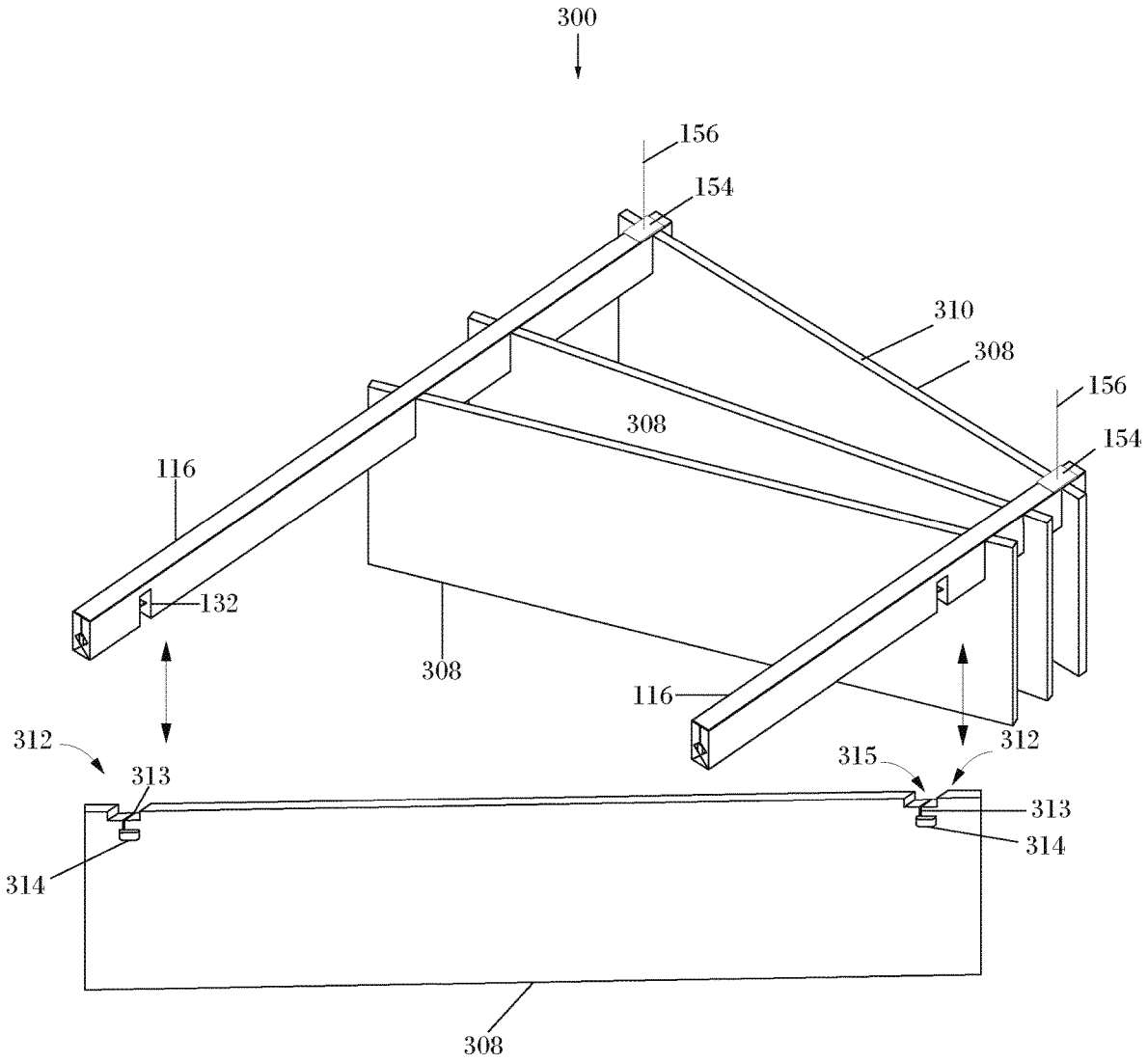
FIG. 15 illustrates a top, front, right perspective view of a ceiling system in accordance with a further embodiment of the invention, similar to the embodiment seen in FIG. 9, but with alignment notches of the baffles and covers configured such that a number of the generally vertical baffles laterally extend between and engage the profiles/covers at an angle relative to the lateral direction, and with a double-ended arrow indicating directions of movement for the baffles to engage with/disengage from the support beams/covers (three of the baffles shown in engagement with the support beams/covers and the fourth baffle shown disengaged from the support beams/covers)
Figure 16:
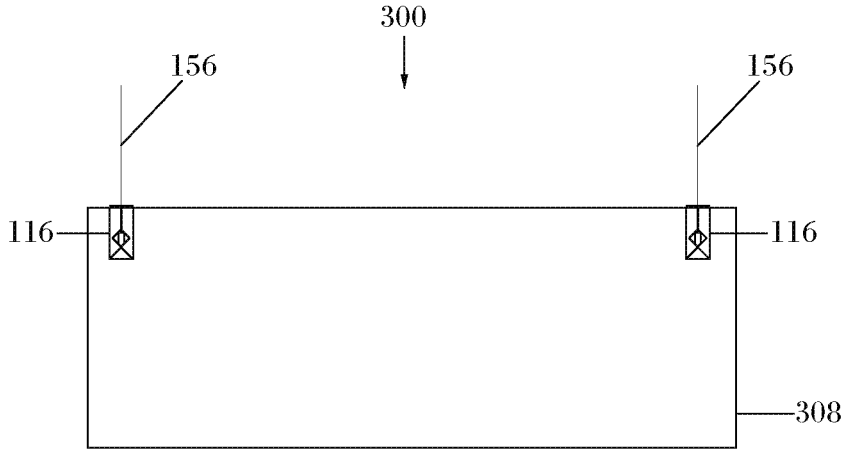
FIG. 16 illustrates a front elevation view of the ceiling system of FIG. 15.
Figure 17:
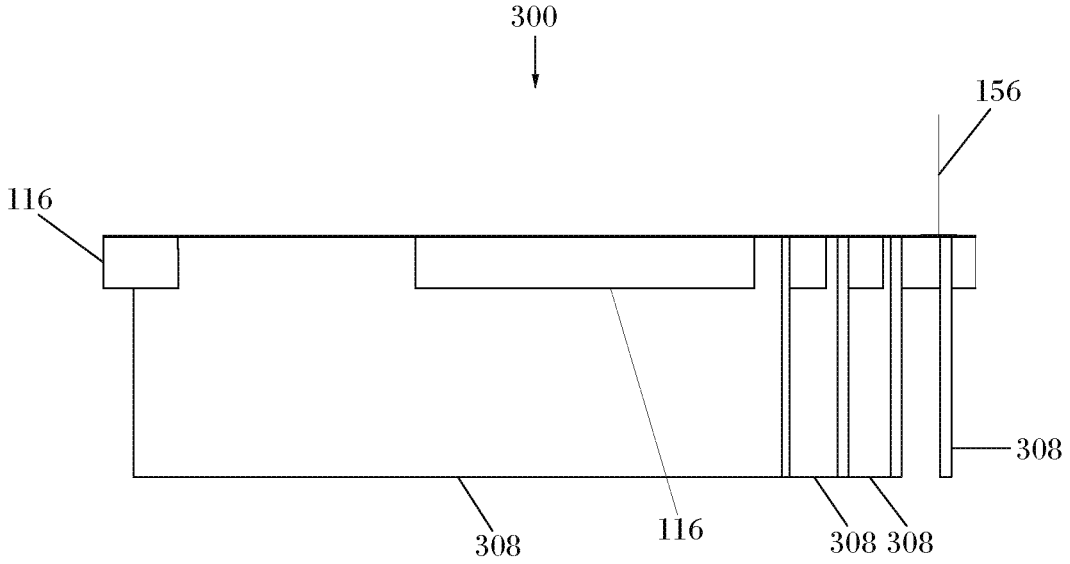
FIG. 17 illustrates a left side elevation view of the ceiling system of FIG. 15.
Figure 18:
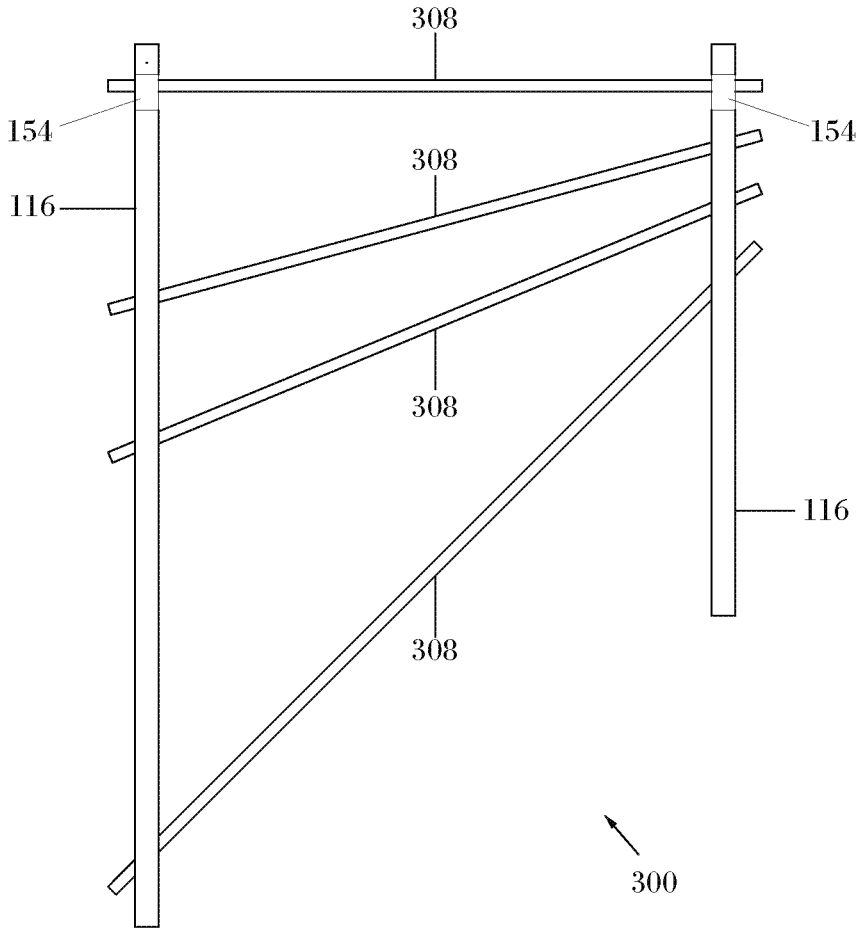
FIG. 18 illustrates a top plan view of the ceiling system of FIG. 15.

Each baffle 308 includes a top side 310 and a plurality of alignment notches 312. Each alignment notch 312 extends from the top side 310 downwards. As seen in FIGS. 15-18, the particular embodiment of the system 300 illustrated therein includes four baffles 308 with two baffle slots 112 on each baffle 308. As seen in FIG. 15, there are four baffles 108 of otherwise identical dimensions (e.g., height, thickness) except for length. The number of alignment notches 312 on each baffle 308 matches the number of support beams 102. Each alignment notch 312 of each one of the baffles 308 is configured to engage a different support beam 102 than engaged by other alignment notch(es) 312 of that particular baffle 308.

As seen in FIG. 15, each alignment notch 312 is configured to engage a particular one of the two support beams 102. In the alternative, the number and placement of alignment notches 312 on a particular baffle can vary from baffle to baffle as desired by a user. Each alignment notch 312 of each one of the plurality of baffles 308 includes a middle portion (or slit portion) 313, a bottom portion (or receptacle portion) 314, and a top portion (or recess portion) 315, where each bottom portion 314 is configured to engage the bulb portion 109 of no more than one of the support beams 102. The top portion 315 extends from the top side 310 of the baffle 308 downwards to the middle portion 113, with the middle portion 113 extending downwards to the bottom portion 314. The top portion 315 of the baffle slots and the alignment notches 132 may be oriented at the same angle. The walls of each top portion 315 are angled to match the angle of the baffle 308 extending laterally between the two support beams 102 relative to perpendicular, with the walls of the alignment notches 132 of the covers 116 at the same angle such that the alignment notches 312 of the baffle 308 engages the alignment notches 132 of the covers 116.

The bottom portion 314 of the alignment notch 312 engages the bulb portion 109 of one of the support beams 102, with the bottom portion 314 being slot-shaped so as to allow the bulb portion 109 to be inserted through the middle portion 313 and allowing the baffle 308 to be rotated such that the baffle 308 is oriented at the proper angle. The alignment notches 312 may be formed in the baffles 308 by conventional methods. In the exemplified embodiment, the relative angle of each baffle 308 is such that imaginary lines extending linearly from each baffle 308 would all intersect at a common point. Alternatively, the relative angle of each baffle 308 could be such that imaginary lines extending linearly from each baffle 108 would not all intersect at a common point.

Each cover 116 has four alignment notches 132 to engage a particular one of the baffles 108. However, as desired by a user, the alignment notches 132 of each cover 116 are spaced unevenly apart from one another along the longitudinal length of each of the covers 116 such that each the baffles 308 are spaced unevenly apart along the longitudinal length of each of the covers 116. Each of the support beam 102/cover 116 pairs has a different longitudinal length, and the alignment notches 132 on the longer cover 116 are spaced apart from each other along the length of the longer cover 116 a greater amount than the alignment notches 132 on the shorter cover 116 (which are bunched closer to each other) in order to create the angled look of the baffles 308 extending laterally between the two support beam 102/cover 116 pairs. Each alignment notch 132 on each of the covers 116 is configured to be sized and shaped for the desired angle of baffle engagement with the cover 116 relative to perpendicular.

Figure 19:
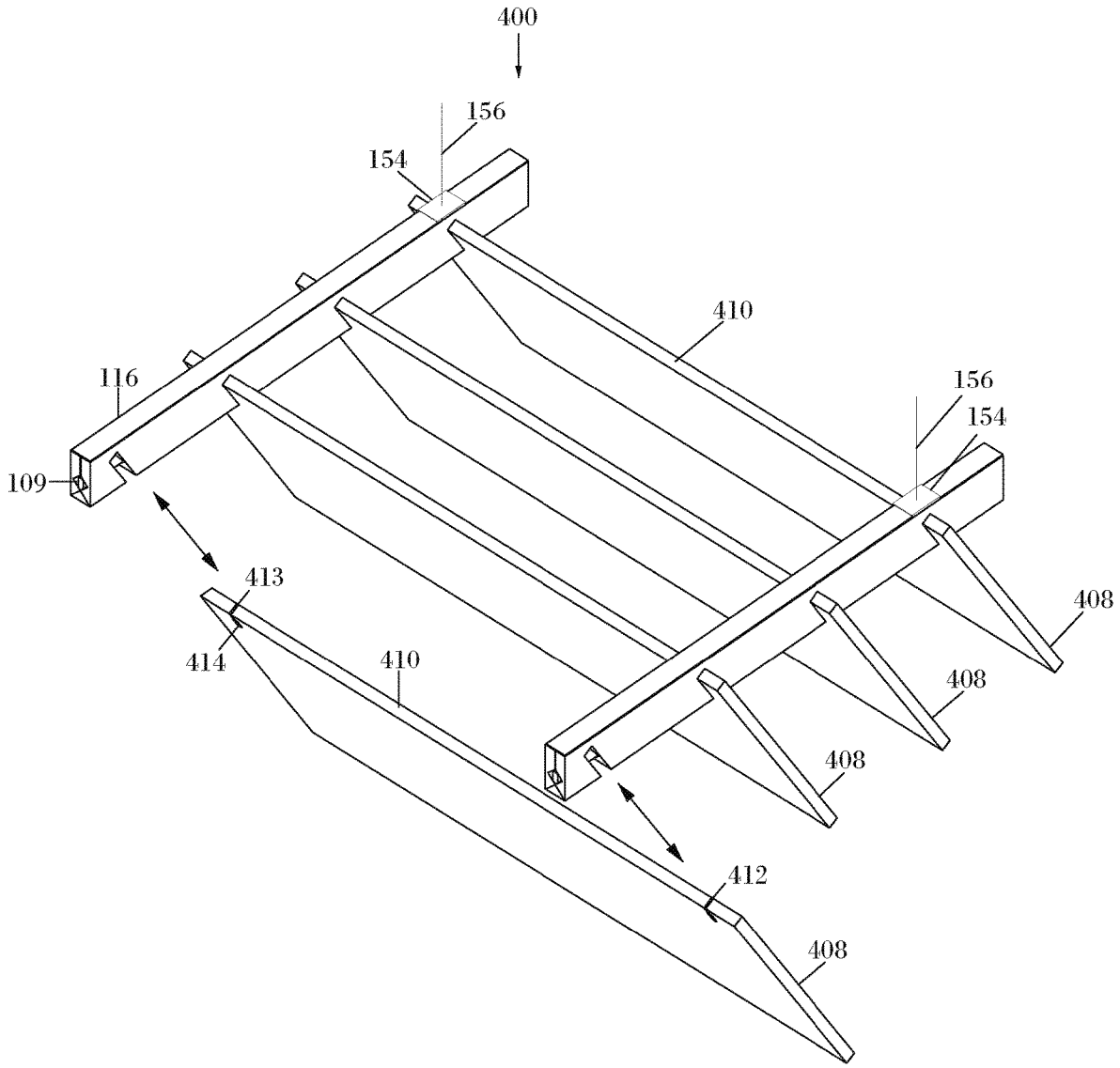
FIG. 19 illustrates a top, front, right perspective view of a ceiling system in accordance with a further embodiment of the invention, similar to the embodiments seen in FIGS. 9 and 15, but with alignment notches of the baffles and covers configured such that a number of the baffles laterally extend between and engage the profiles/covers at an angle relative to a generally horizontal plane defined by the ceiling system, and with a double-ended arrow indicating directions of movement for the baffles to engage with/disengage from the support beams/covers (three of the baffles shown in engagement with the support beams/covers and the fourth baffle shown disengaged from the support beams/covers)
Figure 20:
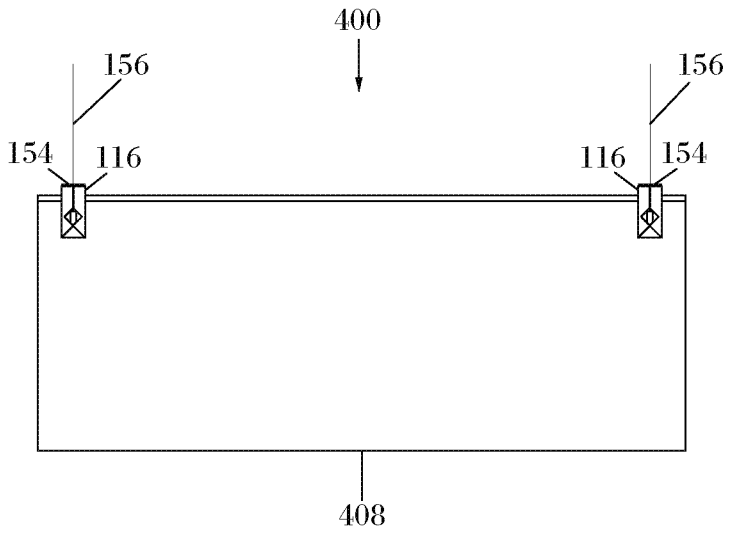
FIG. 20 illustrates a front elevation view of the ceiling system of FIG. 19.
Figure 21:
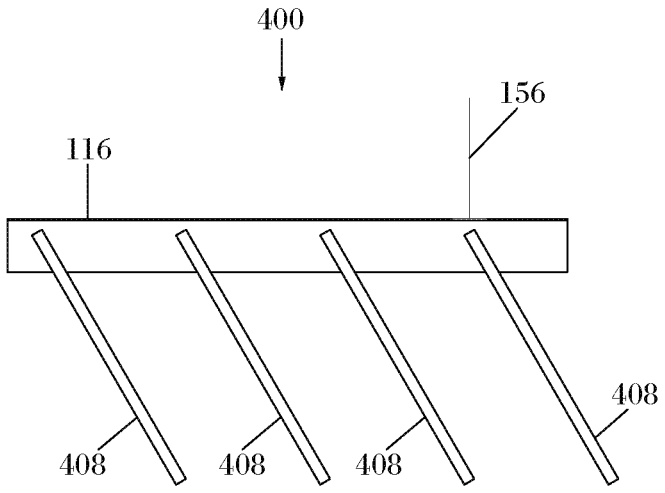
FIG. 21 illustrates a left side elevation view of the ceiling system of FIG. 19.
Figure 22:
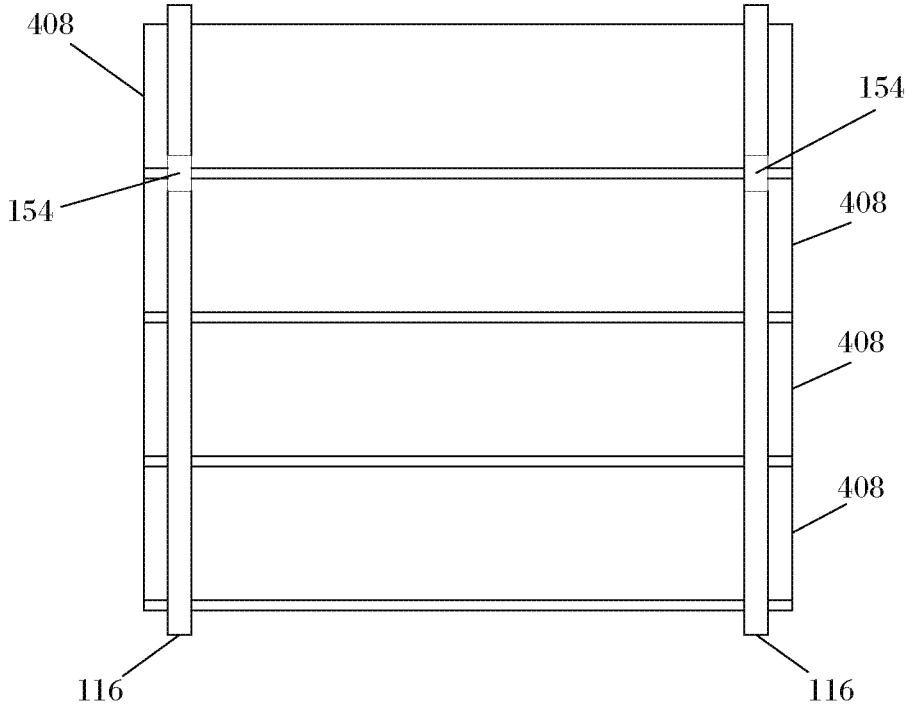
FIG. 22 illustrates a top plan view of the ceiling system of FIG. 19.

As shown in FIGS. 19-22 for purposes of illustration, another embodiment of the present invention resides in an architectural fixture assembly in the form of a ceiling system 400. Except for purposes of clarity, reference numbers used to describe features in the systems 100, 200, 300 will be used to describe identical/similar features in the system 400. In FIGS. 19-22, not all brackets 154 and cables (or threaded rods) 156 are shown for reasons of clarity. The system 400 has many similar, if not identical, features as described above in reference to the systems 100, 200, 300 except that the system 400 describes a generally quadrilateral array (when seen from above or below) including two generally parallel, co-planar, evenly spaced apart support beam 102/cover 116 pairs of equal longitudinal lengths, and four parallel, spaced-apart baffles 408 (with two brackets 154 and two cables 156 per support beam 102 (only two brackets 154 and two cables 156 are shown in FIG. 19 for purposes of clarity)) where the baffles 408 are arranged laterally across the support beam 102/cover 116 pairs (generally perpendicular to the support beam 102/cover 116 pairs) at identical angles relative to a generally horizontal plane defined by at least the support beams 102/covers 116 of the system 400. Each baffle 408 includes a top side 410 and a plurality of alignment notches 412. Each alignment notch 412 extends from the top side 410 downwards.

As seen in FIGS. 19-22, the particular embodiment of the assembly 400 illustrated therein includes four baffles 408 with two alignment notches 412 on each baffle 408. As seen in FIG. 19, there are four baffles 408 of otherwise identical dimensions (e.g., height, length, thickness). The number of alignment notches 412 on each baffle 408 matches the number of support beams 102. Each alignment notch 412 of each one of the baffles 408 is configured to engage a different support beam 102 than engaged by other alignment notch(es) 412 of that particular baffle 408.

As seen in FIG. 19, each alignment notch 412 is configured to engage a particular one of the two support beams 102. In the alternative, the number and placement of alignment notches 412 on a particular baffle can vary from baffle to baffle as desired by a user. Each alignment notch 412 of each one of the plurality of baffles 408 includes a slit portion 413 and a receptacle portion 414, where each receptacle portion 414 is configured to engage the vertical web portion 106 of no more than one of the support beams 102. The slit portion 413 extends from the top side 410 of the baffle 408 downwards to the receptacle portion 414. The walls of each alignment notch 132 are angled to match the angle of the baffle 308 relative to the horizontal plane defined by the system 400 such that the alignment notches 412 of the baffle 408 engage the alignment notches 132 of the covers 116. The receptacle portion 414 of an alignment notch 412 engages the vertical web portion 106 of one of the support beams 102, with the receptacle portion 414 being sized and shaped so as to allow the vertical web portion 106 to be inserted through the slit portion 413 and allowing the baffle 408 to engage the alignment notches 132 at the proper angle. The alignment notches 412 may be formed in the baffles 408 by conventional methods.

Each cover 116 has four alignment notches 132 to engage a particular one of the baffles 408. However, as desired by a user, the alignment notches 132 of each cover 116 are spaced evenly apart from one another along the longitudinal length of each of the covers 116 such that each the baffles 408 are spaced evenly apart along the longitudinal length of each of the covers 116. Each support beam 102/cover 116 pairs has the same longitudinal length, and the alignment notches 132 on each support beam 102/cover 116 pair are aligned with the alignment notches 132 on the other support beam 102/cover 116 pair in order to create the generally parallel, spaced-apart look of the baffles 408 extending laterally between the two support beam 102/cover 116 pairs. Each alignment notch 132 on each of the covers 116 is configured to be sized and shaped for the desired angle of baffle engagement with the cover 116 relative to the horizontal plane defined by the system 400.

As shown in FIGS. 23-26 for purposes of illustration, another embodiment of the present invention resides in an architectural fixture assembly in the form of a ceiling system 500. Except for purposes of clarity, reference numbers used to describe features in the systems 100, 200, 300, 400 will be used to describe identical/similar features in the system 500. In FIGS. 23-26, not all brackets 154 and cables (or threaded rods) 156 are shown for reasons of clarity. The system 500 has many similar, if not identical, features as described above in reference to the systems 100, 200, 300, 400 except that the system 500 describes a generally quadrilateral array (when seen from above or below) including two generally parallel, co-planar, evenly spaced apart support beam 102/cover 116 pairs of generally equal longitudinal lengths, and four non-parallel or semi-parallel, spaced-apart, curved baffles 508 (with two brackets 154 and two cables 156 per support beam 102) where the baffles 508 are arranged laterally across the support beam 102/cover 116 pairs. Each baffle 508 may have the same curvature along its longitudinal length as the other baffles 508, each baffle 508 may have its own curvature, or one or more of the baffles 508 may have the same curvature while the remaining baffles 508 have a different curvature(s).

Figure 23:
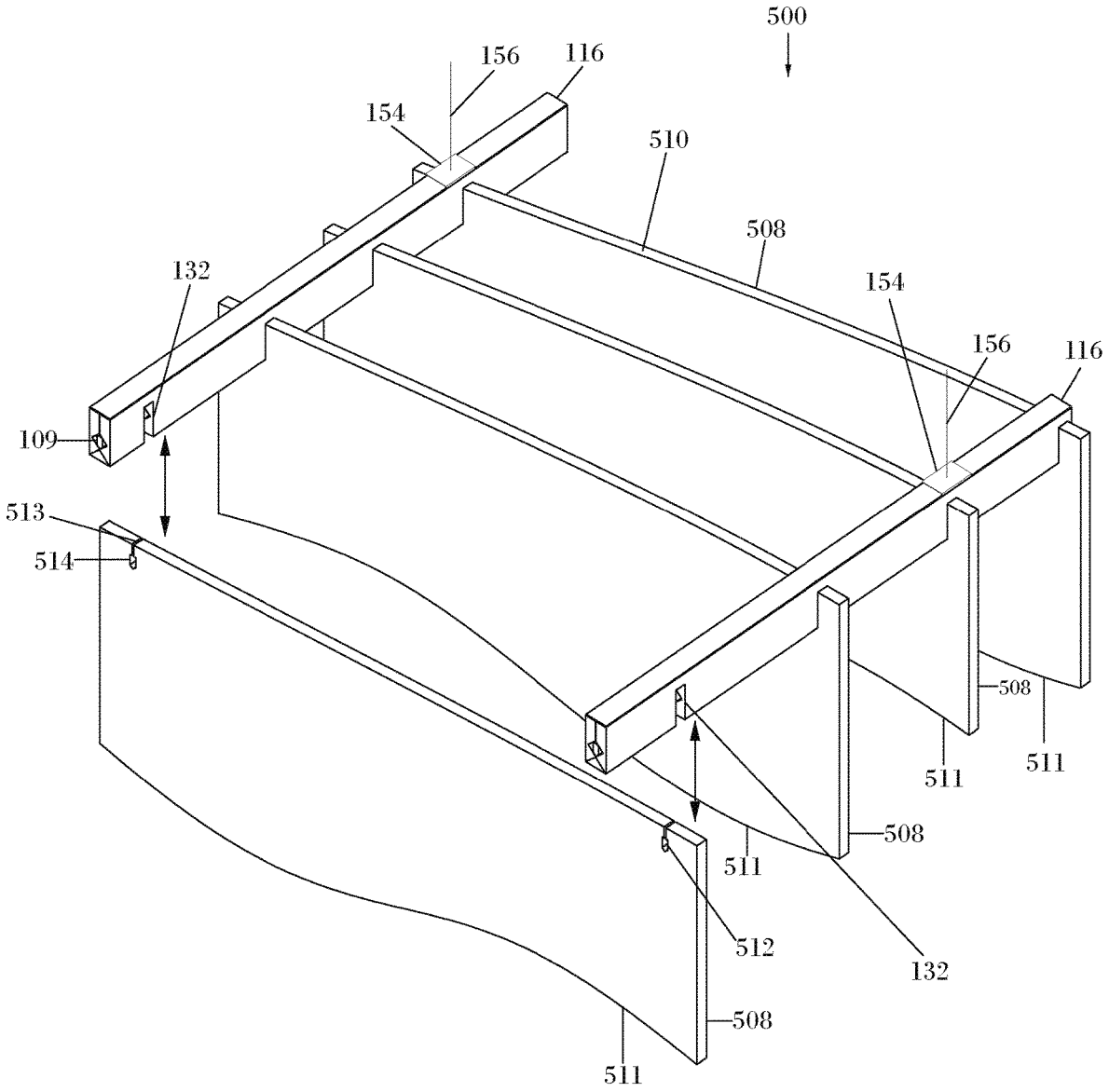
FIG. 23 illustrates a top, front, right perspective view of a ceiling system in accordance with a further embodiment of the invention, similar to the embodiments seen in FIGS. 9, 15, and 19, but with each baffle having a longitudinal curvature (a bottom side of each baffle may have a wave-like shape including one or more curves), alignment notches of the baffles and covers configured such that a number of the baffles laterally extend between and engage the profiles/covers at an angle relative to the lateral direction, and with a double-ended arrow indicating directions of movement for the baffles to engage with/disengage from the support beams/covers (three of the baffles shown in engagement with the support beams/covers and the fourth baffle shown disengaged from the support beams/covers)
Figure 24:
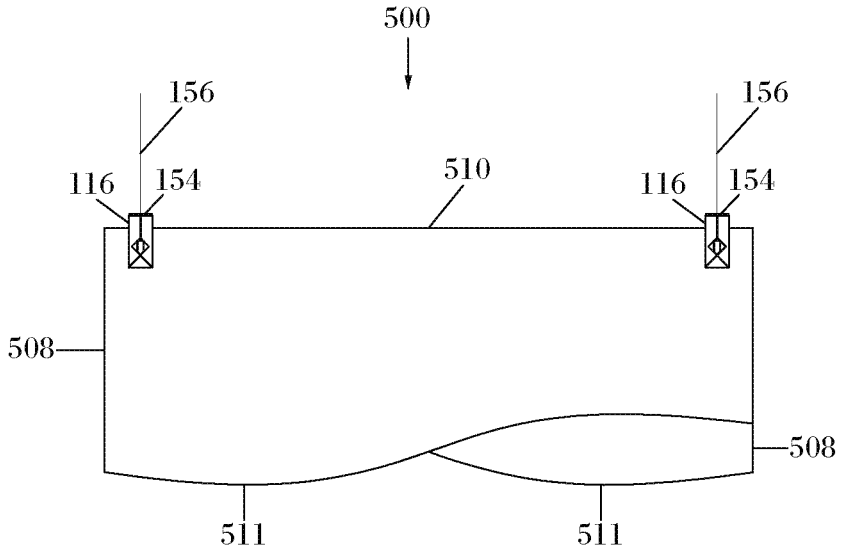
FIG. 24 illustrates a front elevation view of the ceiling system of FIG. 23.
Figure 25:
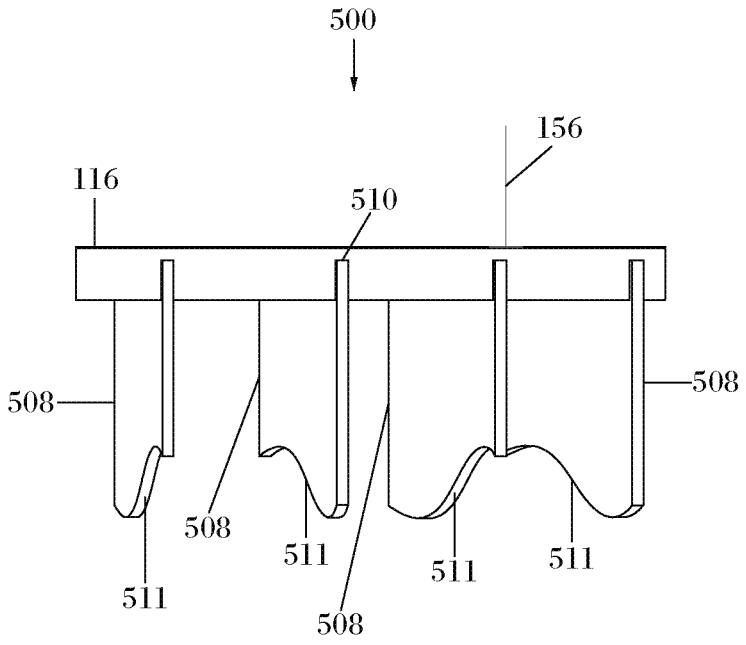
FIG. 25 illustrates a left side elevation view of the ceiling system of FIG. 23.
Figure 26:
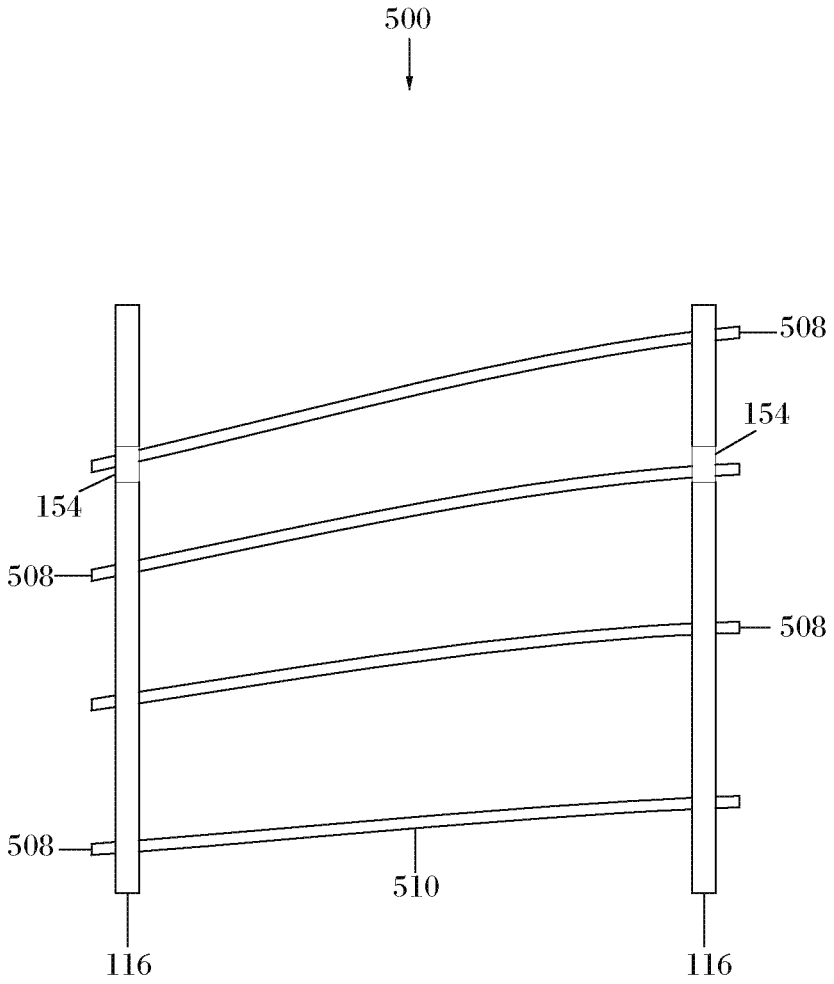
FIG. 26 illustrates a top plan view of the ceiling system of FIG. 23.
Figure 27:
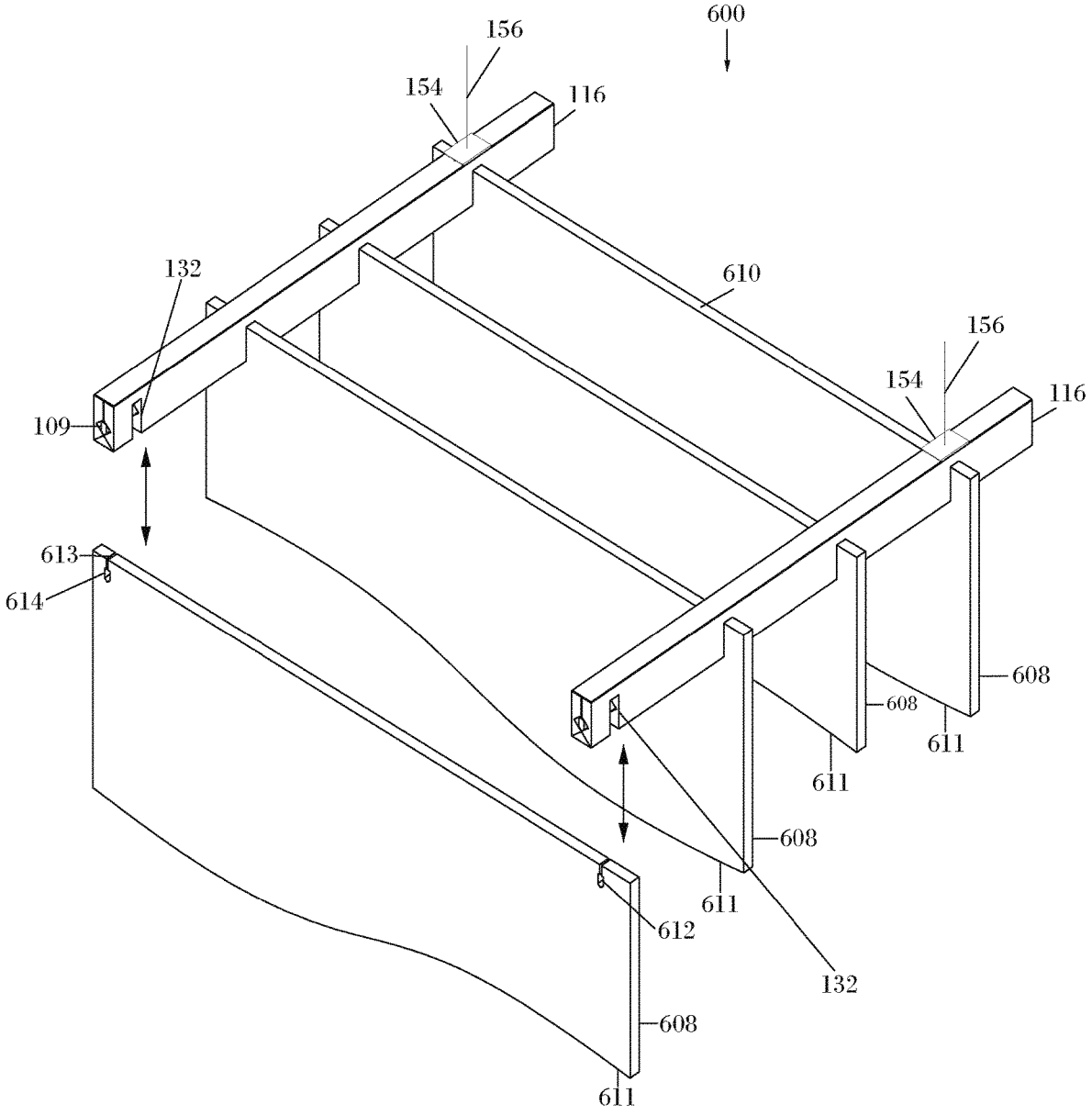
FIG. 27 illustrates a top, front, right perspective view of a ceiling system in accordance with a further embodiment of the invention, similar to the embodiments seen in FIGS. 9, 15, 19, and 23, but with a bottom side of each baffle having a wave-like shape including one or more curves, and with a double-ended arrow indicating directions of movement for the baffles to engage with/disengage from the support beams/covers (three of the baffles shown in engagement with the support beams/covers and the fourth baffle shown disengaged from the support beams/covers)
Figure 28:
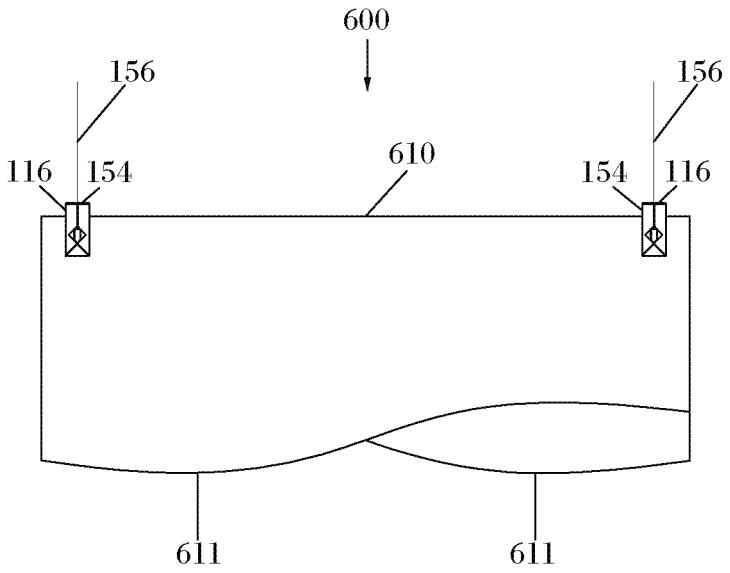
FIG. 28 illustrates a front elevation view of the ceiling system of FIG. 27.
Figure 29:
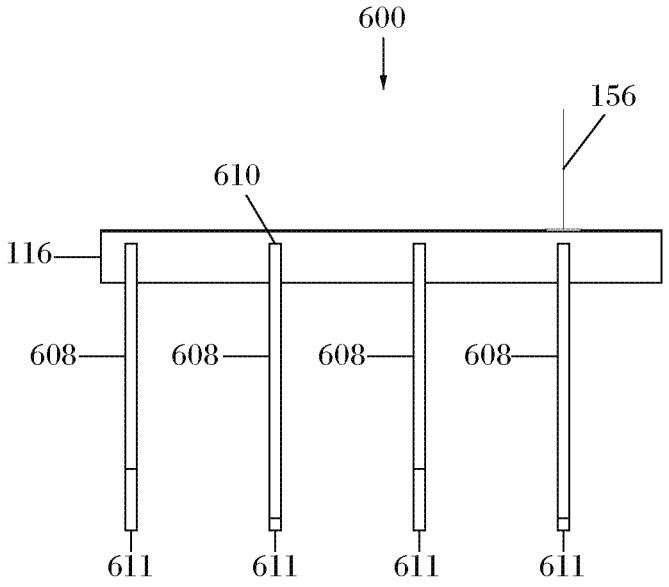
FIG. 29 illustrates a left side elevation view of the ceiling system of FIG. 27.
Figure 30:
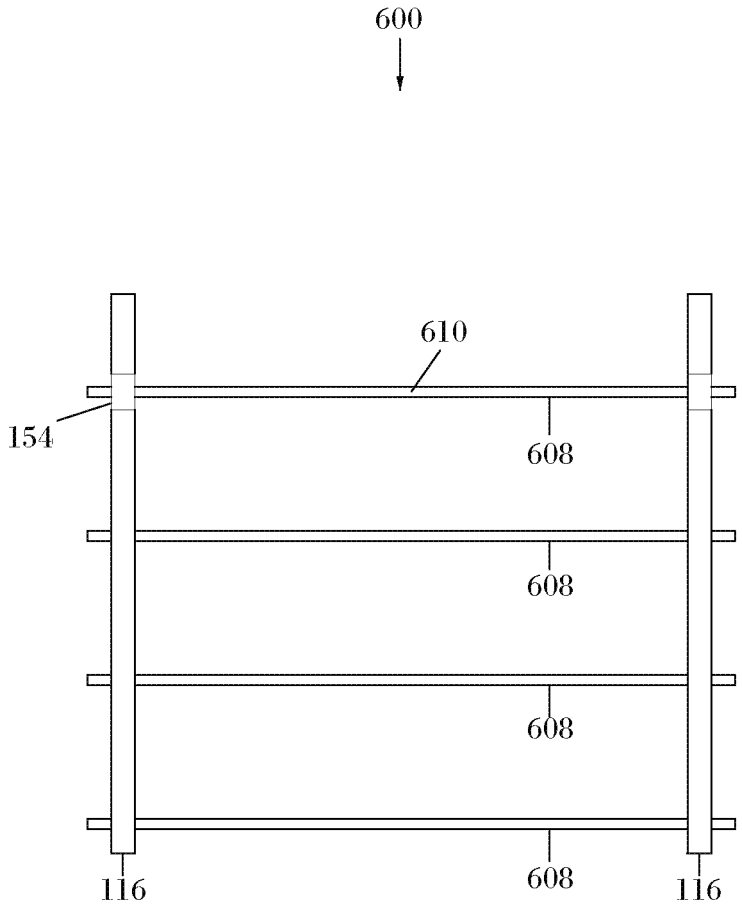
FIG. 30 illustrates a top plan view of the ceiling system of FIG. 27.

Each baffle 508 includes a top side 510 and a plurality of alignment notches 512. Each alignment notch 512 extends from the top side 510 downwards. As seen in FIGS. 23-26, the particular embodiment of the system 500 illustrated therein includes four baffles 508 with two alignment notches 512 on each baffle 508. As seen in FIG. 23, there are four baffles 108 of roughly similar dimensions (e.g., height, length, thickness) except for curvature along the length of each baffle 508. The number of alignment notches 512 on each baffle 508 matches the number of support beams 102. Each alignment notch 512 of each one of the baffles 508 is configured to engage a different support beam 102 than engaged by other alignment notch(es) 512 of that particular baffle 508.

As seen in FIG. 23, each alignment notch 512 is configured to engage a particular one of the two support beams 102. In the alternative, the number and placement of alignment notches 512 on a particular baffle can vary from baffle to baffle as desired by a user. Each alignment notch 512 of each one of the plurality of baffles 508 includes a slit portion 513, and a receptacle portion 514, where each receptacle portion 514 is configured to engage the vertical web portion 106 of no more than one of the support beams 102. The slit portion 513 extends from the top side 310 of the baffle 508 downwards to the receptacle portion 514. The walls of each of the alignment notches 132 of the covers 116 are angled to match the angle of the curved baffle 508 engaging that particular alignment notch 132 such that the alignment notches 512 of the baffles 508 engage the respective the alignment notches 132 of the covers 116 assigned to those alignment notches 512. The receptacle portion 514 of an alignment notch 312 engages the vertical web portion 106 of one of the support beams 102. The alignment notches 512 may be formed in the baffles 508 by conventional methods.

Each cover 116 has four alignment notches 132 to engage a particular one of the baffles 508. However, as desired by a user, the alignment notches 132 of each cover 116 are configured and spaced apart from one another along the longitudinal length of each of the covers 116 to account for the curvature of the baffles 508. Each baffle 508 includes a bottom side 511. The surface of each bottom side 511 includes one or more curved surfaces. Each baffle 508 may have its own unique curved surface(s) on its bottom side 511, all the baffles 508 may have identical curved surface(s) on the bottom side 511, or one or more of the baffles 508 may have identical curved surface(s) on the bottom side 511 but the remaining baffles 508 have different curved surface(s) on the bottom side 511.

As shown in FIGS. 27-30 for purposes of illustration, another embodiment of the present invention resides in an architectural fixture assembly in the form of a ceiling system 600. Except for purposes of clarity, reference numbers used to describe features in the systems 100, 200, 300, 400, 500 will be used to describe identical/similar features in the system 600. In FIGS. 27-30, not all brackets 154 and cables (or threaded rods) 156 are shown for reasons of clarity. The system 600 has many similar, if not identical, features as described above in reference to the system 100, except that the system 600 describes baffles 608 having bottom sides 611 where a surface of each bottom side 611 includes one or more curved surfaces. Each baffle 608 may have its own unique curved surface(s) on its bottom side 611, all the baffles 608 may have identical curved surface(s) on the bottom side 611, or one or more of the baffles 608 may have identical curved surface(s) on the bottom side 611 but the remaining baffles 608 have different curved surface(s) on the bottom side 611.

As shown in FIGS. 31-34 for purposes of illustration, another embodiment of the present invention resides in an architectural fixture assembly in the form of a ceiling system 700. Except for purposes of clarity, reference numbers used to describe features in the systems 100, 200, 300, 400, 500, 600 will be used to describe identical/similar features in the system 700. In FIGS. 31-34, not all brackets 154 and cables (or threaded rods) 156 are shown for reasons of clarity. The system 700 has many similar, if not identical, features as described above in reference to the system 100, except that the system 700 describes a generally trapezoidal array (when seen from above or below) including two generally co-planar support beam 102/cover 116 pairs of identical/similar longitudinal lengths oriented at identical intersecting angles towards each other, and four parallel, spaced-apart baffles 708 (with two brackets 154 and two cables 156 per support beam 102) where the baffles 708 are arranged laterally across the support beam 102/cover 116 pairs parallel to each other and at the same angles relative to the support beam 102/cover 116 pairs.

Each baffle 708 includes a top side 710 and a plurality of alignment notches 712. Each alignment notch 712 extends from the top side 710 downwards. In this embodiment, the two support beams 102/cover 116 pairs are in the same horizontal plane, but oriented at an angle relative to each other. That is, the support beam 102/cover 116 pairs are non-parallel to each other. Furthermore, in this embodiment the support beam 102/cover 116 pairs are non-intersecting. As such, the baffles 708 may have differing lengths than one another owing to the fact that the distance between the support beam 102/cover 116 pairs decrease moving from one end to the other. Thus, the baffles 708 may have a decreasing length as compared to one another as the two support beams 102/cover 116 pairs angle towards each other.

Figure 31:
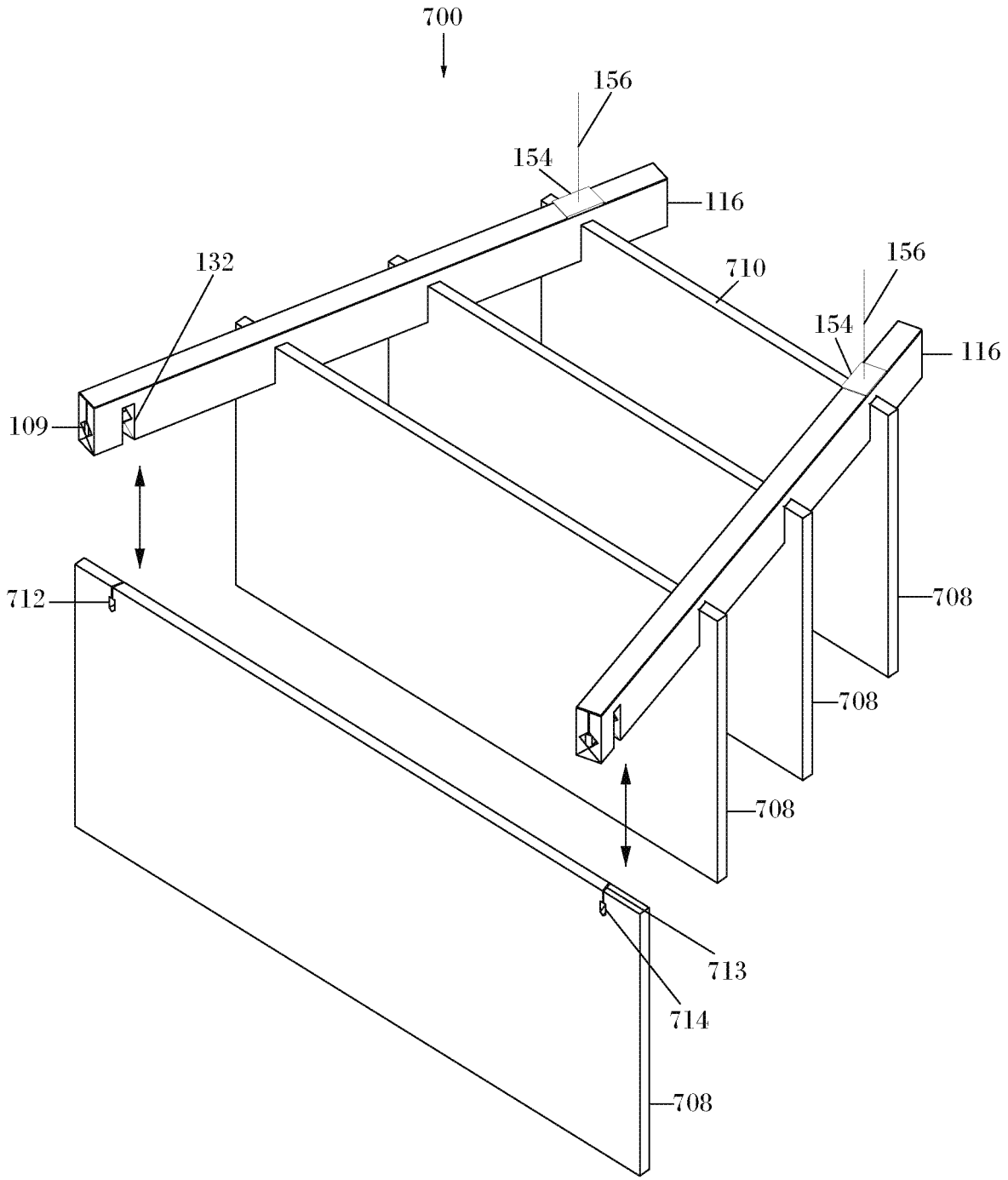
FIG. 31 illustrates a top, front, right perspective view of a ceiling system in accordance with a further embodiment of the invention, similar to the embodiments seen in FIGS. 9, 15, 19, 23, and 27, but with alignment notches of the baffles and covers configured such that the pair of support beams are at an angle relative to each other, and with a double-ended arrow indicating directions of movement for the baffles to engage with/disengage from the support beams/covers (three of the baffles shown in engagement with the support beams/covers and the fourth baffle shown disengaged from the support beams/covers)
Figure 32:
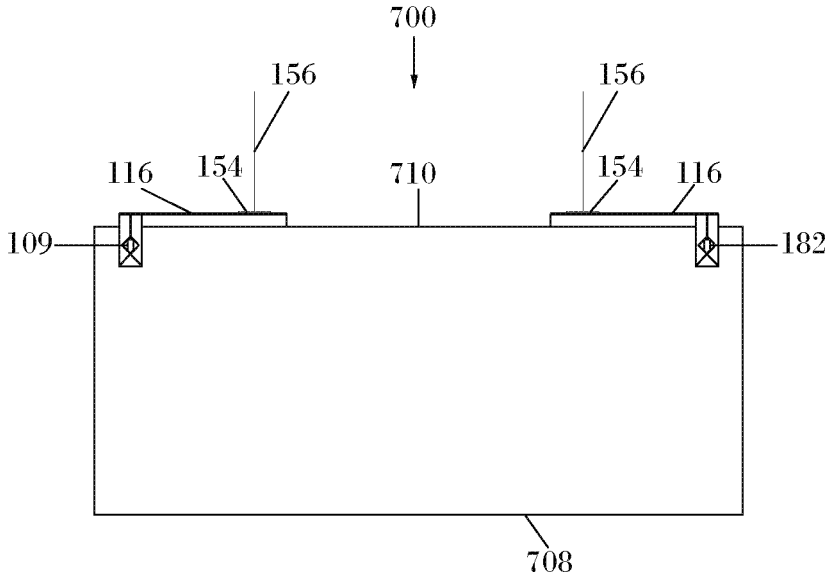
FIG. 32 illustrates a front elevation view of the ceiling system of FIG. 31.
Figure 33:
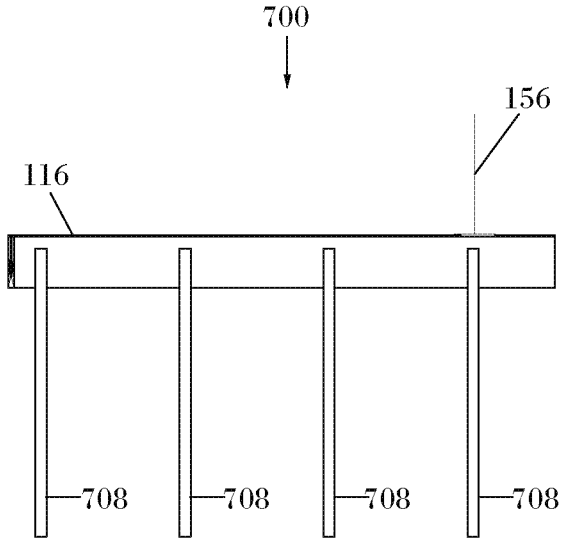
FIG. 33 illustrates a left side elevation view of the ceiling system of FIG. 31.
Figure 34:
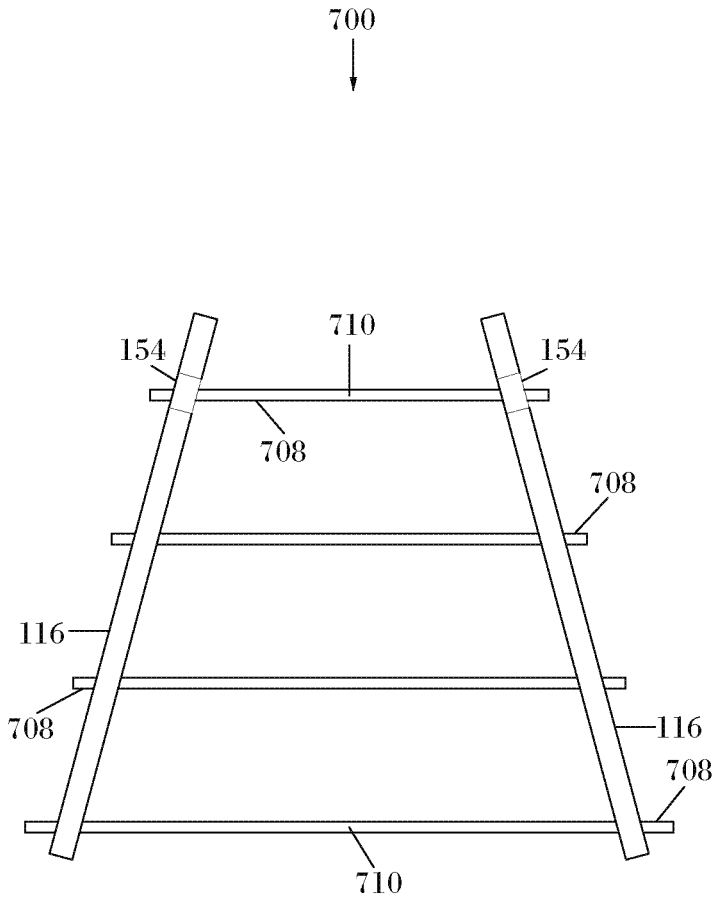
FIG. 34 illustrates a top plan view of the ceiling system of FIG. 31.

As seen in FIGS. 31-34, the particular embodiment of the system 700 illustrated therein includes four baffles 708 with two alignment notches 712 on each baffle 708. As seen in FIG. 31, there are four baffles 708 of otherwise identical dimensions (e.g., height, thickness) except for length. The number of alignment notches 712 on each baffle 708 matches the number of support beams 102. Each alignment notch 712 of each one of the baffles 708 is configured to engage a different support beam 102 than engaged by other alignment notch(es) 712 of that particular baffle 708. As seen in FIG. 31, each alignment notch 712 is configured to engage a particular one of the two support beams 102. In the alternative, the number and placement of alignment notches 712 on a particular baffle can vary from baffle to baffle as desired by a user.

Each alignment notch 712 of each one of the plurality of baffles 708 includes a slit portion 713, and a receptacle portion 714, where each receptacle portion 714 is configured to engage the vertical web portion 106 of no more than one of the support beams 102. The slit portion 713 extends from the top side 710 of the baffle 708 downwards to the receptacle portion 714. The walls of each alignment notch 132 are angled to match the angle of the support beam 102/cover 116 pairs relative to the baffles 708 extending laterally between the two support beams 102 such that the alignment notches 712 of the baffle 708 engage the alignment notches 132 of the covers 116. The receptacle portion 714 of an alignment notch 712 engages the vertical web portion 106 of one of the support beams 102. The alignment notches 712 may be formed in the baffles 708 by conventional methods. The relative angle of each support beam 102/cover 116 pair is such that imaginary lines extending linearly from each support beam 102/cover 116 pair intersect at a common point, from which an imaginary line extending therefrom would run through the middle point of each baffle 708. Alternatively, the relative angle of each support beam 102/cover 116 pair could be such that imaginary lines extending linearly therefrom would intersect at a common point but an imaginary line extending therefrom would not run through the middle point of each baffle 708.

Each cover 116 has four alignment notches 132 to engage a particular one of the baffles 708. However, as desired by a user, the alignment notches 132 of each cover 116 are spaced unevenly apart from one another along the longitudinal length of each of the covers 116 such that each the baffles 708 are spaced unevenly apart along the longitudinal length of each of the covers 116. Each alignment notch 132 on each of the covers 116 is configured to be sized and shaped for the desired angle of baffle engagement with the cover 116 relative to perpendicular.

As shown in FIGS. 35-38 for purposes of illustration, another embodiment of the present invention resides in a ceiling system 800. Except for purposes of clarity, reference numbers used to describe features in the systems 100, 200, 300, 400, 500, 600, 700 will be used to describe identical/similar features in the system 800. In FIGS. 35-38, not all brackets 154 and cables (or threaded rods) 156 are shown for reasons of clarity. The system 800 has many similar, if not identical, features as described above in reference to the system 100, except that the system 800 includes only a single support beam 102/cover 116 pair, and four parallel, spaced-apart baffles 108 (with two brackets 154 and two cables 156 per support beam 102) where the baffles 108 are arranged perpendicular to the support beam 102/cover 116 pair.

Each baffle 108 includes a single baffle slot 112 disposed at a midpoint on the top surface 110 of the baffle 108. However, in other embodiments the baffle slot 112 may be located offset from the midpoint. The baffle slot 112 on each baffle 108 extends from the top surface 110 downwards. As seen in FIGS. 35-38, the particular embodiment of the system 800 illustrated therein includes four baffles 108 having identical dimensions (e.g., height, thickness) except for length. The number of baffle slots 112 on each baffle 108 matches the number of support beams 102. In the alternative, the placement of the baffle slot 112 on a particular baffle 108 can vary from baffle to baffle as desired by a user in order to make the baffles 108 appear off-set. In another alternative, the support beam 102 can be at an angle to a horizontal plane, with baffles 108 that are all generally vertical and/or with one or more baffles that are also at an angle to the horizontal plane. In the alternative of a support beam 102 angled relative to the horizontal plane, one or more of the baffles 108 can be parallel to each other, one or more of the baffles 108 can be at an angle other than perpendicular to the support beam 102, or any permutation and/or combination of the foregoing.

FIGS. 39A-39J were described previously, and these figures illustrate different structural embodiments for the support beam 102*a-j* that may be utilized in accordance with the invention described herein. Furthermore, it should be appreciated that the support beams 102*a-j* are merely exemplary and are not intended to be limiting of the invention. As such, other support beams having other structures and/or configurations may be utilized in accordance with the disclosure set forth herein in other embodiments.

As shown in FIGS. 40-43 for purposes of illustration, another embodiment of the present invention resides in an architectural fixture assembly in the form of a ceiling system 900. The ceiling system 900 includes a pair of support beams 902. Each support beam 902 includes a top engagement portion 904 and a bottom engagement portion 906. In the alternative, a cover (similar to the ones described above) may be used in conjunction with each of the support beams 902. In one particular embodiment, the support beam 902 may be a generally hourglass-shaped or X-shaped support beam 902. As seen in FIGS. 39A-J and discussed above, the support beam 902 may have a variety of cross-sectional shapes adapted to include top and bottom engagement portions 904, 906. The support beam 902 can be any length desired by a user, with various dimensions and proportions of the support beam 902 also being as desired by a user. The support beam 902 can be made from various materials including, without limitation, metal (e.g., steel, steel alloy, aluminum, etc.), wood, plastic, etc. In the embodiment seen in FIGS. 40-43, there are two generally parallel, co-planar support beams 902 of identical dimensions (e.g., height, length, thickness, etc.).

The ceiling system 900 further includes a plurality of baffles 908. Each baffle 908 includes a top side 910 and a plurality of alignment notches 912. Each alignment notch 912 extends from the top side 910 downwards. As seen in FIGS. 40-43, the particular embodiment of the baffle 908 illustrated therein includes four generally parallel baffles 908 with two alignment notches 912 on each baffle 908. The four baffles 908 are of identical dimensions (e.g., height, length, and thickness). In the alternative, a user may vary the dimensions (e.g., height, length, and thicknesses) of each baffle 908 in the system 900 as desired such that all the baffles have different dimensions (e.g., one or more have different height, length, and/or thickness), each baffle has unique dimensions, at least two baffles have identical dimensions but the remaining baffles have different dimensions, etc. In the alternative, at least two baffles 908 may be generally disposed at an angle relative to each other. In another alternative, at least one baffle 908 is a curved baffle. In yet another alternative, the support beams 902 are arranged at an angle relative to each other. In a further alternative, at least two baffles 908 are angled relative to a generally horizontal plane defined by the ceiling system 900. In still another alternative, the baffle(s) 908 includes a curved bottom side.

The number of alignment notches 912 on each baffle 908 may match the number of support beams 902, although this is not required in all embodiments. Each alignment notch 912 of each one of the baffles 908 is configured to engage a different support beam 902 than engaged by other alignment notch(es) 912 of that particular baffle 908. Each alignment notch 912 is configured to engage a particular one of the two support beams 902. In the alternative, the number and placement of alignment notches 912 on a particular baffle can vary from baffle to baffle as desired by a user. Each alignment notch 912 of each one of the plurality of baffles 908 is configured to engage the bottom engagement portion 906 of no more than one of the support beams 902. The alignment notches 912 may be formed in the baffles 108 by conventional methods. The alignment notches 912 are sized/shaped and configured to engage the bottom engagement portion 906 of the support beam(s) 902. The baffles 908 may be engaged to the support beams 902 using various methods. For example, the alignment notches 912 can engage the support beams 902 with a simple upward engagement/downward disengagement. In the alternative, the alignment notches 912 on the baffles 908 can be aligned with the edges of the support beams 902 and then slid onto the support beams 902 with the bottom engagement portion 906 passing through the alignment notch 912.

Figure 40:
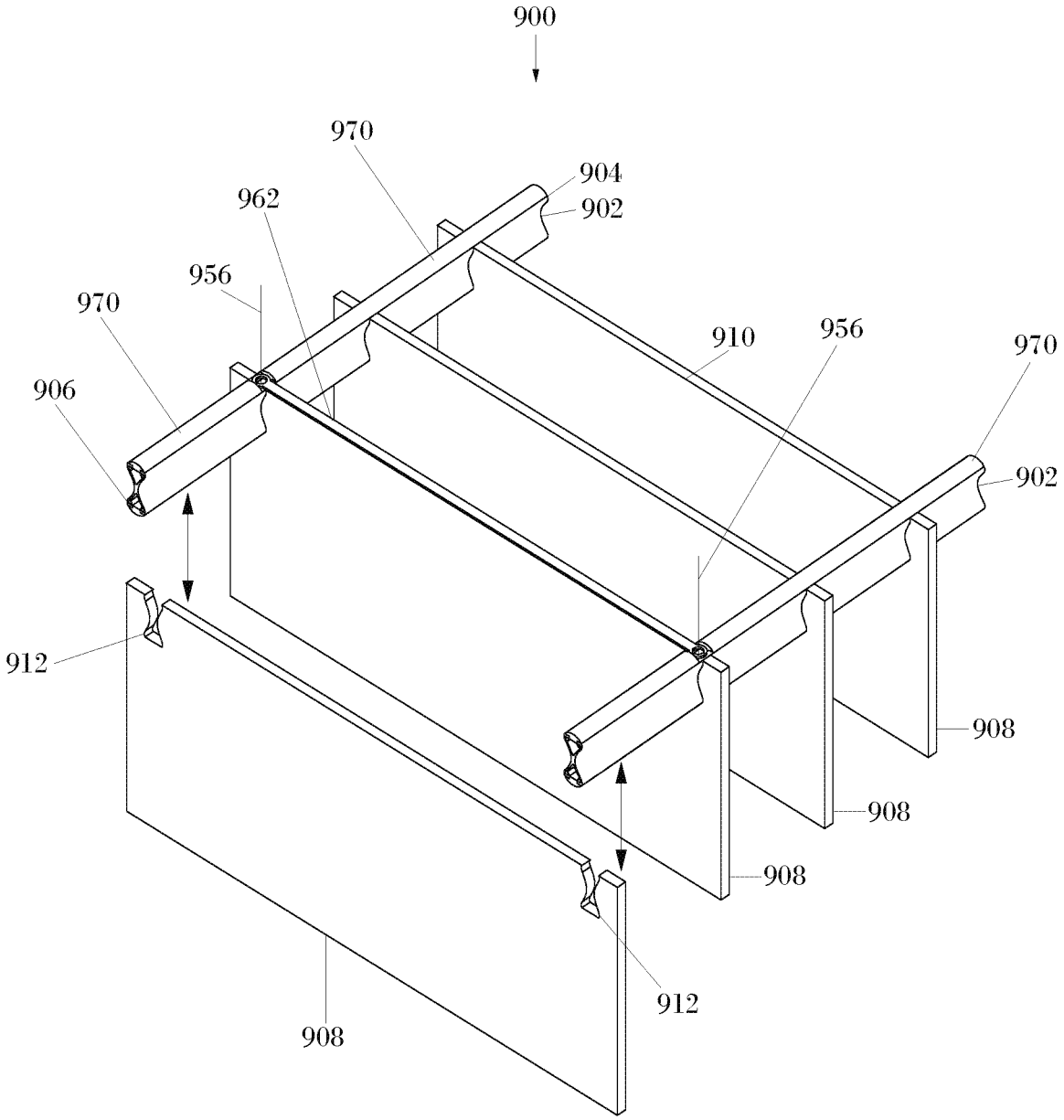
FIG. 40 illustrates a top, front, right, perspective view of a ceiling system in accordance with another embodiment of the invention, with two generally hour-glass cross-sectional shaped support beams in respective engagement with four baffles, and with a double-ended arrow indicating directions of movement for the baffles to engage with/disengage from the support beams (three of the baffles shown in engagement with the support beams and the fourth baffle shown disengaged from the support beams)
Figure 41:
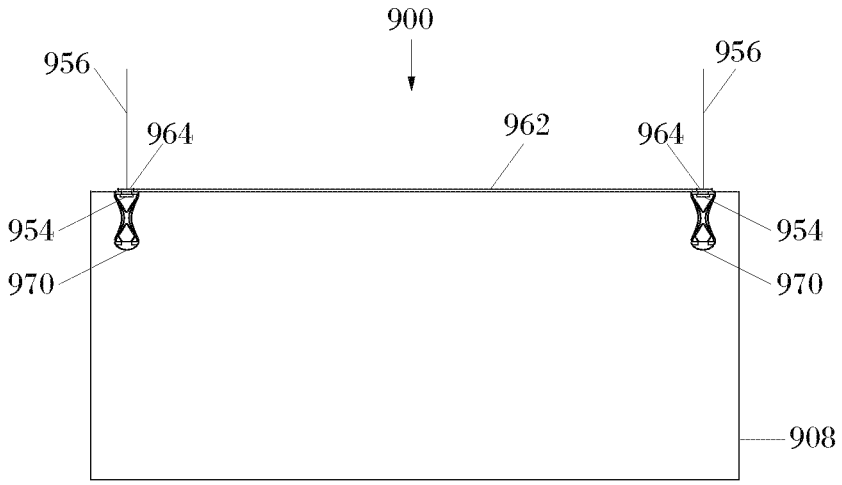
FIG. 41 illustrates a front elevation view of the ceiling system of FIG. 40 (a rear elevation view of the ceiling system being substantially identical to the front elevation view)
Figure 42:
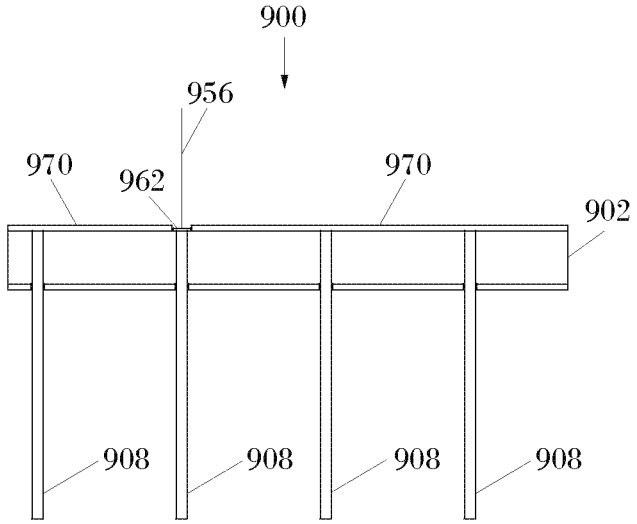
FIG. 42 illustrates a left side elevation view of the ceiling system of FIG. 40 (a right side elevation view of the ceiling system being substantially identical to the front elevation view)
Figure 43:
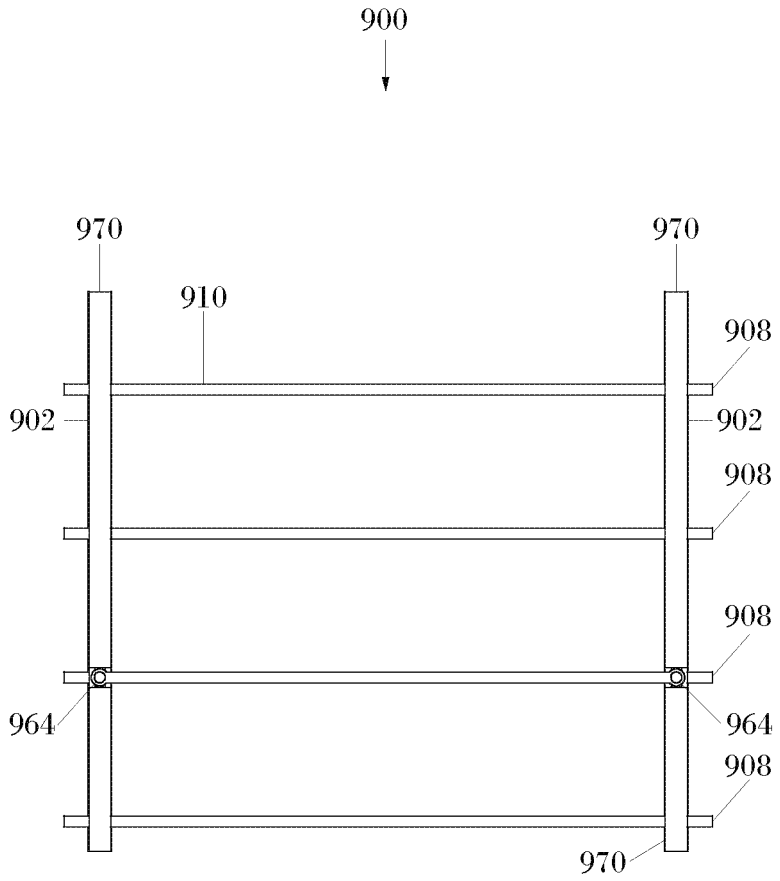
FIG. 43 illustrates a top plan view of the ceiling system of FIG. 40.

As seen in FIGS. 40-42, one or more brackets 954 (not shown for clarity) may engage each of the support beams 902. Each bracket 954 is attached to a threaded rod or cable 956 (same/similar to the threaded rod or cable 156 discussed above). In FIGS. 40-43, not all brackets 954 and cables (or threaded rods) 956 are shown for reasons of clarity. Each bracket 954 is configured to be disposed within an interior portion of the top engagement portion 904 with a slot 960 disposed on the upper part of the top engagement portion 904 allowing the bracket 954 to engage a particular threaded rod or cable 956.

In this embodiment, a stabilizer bar or spacing bar 962 extends between the two support beams 902 and therefore sets the spacing between the support beams 902, and spaces apart the support beams 902 from one another by the same distance as the distance between the alignment notch 912 of the baffles 908 (i.e., the distance between the alignment notch 912 on the left side of the baffle 908 and the alignment notch 912 on the right side of the baffle 908). The spacing bar 962 may also keep each bracket/cable pair on each support beam 902 aligned with an aligned counterpart bracket/cable pair on the other support beam 902. The spacing bar 962 may include two eyelets 964, with each eyelet 964 disposed on an opposite end of the spacing bar 962 from the other eyelet 964. The cable 956 may extend through the eyelet 964.

In this manner, when each particular bracket 954 engages a particular support beam 902, at least one portion of that bracket 954 engages the top side of the interior portion of top engagement portion 904 of that particular support beam 902. In the alternative, a bracket 954 may be attached to a support beam 902 by various fasteners including, without limitation, mechanical fasteners, chemical fasteners (e.g., adhesives), or the like. The cable 956 (e.g., aircraft cable or wire ropes, etc.) is configured to engage a bracket (e.g., generally one cable 956 per bracket 954, but more than one cable 956 may be used in connection with a single bracket 954 as desired by a user) in order to hang the assembly 900 (e.g., from a ceiling or other higher location).

The bracket 954 may be made from various materials including, without limitation, metal (e.g., steel or an alloy thereof, aluminum, and the like), plastic, or the like. The number of brackets 954 engaging any particular support beam 902, as well as the spacing of the brackets long that support beam 902, may vary as desired by a user. The ceiling system 900 seen in FIG. 40 is configured as a generally quadrilateral array (when seen from above or below) with two spaced-apart paired support beams 902 arranged generally perpendicular to four generally even spaced-apart baffles 908. Each of the baffles 908 may be made using a sheet of one or more sound-absorbing/barrier (acoustical) materials including, but not limited to, fabric-covered synthetic polymer foam, fabric-covered glass wool composite material, or the like. Alternatively, each of the baffles 908 may be made from other sound-absorbing materials including, but not limited to, synthetic foam or nonwoven polymer (without fabric), or synthetic foam or nonwoven polymer covered by a perforated metallic sheet, wood, wool or the like. In the alternative, each of the baffles 908 may also be formed from a metallic sheet, a polymeric sheet, or the like.

The ceiling system 900 may comprise a number of spacer caps or closure caps 970. The closure caps 970 may be arranged in sections along the top and bottom of the profiles beams 902 (closure caps 970 are not shown on the top of the support beams 902 in FIG. 41 for reasons of clarity). The closure caps 970 are arranged in sections in order to configure a regularly spaced hole array along the upper and lower lengths of the support beams 902. For example, lengths of individual closure caps 970 along the length of the top of each support beam 902 are configured to accommodate the brackets 954/cables 956 that protrude upwardly from engagement with the support beam 902. In one embodiment, placement of the closure caps 970 can be used to set the location of the brackets 954/cables 956 along the top of the support beam 902 with a longer closure cap 970 (e.g., about two feet long) placed between two bracket 954/cable 956 locations on the top of the support beam 902, with shorter cover caps 970 placed on the top of the support beam 902 between one of the two bracket 954/cable 956 locations and the end of the support beam 902 closest to that bracket 954/cable 956 location.

The closure cap 970 can be made from various materials including, but not limited to, a resilient/compressible plastic or a roll-formed spring steel. On the upper side of the support beam 902, the closure caps 970 engage the slot 960 disposed on the upper part of the top engagement portion 904. On the lower side of the support beam 902, the closure caps 970 engage the slot 961 disposed on the lower part of the bottom engagement portion 906. Likewise, individual closure caps 970 can engage the lower portion of the support beam 902 to define specific spaces between baffles 908 (and between a particular end of the support beam 902 and the particular baffle 908 closest to that end) for case and accuracy of installation. The entire lower side of a support beam 902 can be generally covered by a single closure cap 970 if there are no brackets, cables, lights, or other objects engaging the lower side of that support beam 902. The closure caps 970 can be held in the slots 960, 961 by friction. In the alternative, a single closure cap 970 (with apertures along the length of the cap 970 for the brackets 954/cables 956 to access the slot 960 on the top side of the support beam 902) can be used on each support beam 902. Likewise, a single closure cap 970 (with apertures along the length of the cap 970 to provide access the slot 961 on the bottom side of the support beam 902) can be used on each support beam 902.

Figure 44:
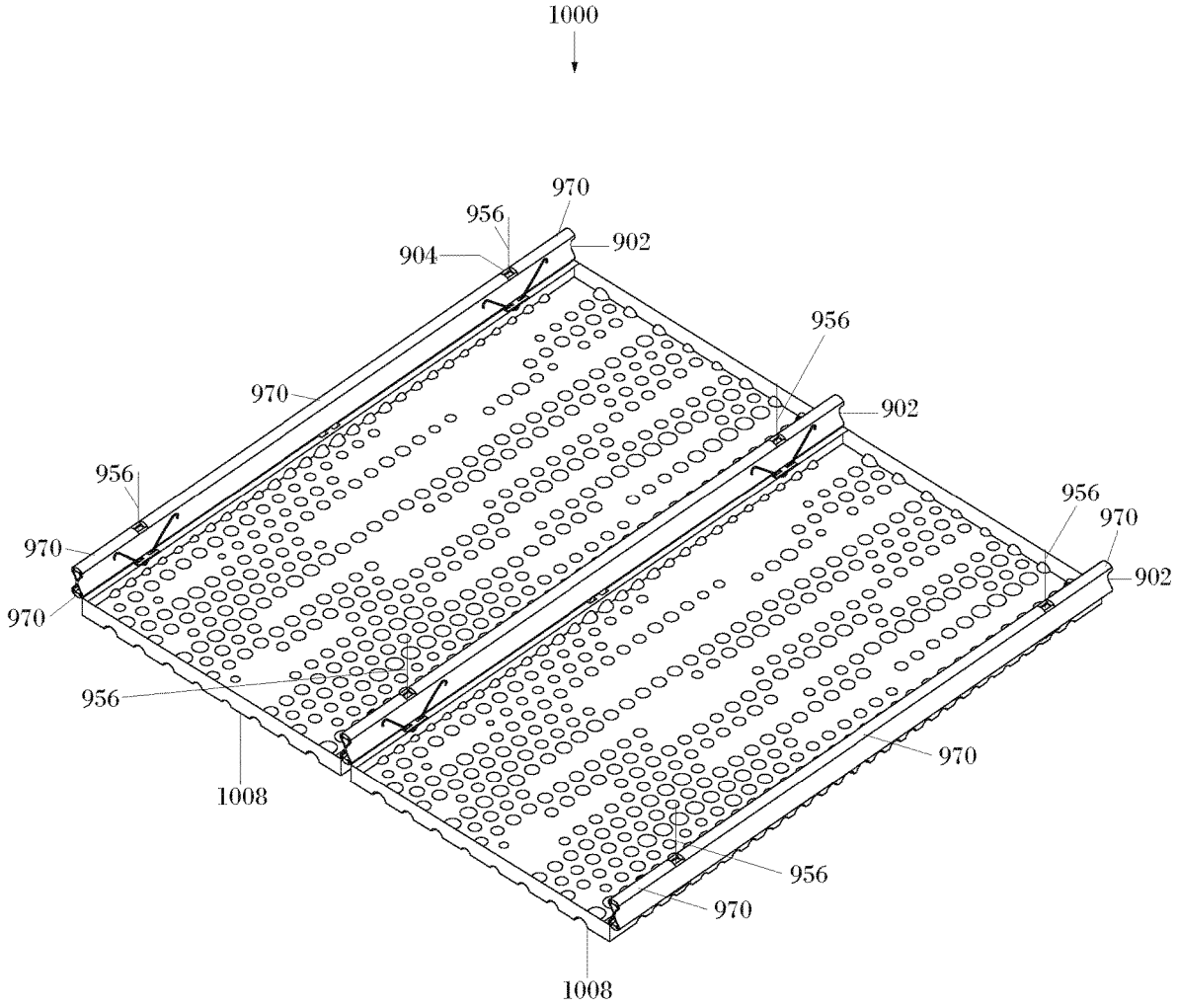
FIG. 44 illustrates a top, front, right, perspective view of a ceiling system in accordance with another embodiment of the invention, with three generally hour-glass cross-sectional shaped support beams in respective engagement with two architectural ceiling panels.
Figure 45A:
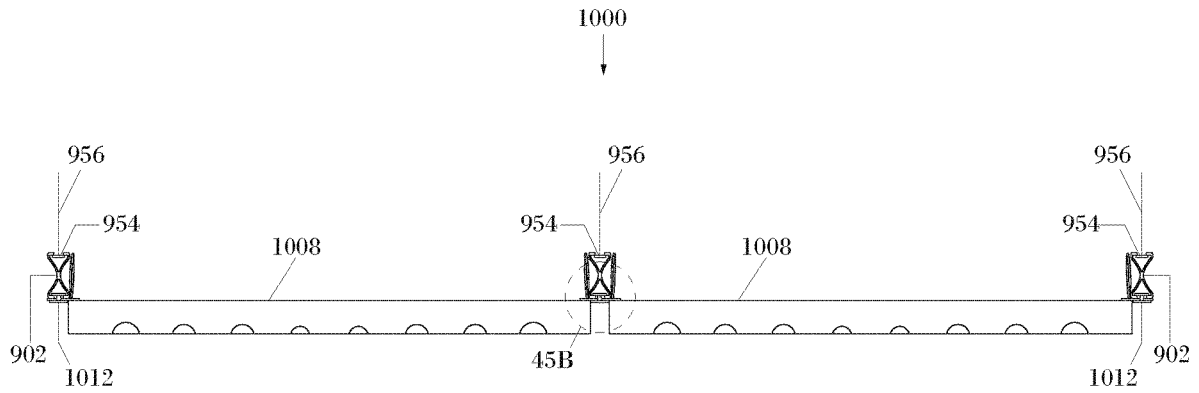
FIG. 45A illustrates a front elevation view of the ceiling system of FIG. 40.
Figure 45B:
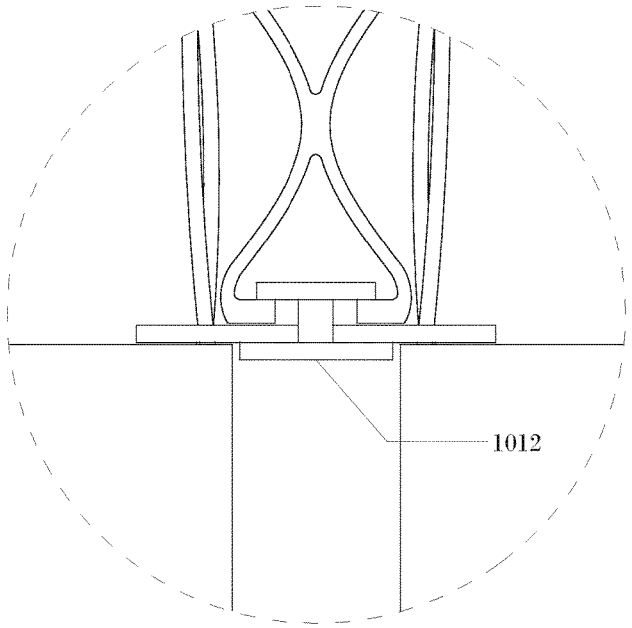
FIG. 45B is a close-up view taken along broken circular line 45B of FIG. 45A.

As shown in FIGS. 44-45B for purposes of illustration, another embodiment of the present invention resides in an architectural fixture assembly in the form of a ceiling system 1000. The ceiling system 1000 further includes a plurality of support beams 902 and a plurality of architectural panels or fixtures 1008. The ceiling system 1000 includes three support beams 902. In the embodiment seen in FIGS. 44-45B, there are two generally parallel, co-planar support beams 902 of identical dimensions (e.g., height, length, thickness, etc.).

The architectural panels or fixtures 1008 are generally horizontal panels. The architectural panels or fixtures 1008 may have unadorned, smooth surfaces or have surfaces with decorative patterns. Examples of architectural fixtures 1008 include, but are not limited to, architectural panels disclosed in U.S. Pat. Nos. D802,173, D794,224, D784,563, D784,564, D847,383, D846,160, D843,020, D849,276, D791,981, D792,986, D781,464, D802,174, D794,222, D849,969, D849,275, D859,696, and D848,035, the contents of the foregoing patents being incorporated by reference herein in their entirety).

Each architectural fixture 1008 may engage the bottom side of the support beam 902 through a number of brackets or supporting mechanisms 1012 which each engage and hold at least one architectural fixture 1008 (either alone or in combination with other brackets or supporting mechanisms 1012) to a particular support beam 902. Brackets and cables 956 are engaged to the support beams 902 in the manner described above. Closure caps 970 are arranged in sections along the top and bottom of the profiles beams 902 (closure caps 970 are not shown on the top and bottom of the support beams 902 in FIG. 45A-45B for reasons of clarity). In the alternative, one or more stabilizer bars 962 may also be used.

As seen in FIGS. 44-45B, a first architectural fixture 1008 (e.g., a generally horizontal panel) is disposed between first and second support beams 902 with a second architectural fixture 1008 (e.g., a generally horizontal panel) disposed between the second and third support beams 902. The first and second architectural fixtures 1008 are generally co-planar and aligned with respect to each other. The bracket or supporting mechanism 1012 includes an engagement portion and at least one lateral flange. The at least one lateral flange is configured to engage at least one architectural fixture 1008. A bracket or supporting mechanisms 1012 disposed between two architectural fixtures (as seen in FIG. 45B) includes two lateral flanges, with each lateral flange extending away from a central portion of the bracket or supporting mechanism 1012 in opposite directions to engage the architectural fixture 1008 associated with that particular lateral flange. A bracket or supporting mechanisms 1012 disposed along a side of a single architectural fixture (as seen in FIG. 45A on the left and right sides of the system 1000) includes a single lateral flange, with the lateral flange extending away from a central portion of the bracket or supporting mechanism 1012 to engage the architectural fixture 1008 associated with that particular lateral flange. Each bracket or supporting mechanism 1108 engages the bottom engagement portion 906 of the support beam 902. In this manner, when each bracket or supporting mechanism 1012 engages a particular support beam 902, an engagement portion of that bracket or supporting mechanisms 1012 engages a bottom side of the interior portion of the bottom engagement portion 906 of that particular support beam 902. The slot 961 disposed on the lower part of the bottom engagement portion 906 allows the engagement portion of that bracket or supporting mechanism 1012 access to the interior portion of the support beam 902. The architectural fixtures 1008 are engaged to the lateral flange(s) of the supporting mechanism 1012 using various means including, without limitation, mechanical fasteners (e.g., screws, washers, nuts, bolts, etc.), welding, chemical fasteners, or a combination of the foregoing.

Figure 46:
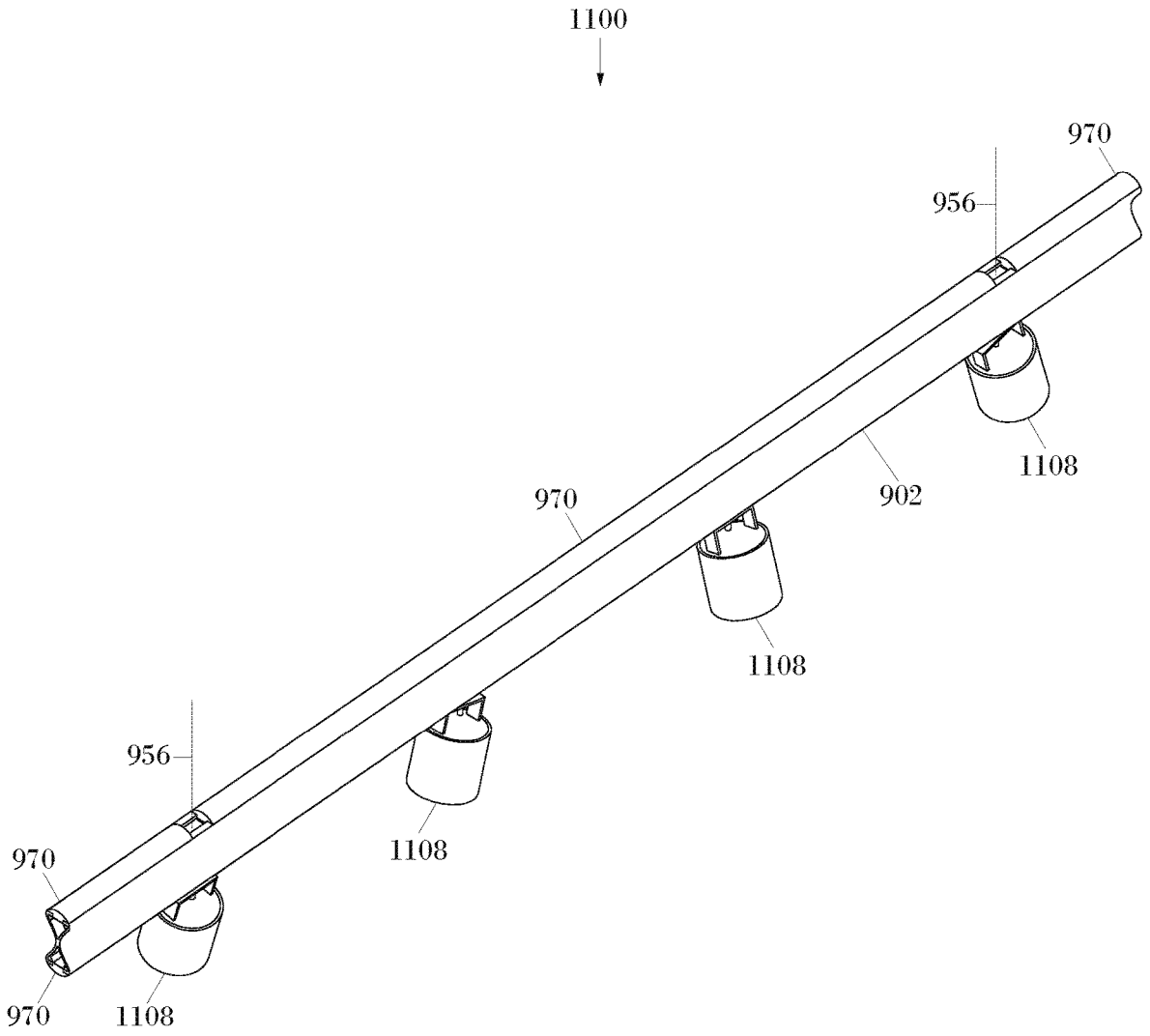
FIG. 46 illustrates a top, front, right, perspective view of a ceiling system in accordance with a further embodiment of the invention, with a generally hour-glass cross-sectional shaped support beam engaging a number of individual light fixtures.
Figure 47:
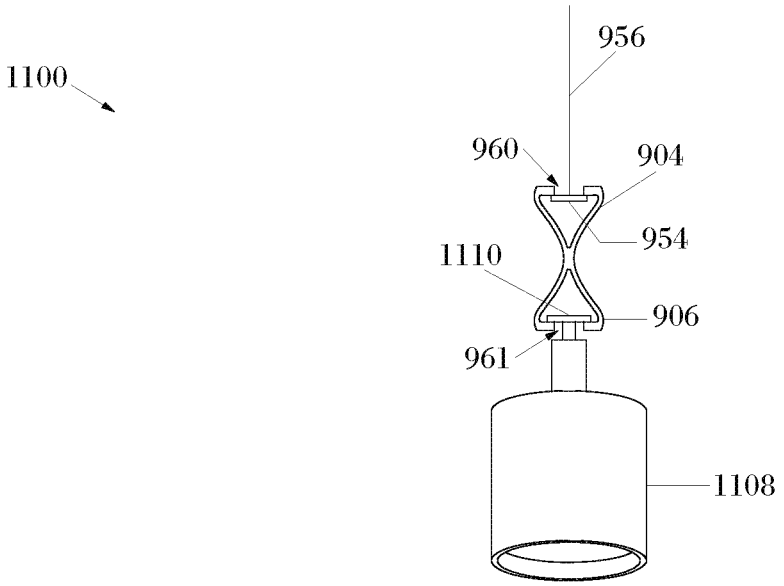
FIG. 47 illustrates a front elevation view of the ceiling system of FIG. 46 (with only a single light fixture shown for clarity)

As shown in FIGS. 46-47 for purposes of illustration, another embodiment of the present invention resides in an architectural fixture assembly in the form of a ceiling system 1100. The ceiling system 1000 includes a support beam 902 and a plurality of light fixtures 1108. In the embodiment seen in FIGS. 46-47, there is a single support beam 902 and four light fixtures 1108 disposed along a length of the support beam 902. In the alternative, there can be a number of generally parallel, co-planar support beams 902 of identical dimensions (e.g., height, length, thickness, etc.), each with at least one light fixture 1108 engaged therewith.

As seen in FIGS. 46-47, one or more brackets 954 may engage each of the support beams 902, such as described above in connection with FIGS. 40-43. Each bracket 954 is attached to a cable 956. In FIGS. 46-47, not all brackets 954 and cables 956 are shown for reasons of clarity. Closure caps 970 are arranged in sections along the top and bottom of the profiles beams 902 (closure caps 970 are not shown on the top or bottom of the support beam 902 in FIG. 47 for reasons of clarity). As described above, each bracket 954 is configured to be disposed within the interior portion of the top engagement portion 904 with a slot 960 disposed on the upper part of the top engagement portion 904 allowing the bracket 954 to engage a particular cable 956.

When the system 1100 include multiple support beams 902 (e.g., two parallel support beams 902), a stabilizer bar 962 may be disposed between the two adjacent support beams 902 to keep each bracket/cable pair on each support beam 902 aligned with an aligned counterpart bracket/cable pair on the other support beam 902. In this manner, when each particular bracket 954 engages a particular support beam 902, at least one portion of that bracket 954 engages the top side of the interior portion of top engagement portion 904 of that particular support beam 902. In the alternative, a bracket 954 may be attached to a support beam 902 by various fasteners including, without limitation, mechanical fasteners, chemical fasteners (e.g., adhesives), or the like. The cable 956 (e.g., aircraft cable or wire ropes, etc.) is configured to engage a bracket 954 (e.g., generally one cable 956 per bracket 954, but more than one cable 956 may be used in connection with a single bracket 954 as desired by a user) in order to hang the assembly 900 (e.g., from a ceiling or other higher location). The bracket may be made from various materials including, without limitation, metal (e.g., steel or an alloy thereof, aluminum, and the like), plastic, or the like. The number of brackets 954 engaging any particular support beam 902, as well as the spacing of the brackets 954 along that support beam 902, may vary as desired by a user.

Each light fixture 1108 engages the bottom engagement portion 906 of the support beam 902. In this manner, when each particular light fixture 1108 engages a particular support beam 902, an engagement portion 1110 of that light fixture 1108 engages a bottom side of the interior portion of the bottom engagement portion 906 of that particular support beam 902. The slot 961 disposed on the lower part of the bottom engagement portion 906 allows the engagement portion 1110 access to the interior portion of the support beam 902.

As set forth above, the closure caps 970 are arranged in sections in order to configure a regularly spaced hole arrays along the upper and lower lengths of the support beams 902. Closure caps 970 are arranged in sections along the top and bottom of the profiles beams 902 (closure caps 970 are not shown on the top or bottom of the support beam 902 in FIG. 47 for reasons of clarity). Placement of the closure caps 970 can be used to set the location of the brackets 954/cables 956 along the top of the support beam 902 (and between a particular end of the support beam 902 and the particular bracket 954/cable 956 closest to that end). Likewise, individual closure caps 970 can engage the lower portion of the support beam 902 to define specific spaces between light fixtures 1108 (and between a particular end of the support beam 902 and the particular light fixture 1108 closest to that end) for case and accuracy of installation.

Figure 48:
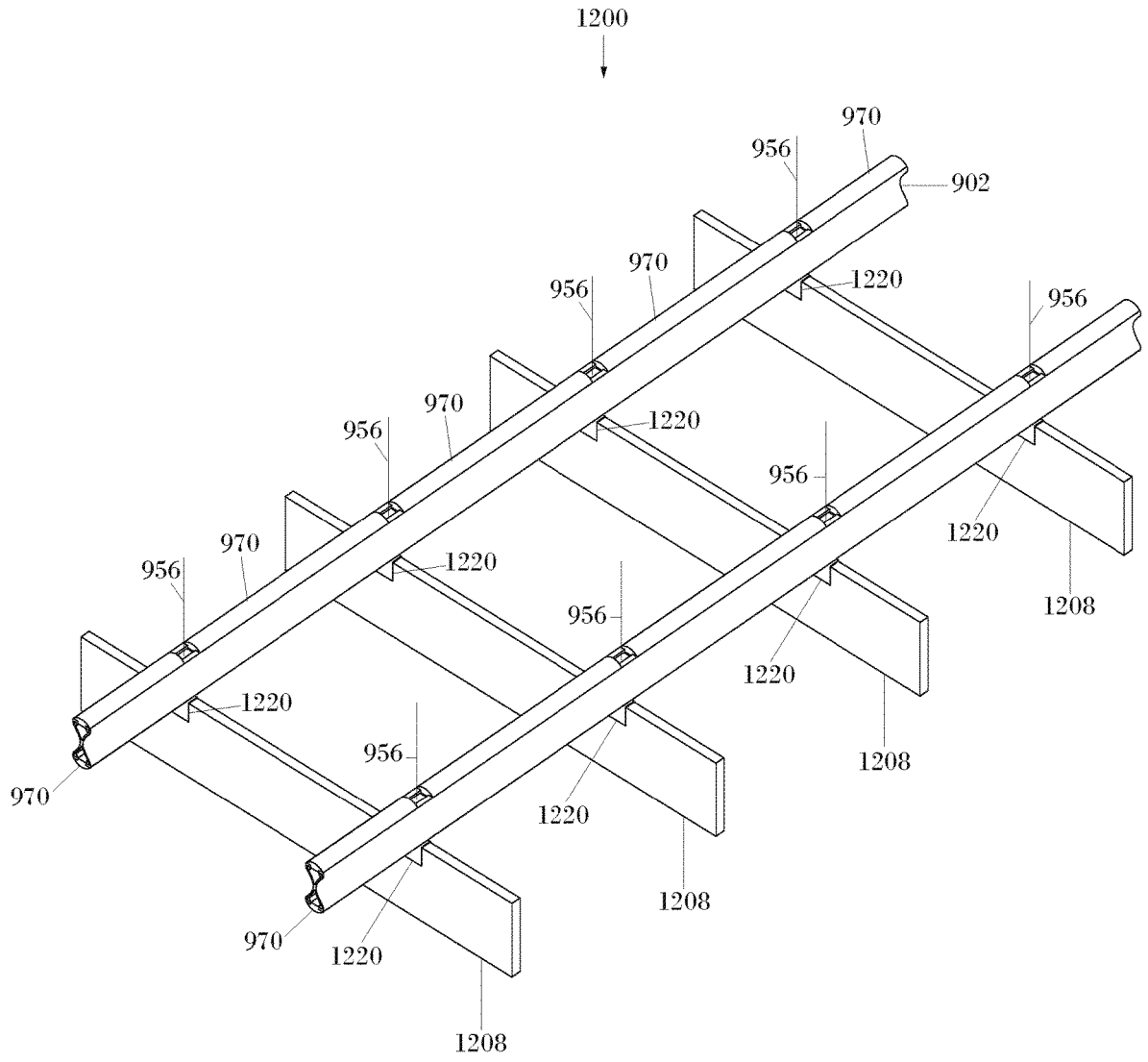
FIG. 48 illustrates a top, front, right, perspective view of a ceiling system in accordance with a further embodiment of the invention, with a pair of generally hour-glass cross-sectional shaped support beams indirectly engaging a number of baffles.
Figure 49:
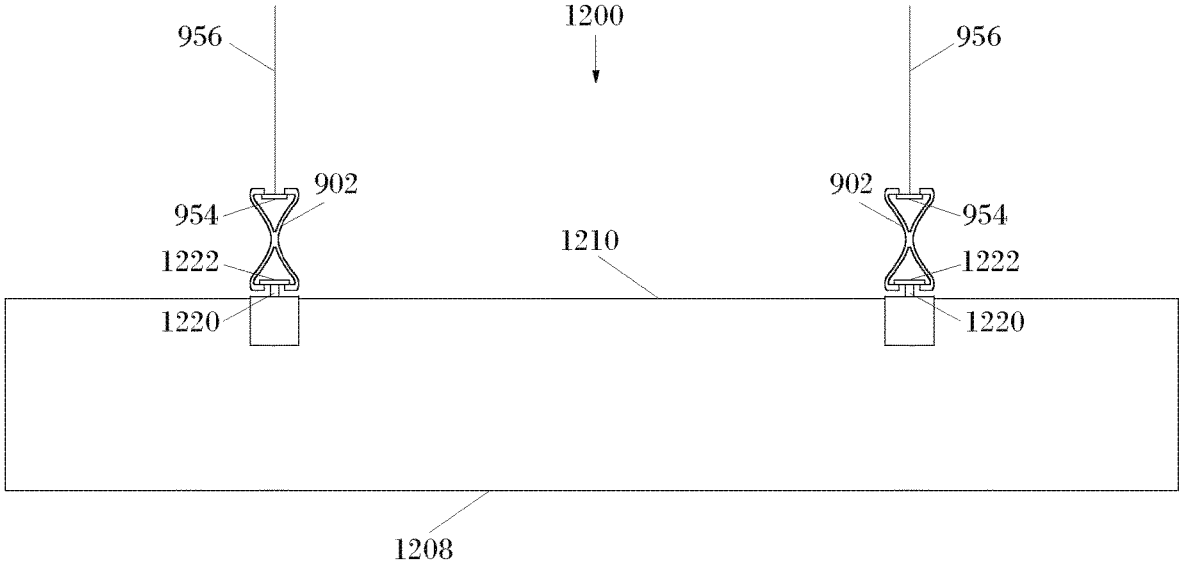
FIG. 49 illustrates a front elevation view of the ceiling system of FIG. 48.

As shown in FIGS. 48-49 for purposes of illustration, another embodiment of the present invention resides in an architectural fixture assembly in the form of a ceiling system 1200. The ceiling system 1200 includes a support beam 902 and a plurality of baffles 1208. In the embodiment seen in FIGS. 48-49, there are a pair of support beams 902, and four baffles 1208 engaging the support beams 902. The support beams 902 are generally parallel, co-planar support beams 902 of identical dimensions (e.g., height, length, thickness, etc.).

As seen in FIGS. 48-49, one or more brackets 954 may engage each of the support beams 902, such as described above in connection with FIGS. 40-43 and FIGS. 46-47. Each bracket 954 is attached to a cable 956. In FIGS. 48-49, not all brackets 954 and cables 956 are shown for reasons of clarity. Closure caps 970 are arranged in sections along the top and bottom of the profiles beams 902 (closure caps 970 are not shown on the top or bottom of the support beam 902 in FIG. 49 for reasons of clarity). As described above, each bracket 954 is configured to be disposed within the interior portion of the top engagement portion 904 with a slot 960 disposed on the upper part of the top engagement portion 904 allowing the bracket 954 to engage a particular cable 956. In the alternative, a stabilizer bar 962 may be disposed between the two adjacent support beams 902 to keep each bracket/cable pair on each support beam 902 aligned with an aligned counterpart bracket/cable pair on the other support beam 902. In this manner, when each particular bracket 954 engages a particular support beam 902, at least one portion of that bracket 954 engages the top side of the interior portion of top engagement portion 904 of that particular support beam 902. In the alternative, a bracket 954 may be attached to a support beam 902 by various fasteners including, without limitation, mechanical fasteners, chemical fasteners (e.g., adhesives), or the like. The cable 956 (e.g., aircraft cable or wire ropes, etc.) is configured to engage a bracket 954 (e.g., generally one cable 956 per bracket 954, but more than one cable 956 may be used in connection with a single bracket 954 as desired by a user) in order to hang the assembly 900 (e.g., from a ceiling or other higher location). The bracket may be made from various materials including, without limitation, metal (e.g., steel or an alloy thereof, aluminum, and the like), plastic, or the like. The number of brackets 954 engaging any particular support beam 902, as well as the spacing of the brackets 954 along that support beam 902, may vary as desired by a user.

Each baffle 1208 includes a top side 1210. As seen in FIGS. 48-49, the particular embodiment of the baffle 1208 illustrated therein includes four generally parallel baffles 1208 of identical dimensions (e.g., height, length, and thickness). In the alternative, a user may vary the dimensions (e.g., height, length, and thicknesses) of each baffle 1208 in the system 1200 as desired such that all the baffles have different dimensions (e.g., one or more have different height, length, and/or thickness), each baffle has unique dimensions, at least two baffles have identical dimensions but the remaining baffles have different dimensions, etc. In the alternative, at least two baffles 1208 may be generally disposed at an angle relative to each other. In another alternative, at least one baffle 1208 is a curved baffle. In yet another alternative, the support beams 902 are arranged at an angle relative to each other. In a further alternative, at least two baffles 1208 are angled relative to a generally horizontal plane defined by the ceiling system 1200. In still another alternative, the baffle(s) 1208 includes a curved bottom side.

Each of the baffles 1208 may be made using a sheet of one or more sound-absorbing/barrier (acoustical) materials including, but not limited to, fabric-covered synthetic polymer foam, fabric-covered glass wool composite material, or the like. Alternatively, each of the baffles 1208 may be made from other sound-absorbing materials including, but not limited to, synthetic foam or nonwoven polymer (without fabric), or synthetic foam or nonwoven polymer covered by a perforated metallic sheet, wood, wool or the like. In the alternative, each of the baffles 1208 may also be formed from a metallic sheet, a polymeric sheet, or the like.

Each baffle 1208 is engaged to the bottom engagement portion 906 of each support beam 902 by a bracket 1220. Each bracket 1220 interconnects the baffle 1208 and the support beam, and is disposed therebetween. An engagement portion 1222 of the bracket 1220 is disposed within the interior portion of the bottom engagement portion 906. A slot 961 disposed on the lower part of the bottom engagement portion 906 allowing the bracket 1220 access to the interior portion of the bottom engagement portion 906. In this manner, when each particular bracket 1220 engages a particular support beam 902, the engagement portion 1222 of that bracket 1220 engages a bottom side of the interior portion of bottom engagement portion 906 of that particular support beam 902. In the alternative, a bracket 1220 may be attached to a support beam 902 and/or a baffle 1208 by various fasteners including, without limitation, mechanical fasteners, chemical fasteners (e.g., adhesives), or the like.

Figure 50:
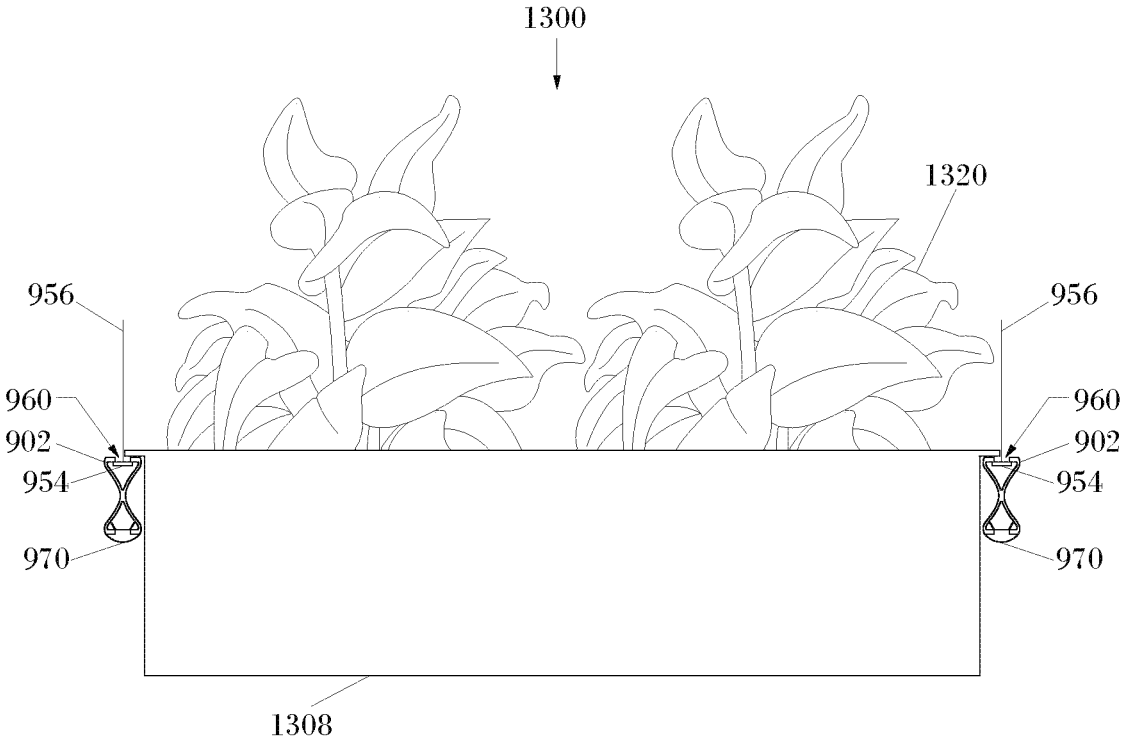
FIG. 50 illustrates a front elevation view of a pair of generally hour-glass cross-sectional shaped support beams indirectly engaging at least one container.

As shown in FIG. 50 for purposes of illustration, another embodiment of the present invention resides in an architectural fixture assembly in the form of a ceiling system 1300. The ceiling system 1300 includes a pair of support beams 902 and a container 1308 supported by the edges of the support beams 902. In the embodiment seen in FIG. 50, there are a pair of support beams 902, and the container 1308 engaging the support beams 902. The support beams 902 are generally parallel, co-planar support beams 902 of identical dimensions (e.g., height, length, thickness, etc.). The container 1308, in the form of an open-top container, can be used as a planter to contain plants 1320 or other objects. The plants 1320 can be living plants or non-living decorative or artificial plants. The interior of the container 1308 may also be adapted for use in conjunction with a variety of devices or objects. For example, one or more light fixtures could be at least partially disposed within the interior portion of the container 1308 (appropriate wiring can be routed to the light fixture(s)). The container 1308 may be made from a light-diffusive material configured to give the container 1308 the appearance of a glow when the light fixture(s) is illuminated. This light-diffusive material may be made from various materials including, without limitation, a thin, non-woven polymer with translucent qualities; a translucent plastic; and the like. The light-diffusive material may diffuse light emitted from the light fixture in a manner that uniformly or non-uniformly diffuses light along the container 1308.

In a further example, the container 1308 can include at least one speaker of an audio system at least partially disposed within the interior portion of the container 1308 (the speaker may be wireless or, if wired, appropriate wiring can be routed to the speaker). In yet another example, a portion of a sprinkler system may be at least partially disposed within the interior portion of the container 1308. In another example, a portion of a Heating Ventilation and Air Conditioning (HVAC) system may be at least partially disposed within the interior portion of the container 1308. In yet an additional example, a router or other wireless system can be at least partially disposed within the interior portion of the container 1308. The above examples are merely illustrative and not limiting. In conjunction with the above examples, the structure of the systems 100, 200, 300, 400, 500, 600, 700, 800, 900, 1000, 1100, 1200, 1300 may be adapted to secure various objects; provide routing of various electrical wiring, cabling (e.g., Ethernet, optical fibers, audio, etc.), water pipes/piping, ducts/ducting, and the like; or otherwise provide for the operation of various devices/equipment. Various features found in individual systems

100, 200, 300, 400, 500, 600, 700, 800, 900, 1000, 1100, 1200, 1300 may be used in other systems 100, 200, 300, 400, 500, 600, 700, 800, 900, 1000, 1100, 1200, 1300.

Various permutations and/or combinations of the above-described systems 100, 200, 300, 400, 500, 600, 700, 800, 900, 1000, 1100, 1200, 1300 can be implemented as well. The above-described systems 100, 200, 300, 400, 500, 600, 700, 800, 900, 1000, 1100, 1200, 1300 employed generally horizontal co-planar support beams but the above-described systems 100, 200, 300, 400, 500, 600, 700, 800, 900, 1000, 1100, 1200, 1300 can be implemented with at least one support beam that is not co-planar with the other support beam(s).

The following is one example of assembling a ceiling system 100, 200, 300, 400, 500, 600, 700, 800, 900, 1000, 1100, 1200, 1300 with variation in assembly depending on the type of system 100, 200, 300, 400, 500, 600, 700, 800, 900, 1000, 1100, 1200, 1300 being assembled. In use, a user selects a desired configuration for a system 100, 200, 300, 400, 500, 600, 700, 800, 900, 1000, 1100, 1200, 1300. In this particular example, the desired configuration chosen is system 100. The selection of the desired configuration includes, without limitation, selecting a desired number, size (e.g., length, height, width), and shape (e.g., longitudinally linear, longitudinally curved, cross-sectional shape (e.g., generally T-shaped, etc.)) of support beams 102; selecting a desired number, size (e.g., length, height, width), and shape (e.g., longitudinally linear, longitudinally curved, cross-sectional shape (e.g., generally rectangular, generally circular, generally square, generally triangular, generally diamond-shaped, generally ovoid, any generally polygonal shape having at least four sides to as many sides as approximating a generally circular shape, generally horizontal top and bottom sides with convex left and right sides, generally horizontal top and bottom sides with concave left and right sides, etc.) of baffles 108; and selecting a desired number, size (e.g., length, height, width), and shape (e.g., generally linear, generally curved, cross-sectional shape (e.g., generally rectangular, generally circular, generally square, generally triangular, generally diamond-shaped, generally ovoid, any generally polygonal shape having at least four sides to as many sides as approximating a generally circular shape, generally horizontal top and bottom sides with convex left and right sides, generally horizontal top and bottom sides with concave left and right sides, etc.)) of covers 116; and selecting a number and type of brackets 154 (as well as selecting the placement of brackets 154 along the lengths of each support beam 102). The system 100 is then assembled in any order desired by the user.

For example, each of the covers 116 may be engaged to one of the support beam 102 in a manner identical/similar to the one described above. The engagement of the cover 116 and support beam 102 may be accomplished by pressing entire length of the bulb portion 109 of the vertical web portion 106 against the entire length of the slit 150 of the cover 116, or by pressing one of the ends of the bulb portion 109 against one of the ends of the slit 150 until that end of the bulb portion 109 engages the second section 182 of the cover slot 180 of the cover 116 and then inserting more of the bulb portion 109 through the slit 150 into the second section 182 of the cover slot 180 as the users makes their way down the length of the support beam 102. This engagement process can be repeated for each paired support beam 102/cover 116. A desired number of brackets 154 (and desired spacing between brackets 154 on each support beam 102 having at least two brackets 154) may then be attached to each of the support beams 102. An appropriate number of cables 156 may then be connected to a ceiling (at least one cable 156 for every bracket 154). Each cable 156 has an appropriate length such that the system 100 hangs a desired distance below the ceiling. The brackets 154 of each support beam 102/cover 116 pair are then engaged to cables 156 appropriate for positioning that support beam 102/cover 116 appropriately within the selected configuration of that system 100. Baffles 108 are then attached to each engaged support beam 102/cover 116 pair (e.g., as described above) such that the baffles 108 are in the desired configuration of the system 100.

The architectural fixtures may include various patterns, features, designs, logos, cartoons, or the like for ornamental purposes. The architectural fixtures may be monochromatic, or include various patterns (e.g., multi-color stripes, polka dots or the like) or the like for ornamental purposes.

Although the present invention has been discussed above in the context of attachment to a horizontal ceiling or vertical wall surface, the present invention may also be connected directly to or indirectly from various other surfaces.

In addition, the claimed invention is not limited in size and may be constructed in various sizes (e.g., miniature versions; large-scale versions) in which the same or similar principles of motion and friction control as described above would apply. Furthermore, the FIGS. (and various components shown therein) of the specification are not to be construed as drawn to scale.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A cover for use in a ceiling system, the cover comprising:

an elongated cover body extending along a cover axis from a first end to a second end, the elongated cover body comprising a floor portion and first and second sidewall portions extending upward from the floor portion in an opposing manner;

a cover slot in a top surface of the elongated cover body and extending downward into the elongated cover body between the first and second sidewall portions, the cover slot having a narrowed section and a widened section below the narrowed section;

a plurality of transverse cover notches arranged in a spaced apart manner along the elongated cover body, each of the plurality of transverse cover notches formed in a bottom portion of the elongated cover body and intersecting the widened section and at least a portion of the narrowed section of the cover slot; and the first sidewall portion of the elongated cover body comprising a first downward facing shoulder that defines a first roof portion of the widened section of the cover slot, and the second sidewall portion of the elongated cover body comprising a second downward facing shoulder that defines a second roof portion of the widened section of the cover slot.

2. The cover according to claim 1 wherein the narrowed section of the cover slot has a maximum transverse width that is less than a maximum transverse width of the widened section of the cover slot.

3. The cover according to claim 2 wherein the narrowed section of the cover slot has a substantially constant transverse width and wherein the widened section of the cover slot has a transverse width that is constant or increases moving from the floor portion to a transition region and then decreases moving from the transition region to the narrowed section.

4. The cover according to claim 1 wherein the cover slot extends along a slot axis, and wherein each of the first and second downward facing shoulders are oriented at an oblique angle relative to the slot axis.

5. The cover according to claim 1 wherein the floor portion of the elongated cover body extends between and connects the first and second sidewall portions of the elongated cover body together.

6. The cover according to claim 1 wherein the elongated cover body is a singular one-piece component formed from a sound absorbing material.

7. The cover according to claim 1 wherein the cover slot extends from the first end to the second end of the elongated cover body.

8. The cover according to claim 1 wherein the elongated cover body is formed of an acoustic absorbing material.

9. The cover according to claim 1 wherein the elongated cover body is configured so that the first and second sidewall portions can be flexed away from one another upon application of outward forces to inner surfaces of the first and second sidewall portions and the first and second sidewall portions return to their non-flexed state upon cessation of the outward forces.

10. The cover according to claim 1 wherein the widened section of the cover slot has a diamond-shaped transverse cross-sectional area.

11. The cover according to claim 1 wherein the elongated cover body comprises an elongated sheet that is alterable from a flat state to a folded state by folding the first and second sidewall portions relative to the floor portion.

12. The cover according to claim 11 wherein the elongated cover body is configured to be maintained in the folded state by an adhesive located along an interface between the floor portion and each of the first and second sidewall portions.

13. A cover for use in a ceiling system, the cover comprising:

an elongated cover body extending along a cover axis from a first end to a second end, the elongated cover body comprising a bottom surface, a top surface, a first sidewall portion, and a second sidewall portion;

a cover slot extending from an opening in the top surface of the elongated cover body downwardly into the elongated cover body between the first and second sidewall portions; and a plurality of transverse cover notches arranged in a spaced apart manner along the elongated cover body, each of the plurality of transverse cover notches extending from the bottom surface of the elongated cover body to an end wall that is located between the top surface of the elongated cover body and the bottom surface of the elongated cover body, wherein the plurality of transverse cover notches do not extend to the top surface of the elongated cover body.

14. The cover according to claim 13 wherein the cover slot has a narrowed section and a widened section below the narrowed section.

15. The cover according to claim 14 wherein the widened section of the cover slot has a diamond-shaped transverse cross-sectional area.

16. The cover according to claim 13 wherein the opening in the top surface is elongated in a direction of the cover axis and extends continuously from the first end of the elongated cover body to the second end of the elongated cover body.

17. The cover according to claim 13 wherein the elongated cover body further comprises a floor portion, the first and second sidewall portions extending upwardly from the floor portion to the top surface of the elongated cover body.

18. A cover for use in a ceiling system, the cover comprising:

an elongated cover body extending along a cover axis from a first end to a second end, the elongated cover body comprising a floor portion and first and second sidewall portions extending upward from the floor portion in an opposing manner;

a cover slot in a top surface of the elongated cover body and extending downward into the elongated cover body between the first and second sidewall portions, the cover slot having a narrowed section and a widened section below the narrowed section, wherein the narrowed section of the cover slot has a substantially constant transverse width and wherein the widened section of the cover slot has a transverse width that increases moving from the floor portion to a transition region and then decreases moving from the transition region to the narrowed section;

a plurality of transverse cover notches arranged in a spaced apart manner along the elongated cover body, each of the plurality of transverse cover notches formed in a bottom portion of the elongated cover body and intersecting the widened section and at least a portion of the narrowed section of the cover slot.

19. The cover according to claim 18 wherein the widened section of the cover slot has a diamond-shaped transverse cross-sectional area.

* * * * *